US010876812B2

(12) United States Patent
Parise

(10) Patent No.: US 10,876,812 B2
(45) **Date of Patent: *Dec. 29, 2020**

(54) SELF-DEFENSE APPARATUS

(71) Applicant: Richard Parise, Sparks, NV (US)

(72) Inventor: Richard Parise, Sparks, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/692,876

(22) Filed: Nov. 22, 2019

(65) Prior Publication Data

US 2020/0256635 A1 Aug. 13, 2020

Related U.S. Application Data

(63) Continuation of application No. 16/274,496, filed on Feb. 13, 2019, now Pat. No. 10,520,277.

(51) Int. Cl.

| | |
|---|---|
| ***F41B 15/00*** | (2006.01) |
| ***F41H 9/10*** | (2006.01) |
| ***F41B 15/02*** | (2006.01) |
| ***F41B 15/06*** | (2006.01) |

(Continued)

(52) U.S. Cl.

CPC ..... *F41B 15/00* (2013.01); *F41B 15/02* (2013.01); *F41B 15/06* (2013.01); *F41H 9/10* (2013.01); *F21V 33/0064* (2013.01); *F41B 15/022* (2013.01); *F41B 15/025* (2013.01); *F41B 15/027* (2013.01); *G08B 15/004* (2013.01)

(58) Field of Classification Search

CPC ..... F41B 15/00; F41B 15/02; F41B 15/022; F41B 15/025; F41B 15/027; F41B 15/06; F21V 33/0064; F41H 9/10; G08B 15/004

USPC ..... 463/47.2, 47.4

See application file for complete search history.

(56) References Cited

U.S. PATENT DOCUMENTS

| | | | |
|---|---|---|---|
| 2,099,447 | A | 11/1937 | Matsuyama |
| 3,106,398 | A | 10/1963 | Gowdey |
| D205,456 | S | 8/1966 | Combs |

(Continued)

FOREIGN PATENT DOCUMENTS

| | | | |
|---|---|---|---|
| WO | 9007959 | A1 | 7/1990 |

OTHER PUBLICATIONS

FURY Tactical 77730 Pepper-STRIKE Pressure Point Device with .50 oz Pepper Spray, http://www.joy-247.com/product.php?id_product=594, retrieved Mar. 7, 2016.

(Continued)

*Primary Examiner* — William H McCulloch, Jr.

(74) *Attorney, Agent, or Firm* — Honigman LLP; Brett A. Krueger

(57) ABSTRACT

A self-defense apparatus includes a sleeve portion and an adapter connected to the sleeve portion. The sleeve portion includes a proximal end surface, an outer side surface, and a distal end surface. The sleeve portion defines an implement-receiving cavity that extends axially into the proximal end surface. The sleeve portion defines an adapter-receiving passage that extends axially into the distal end surface. A proximal portion of the outer side surface defines a handle portion that includes one or more finger grooves. A distal portion of the outer side surface defines an adapter-interfacing body. A first portion of the adapter body is disposed within the adapter-receiving passage. A second portion of the adapter body extends beyond the distal end surface. A distal portion of the second portion of the adapter body defines a conical body.

20 Claims, 44 Drawing Sheets

(51) Int. Cl.
*F21V 33/00* (2006.01)
*G08B 15/00* (2006.01)

(56) References Cited

U.S. PATENT DOCUMENTS

| | | | | |
|---|---|---|---|---|
| 5,033,142 | A | 7/1991 | Templeton | |
| 5,330,181 | A * | 7/1994 | Wong | F41B 15/02 30/295 |
| 5,347,436 | A * | 9/1994 | Clyde | F21L 15/02 362/102 |
| 5,454,565 | A | 10/1995 | Ramirez | |
| 6,196,419 | B1 * | 3/2001 | Haney | B65D 83/202 222/153.03 |
| D627,852 | S * | 11/2010 | Yang-Fu | D22/117 |
| D630,292 | S * | 1/2011 | Yang-Fu | D22/117 |
| 7,887,211 | B2 | 2/2011 | Summers | |
| 8,747,233 | B1 * | 6/2014 | Klein | F41G 1/35 463/47.7 |
| 8,956,235 | B2 * | 2/2015 | Cheng | F41B 15/027 463/47.2 |
| D753,261 | S * | 4/2016 | Griffin | D22/117 |
| 9,671,192 | B2 * | 6/2017 | Cheng | F41B 15/00 |
| D811,515 | S * | 2/2018 | Parise | D22/117 |
| 10,054,305 | B1 * | 8/2018 | Slepack | G08B 15/02 |
| D829,297 | S * | 9/2018 | Sheikh | D22/117 |
| D829,298 | S * | 9/2018 | Parise | D22/117 |
| D841,761 | S * | 2/2019 | Lin | D22/117 |
| 10,502,522 | B2 * | 12/2019 | Tanzini | F41B 15/00 |
| 10,520,277 | B1 * | 12/2019 | Parise | F41B 15/02 |
| 2004/0129730 | A1 * | 7/2004 | Parsons | F41H 9/10 222/153.11 |
| 2005/0279769 | A1 * | 12/2005 | Cellini | F41H 9/10 222/192 |
| 2008/0245818 | A1 * | 10/2008 | Strickland | F41H 9/10 222/113 |
| 2010/0304874 | A1 * | 12/2010 | Abatemarco | F41H 9/10 463/47.3 |
| 2011/0053694 | A1 * | 3/2011 | Wood | F41B 15/06 463/47.4 |
| 2012/0122593 | A1 * | 5/2012 | Gross | F21L 4/005 463/47.4 |
| 2013/0176711 | A1 * | 7/2013 | Bushee | A45B 3/04 362/102 |
| 2014/0334131 | A1 * | 11/2014 | Bushee | F41B 15/022 362/102 |
| 2016/0012701 | A1 * | 1/2016 | Lu | G08B 25/016 222/183 |
| 2016/0298939 | A1 * | 10/2016 | Kuo | F41B 15/027 |
| 2020/0256635 | A1 * | 8/2020 | Parise | F41B 15/02 |

OTHER PUBLICATIONS

UPC No. 766359777306 is associated with Fury Pepperstrike, http://www.upcindex.com/766359777306, retrieved Mar. 7, 2016.

* cited by examiner

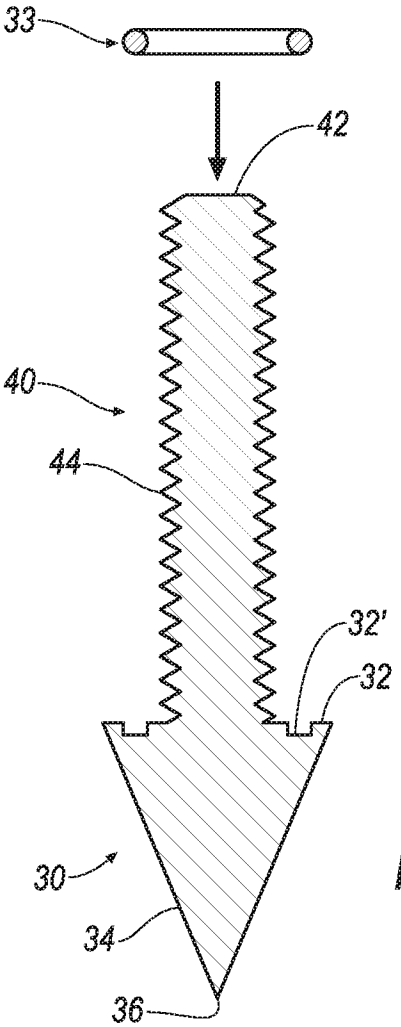
FIG. 12C$_1$''
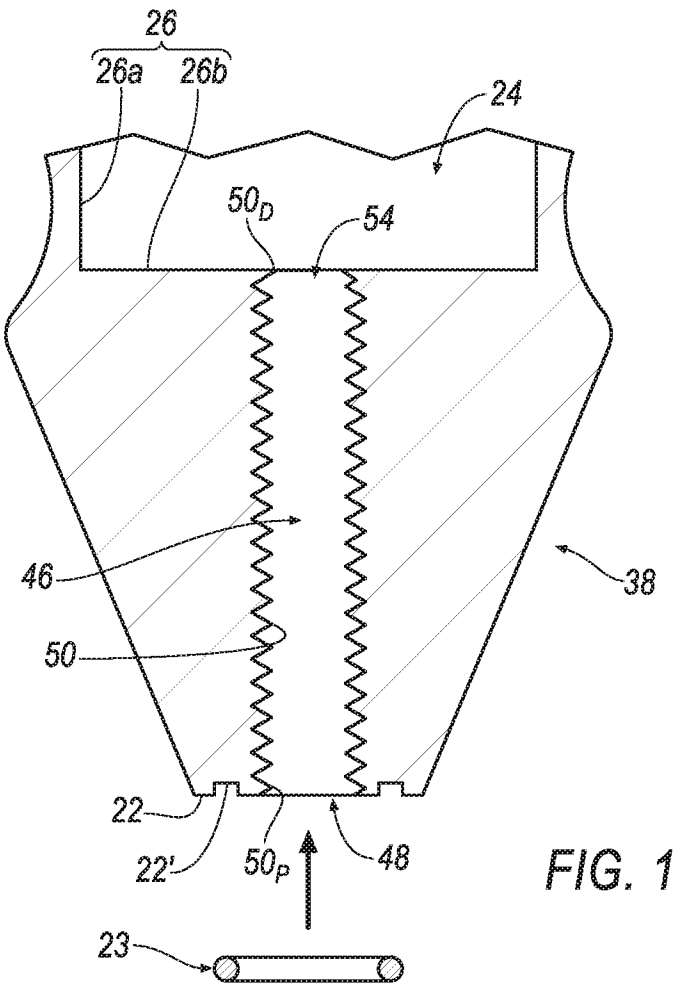
FIG. 12C$_1$'

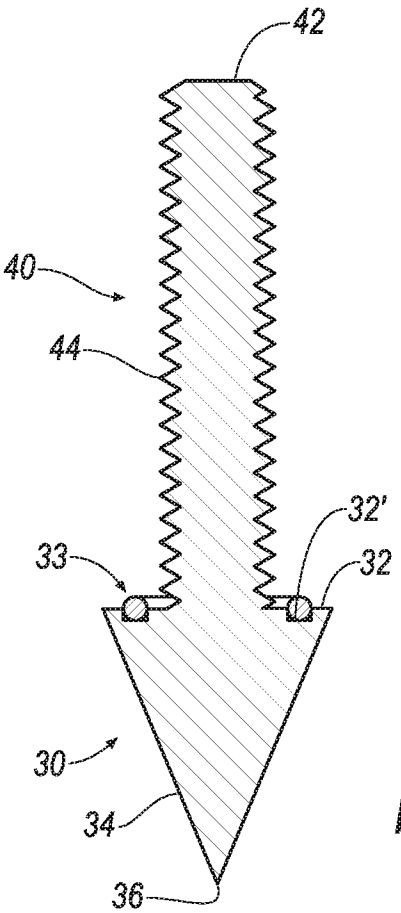
FIG. 12C$_2$''
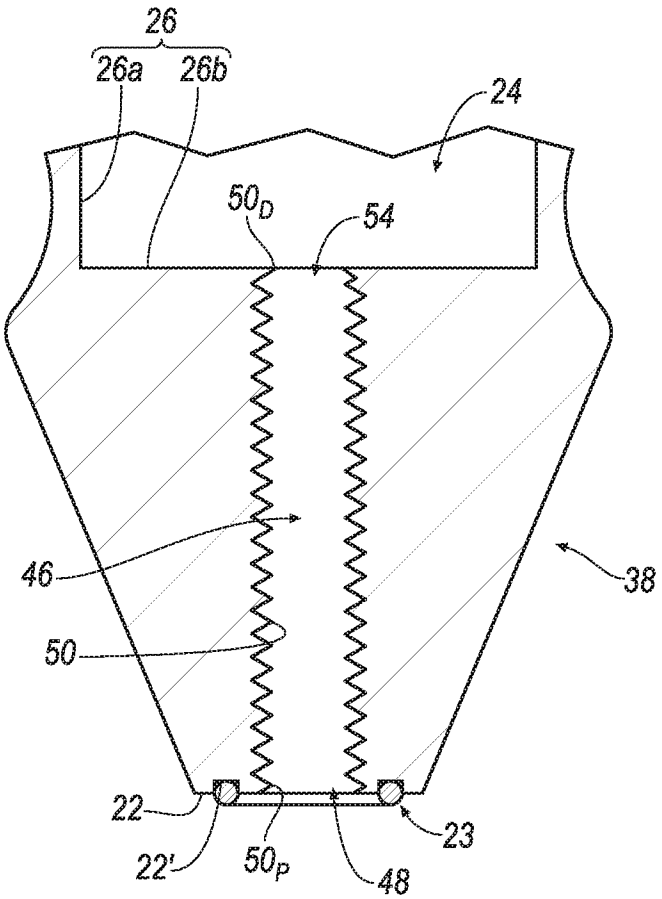
FIG. 12C$_2$'

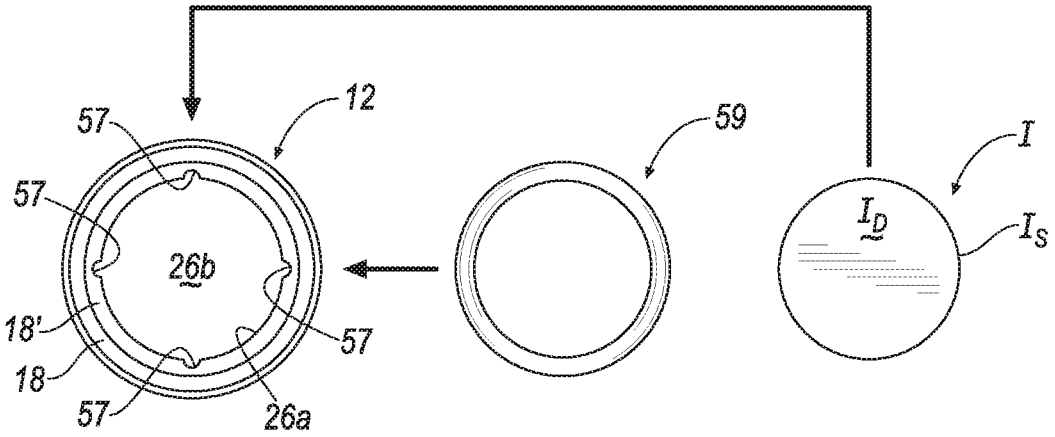
FIG. 13'
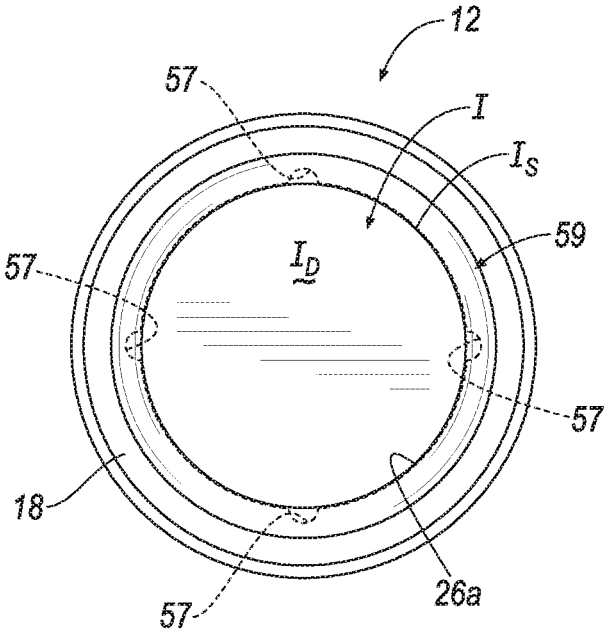
FIG. 13"

SELF-DEFENSE APPARATUS

CROSS REFERENCE TO RELATED APPLICATIONS

This U.S. patent application is a continuation of, and claims priority under 35 U.S.C. § 120 from, U.S. patent application Ser. No. 16/274,496, filed on Feb. 13, 2019, which is hereby incorporated by reference in its entirety.

TECHNICAL FIELD

The disclosure relates to a portion of a self-defense apparatus, a self-defense apparatus, and an assembly including the same.

BACKGROUND

A variety of self-defense devices are known. While existing self-defense device perform adequately for their intended purpose, improvements to self-defense devices are continuously being sought in order to advance the arts.

SUMMARY

One aspect of the disclosure provides a self-defense apparatus that includes a sleeve portion and an adapter portion connected to the sleeve portion. The sleeve portion includes a proximal end surface, an outer side surface, and a distal end surface. The sleeve portion defines an implement-receiving cavity that extends axially into the proximal end surface. The sleeve portion defines an adapter-receiving passage that extends axially into the distal end surface. A proximal portion of the outer side surface defines a handle portion that includes one or more finger grooves. A distal portion of the outer side surface defines an adapter-interfacing body. A first portion of the adapter body is disposed within the adapter-receiving passage. A second portion of the adapter body extends beyond the distal end surface. A distal portion of the second portion of the adapter body defines a conical body.

Another aspect of the disclosure provides a self-defense apparatus that includes a sleeve portion and an adapter body connected to the sleeve portion. The sleeve portion is formed from a non-metallic material and the adapter body is formed from a metallic material. The sleeve portion includes a proximal end surface, an outer side surface, and a distal end surface. The sleeve portion defines an implement-receiving cavity that extends axially into the proximal end surface. The sleeve portion defines an adapter-receiving passage that extends axially into the distal end surface. A proximal portion of the outer side surface defines a handle portion that includes one or more finger grooves. A distal portion of the outer side surface defines an adapter-interfacing body. A first portion of the adapter body is disposed within the adapter-receiving passage. A second portion of the adapter body extends beyond the distal end surface. A distal portion of the second portion of the adapter body defines a conical body.

In yet another aspect, a self-defense apparatus includes a sleeve portion formed from a non-metallic material and an adapter body formed from a metallic material that are integrated by over-molding the non-metallic material over the metallic material. The sleeve portion includes a proximal end surface, an outer side surface, and a distal end surface. The sleeve portion defines an implement-receiving cavity that extends axially into the proximal end surface. The sleeve portion defines an adapter-receiving passage that extends axially into the distal end surface. A proximal portion of the outer side surface defines a handle portion that includes one or more finger grooves. A distal portion of the outer side surface defines an adapter-interfacing body. A first portion of the adapter body is disposed within the adapter-receiving passage. A second portion of the adapter body extends beyond the distal end surface. A distal portion of the second portion of the adapter body defines a conical body.

One aspect of the disclosure provides a self-defense apparatus that includes a sleeve portion including one of a fastener or a fastener-receiving passage. The sleeve portion includes a proximal sleeve portion and a distal sleeve portion. The sleeve portion also includes a proximal end surface, an outer side surface, and a distal end surface. The sleeve portion defines an implement-receiving cavity that extends axially into the proximal end surface. The proximal end surface and a proximal portion of the outer side surface define a handle portion of the sleeve portion. The distal end surface and a distal portion of the outer side surface define a distal sleeve portion having an adapter-interfacing body of the sleeve portion. The self-defense apparatus also includes an adapter portion connected to the sleeve portion. The adapter portion includes the other of the fastener or the fastener-receiving passage. The adapter portion includes a proximal end surface, an outer side surface, and a distal end surface. The outer side surface and the distal end surface of the adapter portion define an adapter body. The self-defense apparatus also includes a weapon defined by the adapter body and the adapter-interfacing body.

Implementations of the disclosure may include one or more of the following optional features. In some implementations, the implement-receiving cavity is sized for selectively retaining at least a portion of a length of an implement. Moreover, the implement-receiving cavity may be cylindrically shaped, and/or the implement may be cylindrically shaped. The cylindrically-shaped implement may include one of an aerosol spray canister or a flashlight or strobe light. In some implementations, the distal portion of the outer side surface defines one or a combination of: one or more finger grooves or finger channels that is/are sized for receiving fingers of a user; a frictional or knurled surface; a plurality of connected finger-receiving loops; a primary weapon attachment portion; or a combat clothing attachment portion.

In some implementations, the fastener-receiving passage is not in fluid communication with the implement-receiving cavity. In additional examples, one or both of the handle portion of the sleeve portion and the adapter-interfacing body of the sleeve portion defines one or more cavity vacuum-relief air passages that is/are in fluid communication with the implement-receiving cavity. The self-defense apparatus may include one or more seals that seal one or more cavity vacuum-relief air passages.

In alternative implementations, the fastener-receiving passage is in fluid communication with the implement-receiving cavity. One or both of the distal end surface of the sleeve portion and the proximal end surface of the adapter portion may form a groove that is sized for receiving a seal for sealing an air gap between the distal end surface of the sleeve portion and the proximal end surface of the adapter portion that is in fluid communication with the fastener-receiving passage that is in fluid communication with the implement-receiving cavity. The self-defense apparatus may include one or more implement retainers secured to an inner side surface that defines the implement-receiving cavity. The inner side surface that defines the implement-receiving cavity may define one or more grooves that is/are sized to receive the one or more implement retainers. The self-defense apparatus may further include a biometric retainer that is sized for being disposed between the distal end surface of the sleeve portion and the proximal end surface of the adapter portion. In some examples, one or both of the sleeve portion or the adapter portion defines one or more biometric-retaining grooves. The self-defense apparatus may further include one or more biometric retainers disposed within the one or more biometric-retaining grooves.

Each of the fastener and the fastener-receiving passage may define a threaded surface for permitting the adapter portion to be removably coupled to the sleeve portion. The fastener may be a one-way fastener, and the fastener-receiving passage may be a one-way fastener-receiving passage where the adapter portion is non-removably coupled to the sleeve portion.

Another aspect of the disclosure provides an assembly that includes an implement and a self-defense apparatus. The self-defense apparatus includes a sleeve portion including one of a fastener or a fastener-receiving passage. The sleeve portion includes a proximal sleeve portion and a distal sleeve portion. The sleeve portion also includes a proximal end surface, an outer side surface, and a distal end surface. The sleeve portion defines an implement-receiving cavity that extends axially into the proximal end surface. The proximal end surface and a proximal portion of the outer side surface define a handle portion of the sleeve portion. The distal end surface and a distal portion of the outer side surface define a distal sleeve portion having an adapter-interfacing body of the sleeve portion. The self-defense apparatus also includes an adapter portion connected to the sleeve portion. The adapter portion includes the other of the fastener or the fastener-receiving passage. The adapter portion includes a proximal end surface, an outer side surface, and a distal end surface. The outer side surface and the distal end surface of the adapter portion define an adapter body. The self-defense apparatus also includes a weapon defined by the adapter body and the adapter-interfacing body Implementations of this aspect of the disclosure may include one or more of the following optional features. The implement may include one of an aerosol spray canister or a flashlight or strobe light. In some implementations, the distal portion of the outer side surface defines one or a combination of: one or more finger grooves or finger channels that is/are sized for receiving fingers of a user; a frictional or knurled surface; a plurality of connected finger-receiving loops; a primary weapon attachment portion; or a combat clothing attachment portion.

In yet another aspect, a portion of a self-defense apparatus includes an adapter portion. The portion of the self-defense apparatus includes a sleeve portion including one of a fastener or a fastener-receiving passage. The sleeve portion includes a proximal sleeve portion and a distal sleeve portion. The sleeve portion also includes a proximal end surface, an outer side surface, and a distal end surface. The sleeve portion defines an implement-receiving cavity that extends axially into the proximal end surface. The proximal end surface and a proximal portion of the outer side surface define a handle portion of the sleeve portion. The distal end surface and a distal portion of the outer side surface define a distal sleeve portion having an adapter-interfacing body of the sleeve portion. The portion of the self-defense apparatus also includes a portion of a weapon defined by the adapter-interfacing body.

Implementations of this aspect may include one or more of the following optional features. The implement-receiving cavity may be sized for selectively retaining at least a portion of a length of an implement. In some examples, the implement-receiving cavity is cylindrically shaped, and/or the implement is cylindrically shaped. The cylindrically-shaped implement may include one of an aerosol spray canister or a flashlight or strobe light. In some implementations, the distal portion of the outer side surface defines one or a combination of: one or more finger grooves or finger channels that is/are sized for receiving fingers of a user; a frictional or knurled surface; a plurality of connected finger-receiving loops; a primary weapon attachment portion; or a combat clothing attachment portion.

In some implementations, the fastener-receiving passage is not in fluid communication with the implement-receiving cavity. In additional examples, one or both of the handle portion of the sleeve portion and the adapter-interfacing body of the sleeve portion defines one or more cavity vacuum-relief air passages that is/are in fluid communication with the implement-receiving cavity. The self-defense apparatus may include one or more seals that seal one or more cavity vacuum-relief air passages.

In alternative implementations, the fastener-receiving passage is in fluid communication with the implement-receiving cavity. One or both of the distal end surface of the sleeve portion and the proximal end surface of the adapter portion may form a groove that is sized for receiving a seal for sealing an air gap between the distal end surface of the sleeve portion and the proximal end surface of the adapter portion that is in fluid communication with the fastener-receiving passage that is in fluid communication with the implement-receiving cavity. The self-defense apparatus may include one or more implement retainers secured to an inner side surface that defines the implement-receiving cavity. The inner side surface that defines the implement-receiving cavity may define one or more grooves that is/are sized to receive the one or more implement retainers. The self-defense apparatus may further include a biometric retainer that is sized for being disposed between the distal end surface of the sleeve portion and the proximal end surface of the adapter portion. In some examples, one or both of the sleeve portion or the adapter portion defines one or more biometric-retaining grooves. The self-defense apparatus may further include one or more biometric retainers disposed within the one or more biometric-retaining grooves.

Each of the fastener and the fastener-receiving passage may define a threaded surface for permitting the adapter portion to be removably coupled to the sleeve portion. The fastener may be a one-way fastener, and the fastener-receiving passage may be a one-way fastener-receiving passage where the adapter portion is non-removably coupled to the sleeve portion.

Another aspect includes a portion of a self-defense apparatus that includes a sleeve portion. The portion of the self-defense apparatus includes an adapter portion including one of a fastener or a fastener-receiving passage. The adapter portion includes a proximal end surface, an outer side surface, and a distal end surface. The outer side surface and the distal end surface of the adapter portion define an adapter body. The portion also includes a weapon defined by the adapter body.

Implementations of this aspect of the disclosure may include one or more of the following optional features. In some implementations, the proximal end surface of the adapter portion forms a groove that is sized for receiving a seal for sealing an air gap between a distal end surface of the sleeve portion and the proximal end surface of the adapter portion that is in fluid communication with a fastener-receiving passage extending through the sleeve portion that is in fluid communication with an implement-receiving cavity. In some examples, the adapter portion defines one or more biometric-retaining grooves. The portion of the self-defense apparatus may further include one or more biometric retainers disposed within the one or more biometric-retaining grooves. In some examples, the portion of the self-defense apparatus includes a biometric retainer that is sized for being disposed between a distal end surface of the sleeve portion and the proximal end surface of the adapter portion.

Each of the fastener and the fastener-receiving passage may define a threaded surface for permitting the adapter portion to be removably coupled to the sleeve portion. The fastener may be a one-way fastener, and the fastener-receiving passage may be a one-way fastener-receiving passage where the adapter portion is non-removably coupled to the sleeve portion.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 12$C_1$'-12$C_2$' are enlarged views of an exemplary sleeve portion and a seal for assembling the self-defense assembly of FIGS. 7-9.

FIG. 12$C_1$"-12$C_2$" are enlarged views of an exemplary adapter portion and a seal for assembling the self-defense assembly of FIGS. 7-9.

FIG. 13' is a proximal end exploded view of any of the exemplary sleeve portions and a proximal seal of FIGS. 13A-13C, 14A-14C and 15A-15C.

FIG. 13" is a proximal end assembled view of any of the exemplary sleeve portions and the proximal seal of FIGS. 13'.

Like reference symbols in the various drawings indicate like elements.

DETAILED DESCRIPTION

The figures illustrate exemplary implementations of self-defense apparatuses and components of self-defense apparatuses. Based on the foregoing, it is to be generally understood that the nomenclature used herein is simply for convenience and the terms used to describe the invention should be given the broadest meaning by one of ordinary skill in the art.

Figure 1:
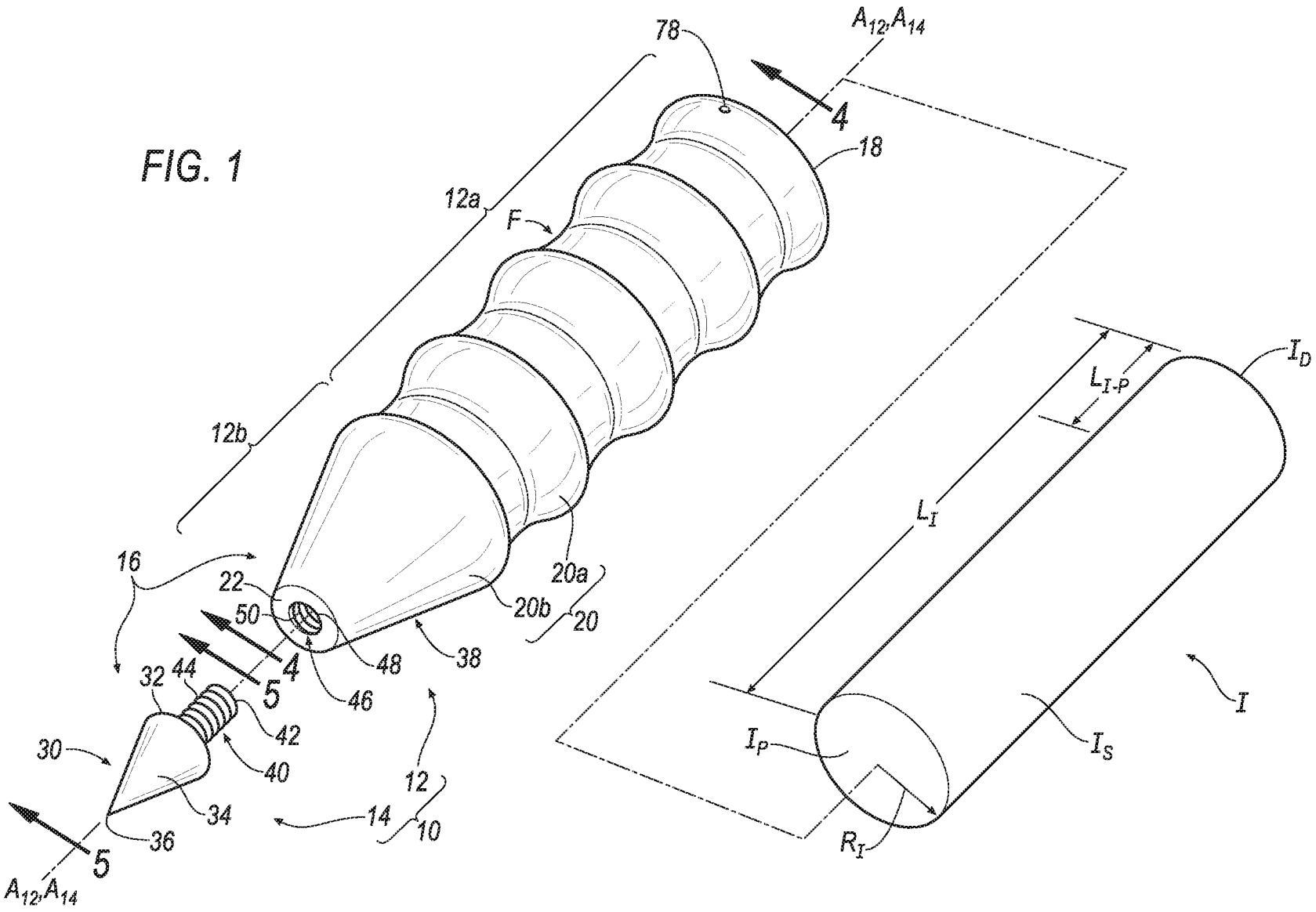
FIG. 1 is an exploded view of an exemplary self-defense apparatus having a handle portion defining a plurality of finger-receiving grooves.
Figure 2:
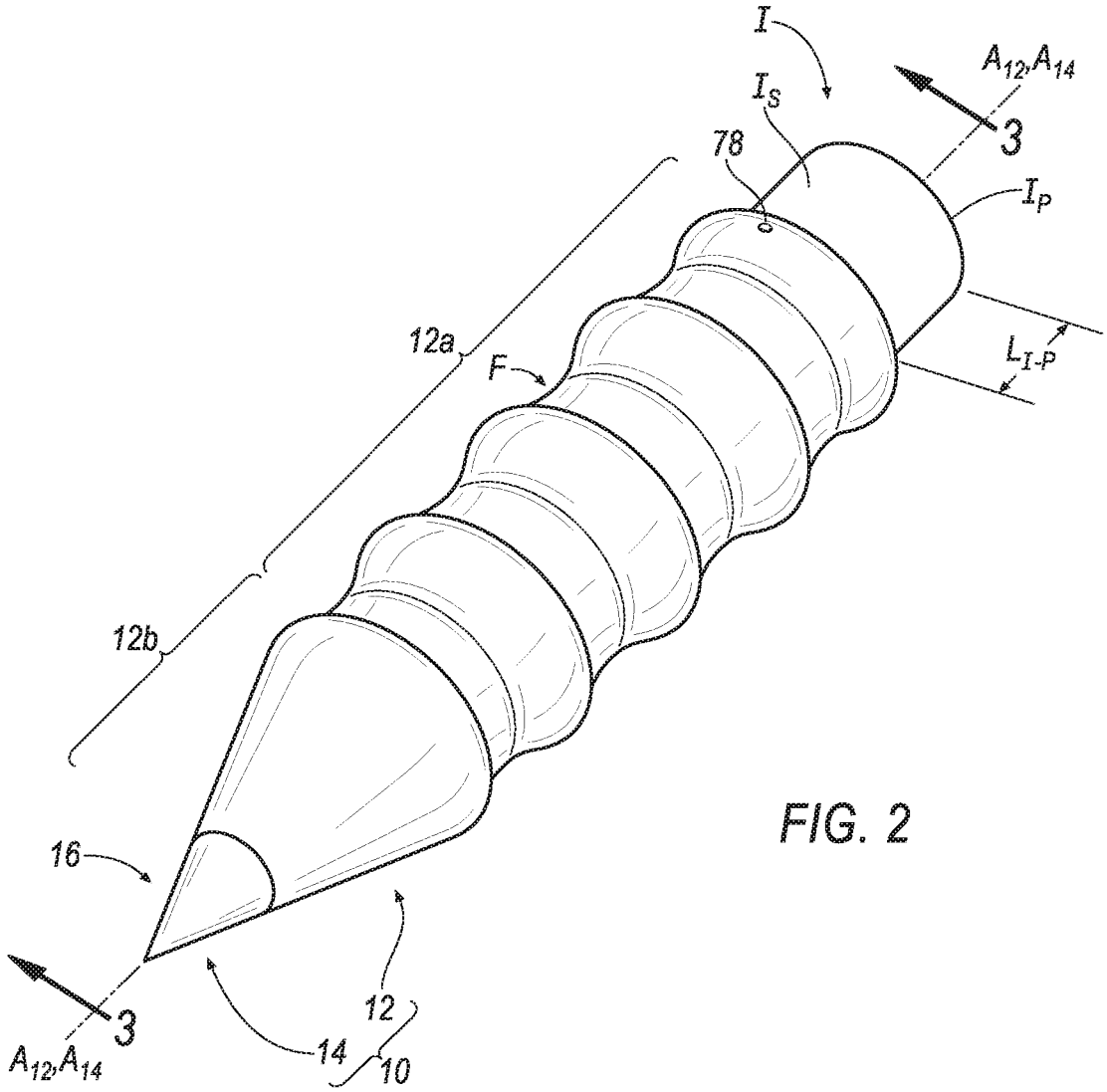
FIG. 2 is an assembled view of the self-defense apparatus of FIG. 1.

Referring to FIGS. 1 and 2, a self-defense assembly is shown generally at 10. The self-defense assembly 10 is sized for selectively-retaining a substantially cylindrical implement I. An exemplary substantially cylindrical implement I includes, for example, an aerosol spray canister (e.g., pepper spray, bear spray, Chemical Mace or the like). Another exemplary substantially cylindrical implement I includes, for example, a flashlight, strobe light or the like. Although an aerosol spray canister, flashlight or strobe light are described above as exemplary substantially cylindrical implements I that may be selectively retained by the self-defense assembly 10, the self-defense assembly 10 may be sized for selectively retaining any type of substantially cylindrical implement I, and, therefore, is not limited to selectively retaining an aerosol spray canister, flashlight or strobe light or the like.

The self-defense assembly 10 includes a sleeve portion 12 and an adapter portion 14. In some implementations, as seen, for example, at FIG. 1, the sleeve portion 12 and the adapter portion 14 are separate components that are selectively joined or removably attached together by way of, for example, a male-female connection (with reference to FIG. 1, see, e.g., a male portion 40 extending from the adapter portion 14 and a female portion 46 extending into the sleeve portion 12). Although some exemplary implementations include the adapter portion 14 including the male portion 40 and the sleeve portion 12 including the female portion 46 is described above, an alternative design of the self-defense assembly 10 include the adapter portion 14 having the female portion 46 and the sleeve portion 12 including the male portion 40. In yet another example, the sleeve portion 12 and the adapter portion 14 are separate components that are integrated (e.g., over-molded, co-molded or the like) in a removably attached or a non-removably attached configuration during a manufacturing process. In yet other implementations, the sleeve portion 12 and the adapter portion 14 is integrated as one component from one material during a manufacturing process.

The chosen material for the design of each of the sleeve portion 12 and the adapter portion 14 may be related to optimizing one or more functions of each of the sleeve portion 12 and the adapter portion 14. In some examples, the sleeve portion 12 generally provides one or more functions being: (1) providing an outer gripping surface (see, e.g., surface 20*a*) that may be grasped by a user; (2) selectively-retaining an implement within a cavity (see, e.g., cavity 24 at FIG. 3) formed by the sleeve portion 12; and (3) collecting assailant biometrics (e.g., blood, skin tissue, hair and the like) within grooves and/or gaps (see, e.g., grooves 66 at FIGS. 19A-19B, 20A-20B, 21A-21B, 22A-22B) and/or biometric retainers (see, e.g., biometric retainers 68, 70, 74 at FIGS. 19A-19B, 20A-20B, 21A-21B, 22A-22B). Furthermore, the adapter portion 14 may generally provide one or more functions being: (1) providing a leading portion of a weapon that is to be wielded by the user; (2) selectively retaining an implement within a cavity formed by the sleeve portion 12 (see, e.g., male portion 40 of the adapter portion 14 that selectively seals the cavity 24 of the sleeve portion 12 at FIGS. 7-11 and 12A-12D); and (3) collecting assailant biometrics (e.g., blood, skin tissue, hair and the like) within grooves and/or gaps (see, e.g., grooves 66 at FIGS. 19A-19B, 20A-20B, 21A-21B, 22A-22B) and/or biometric retainers (see, e.g., biometric retainers 68, 70, 74 at FIGS. 19A-19B, 20A-20B, 21A-21B, 22A-22B).

In some examples, the sleeve portion 12 and the adapter portion 14 are each be formed from a different material. In other examples, the sleeve portion 12 and the adapter portion 14 are separate components formed from similar materials.

In some implementations, the sleeve portion 12 is formed from an anodized aluminum and the adapter portion 14 is formed from a hardened steel. The adapter portion 14 may be formed from a first material that is harder or more rigid than a second, different material that defines the sleeve portion 12; accordingly, the adapter portion 14 may be formed from first material defined by a metallic material or rigid plastic material whereas the sleeve portion 12 may be formed from a second material defined by, for example, a non-metallic material, a less rigid plastic material, a flexible plastic material or a non-plastic flexible material, such as, for example a rubber material or a neoprene material.

With reference to FIGS. 1 and 2, the sleeve portion 12 may be generally defined by a proximal sleeve portion 12*a* and a distal sleeve portion 12*b*. The proximal sleeve portion 12*a* may be alternatively referred to as a handle portion of the self-defense assembly 10. The distal sleeve portion 12*b* defines a portion of a weapon 16 of the self-defense assembly 10.

The distal sleeve portion 12*b* and the adapter portion 14 may define the weapon 16. The distal sleeve portion 12*b* may be alternatively referred to as a trailing portion of the weapon 16. The adapter portion 14 may be alternatively referred to as a leading portion of the weapon 16.

Figure 4:
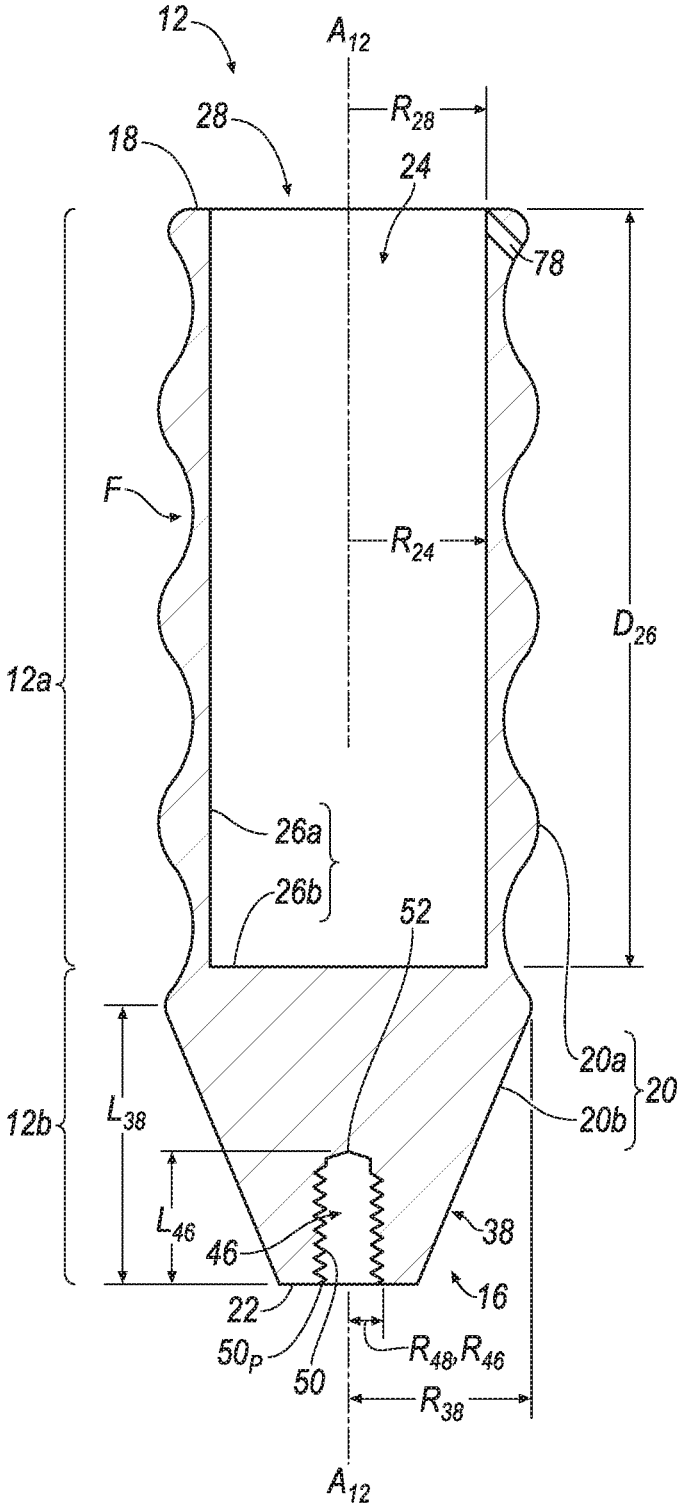
FIG. 4 is a cross-sectional view of an exemplary sleeve portion of the self-defense apparatus according to line 4-4 of FIG. 1.

Referring to FIG. 4, exemplary configurations of the sleeve portion 12 will now be described. The self-defense apparatus 10, however, is not limited to the design of the sleeve portion 12 seen at FIG. 4, and, therefore, other exemplary designs of the sleeve portion 12 (see, e.g., alternative configurations of the sleeve portion 12 at FIGS. 9, 12$C_1$'-12$C_2$', 13A-13C, 13', 13", 14A-14C, 15A-15C, 16A-16C, 17A-17C, 18A-18C, 19A-19B, 21A-21, 22A-22B and 23A-23B) may be utilized in combination with the adapter portion 14 (see also, e.g., alternative configurations of the adapter portion 14 at FIGS. 11, 12$C_1$"-12$C_2$", 20A-20B, 21A-21B, 22A-22B and 23A-23B) for assembling the self-defense apparatus 10.

As seen at FIG. 4, the exemplary sleeve portion 12 includes a proximal end surface 18, an outer side surface 20 and a distal end surface 22. A proximal portion of the outer side surface 20 is shown generally at 20*a*; the proximal portion 20*a* of the outer side surface 20 extends from the proximal end surface 18. A distal portion of the outer side surface 20 is shown generally at 20*b*; the distal portion 20*b* of the outer side surface 20 extends from the distal end surface 22.

The handle portion 12*a* is generally defined by the proximal end surface 18 of the sleeve portion 12 and the proximal portion 20*a* of the outer side surface 20 of the sleeve portion 12. The proximal portion 20*a* of the outer side surface 20 of the sleeve portion 12 may be designed to have any desirable shape. As seen at FIGS. 1-2 and 4, the proximal portion 20*a* of the outer side surface 20 of the sleeve portion 12 may be optionally defined by a substantially smooth (i.e., non-frictional) undulating profile forming one or more finger grooves or finger channels F that is/are sized for receiving fingers of a user.

Figure 24:
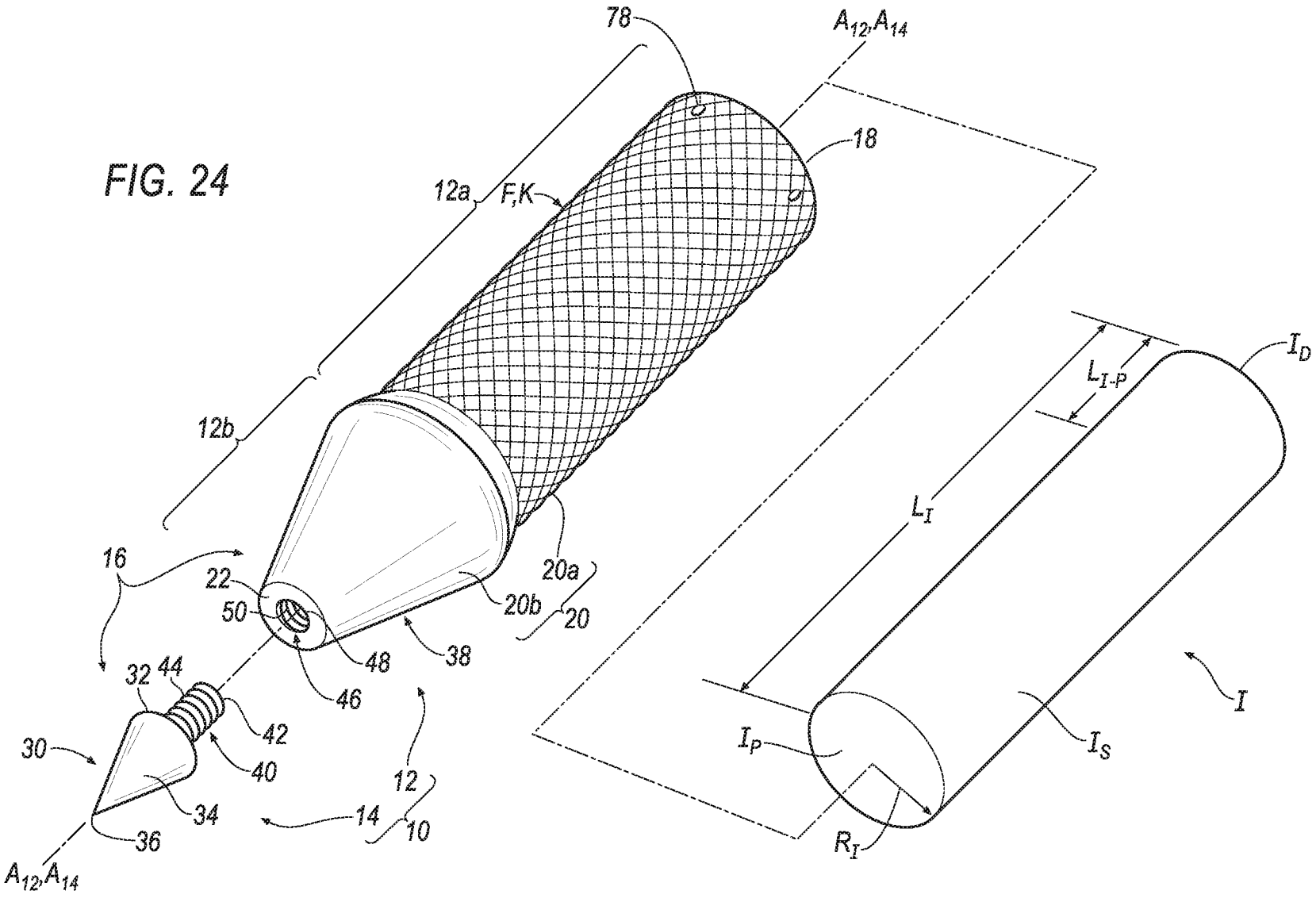
FIG. 24 is an exploded view of an exemplary self-defense apparatus having a handle portion defining a frictional surface.
Figure 25:
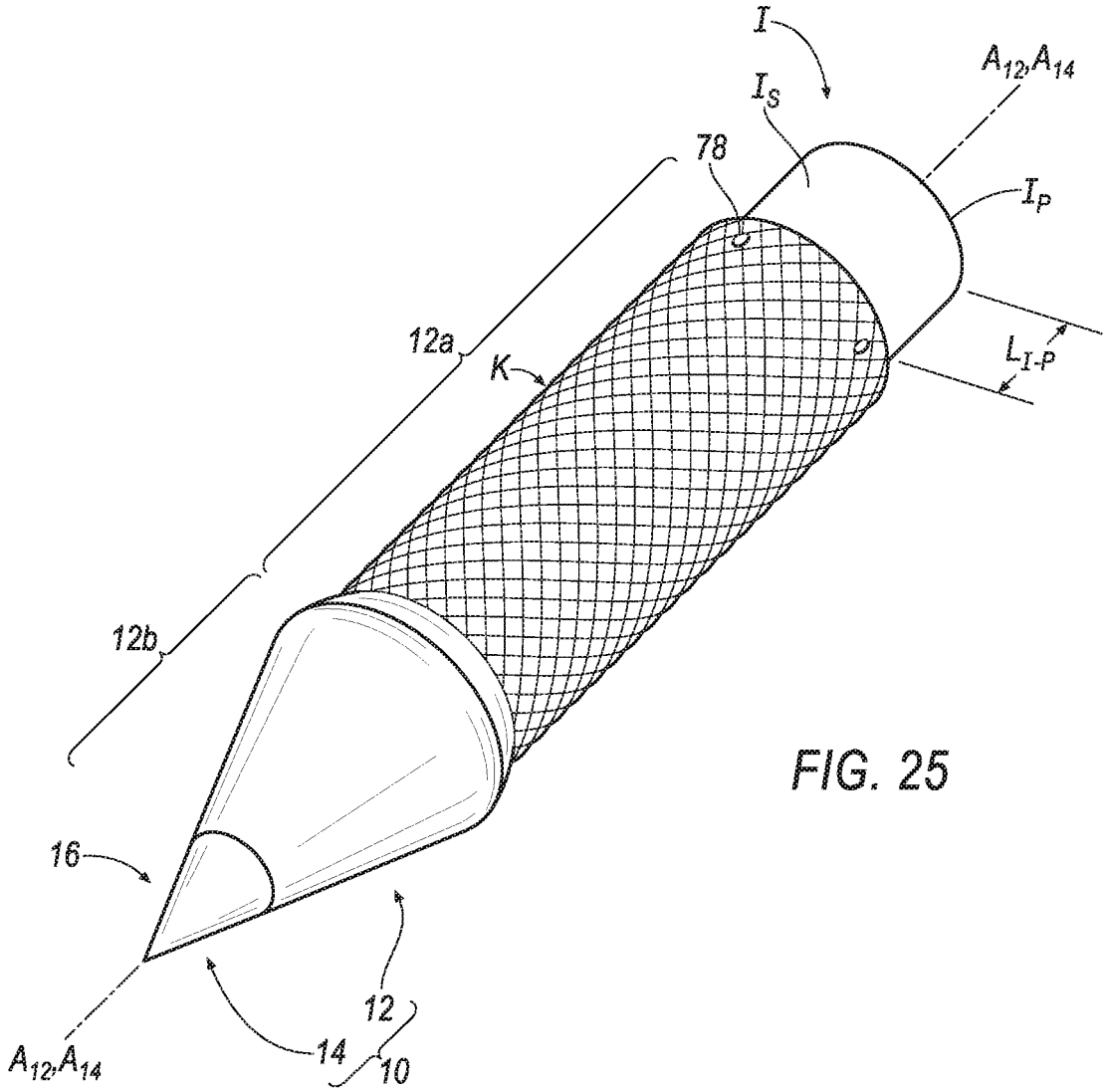
FIG. 25 is an assembled view of the self-defense apparatus of FIG. 24.
Figure 26:
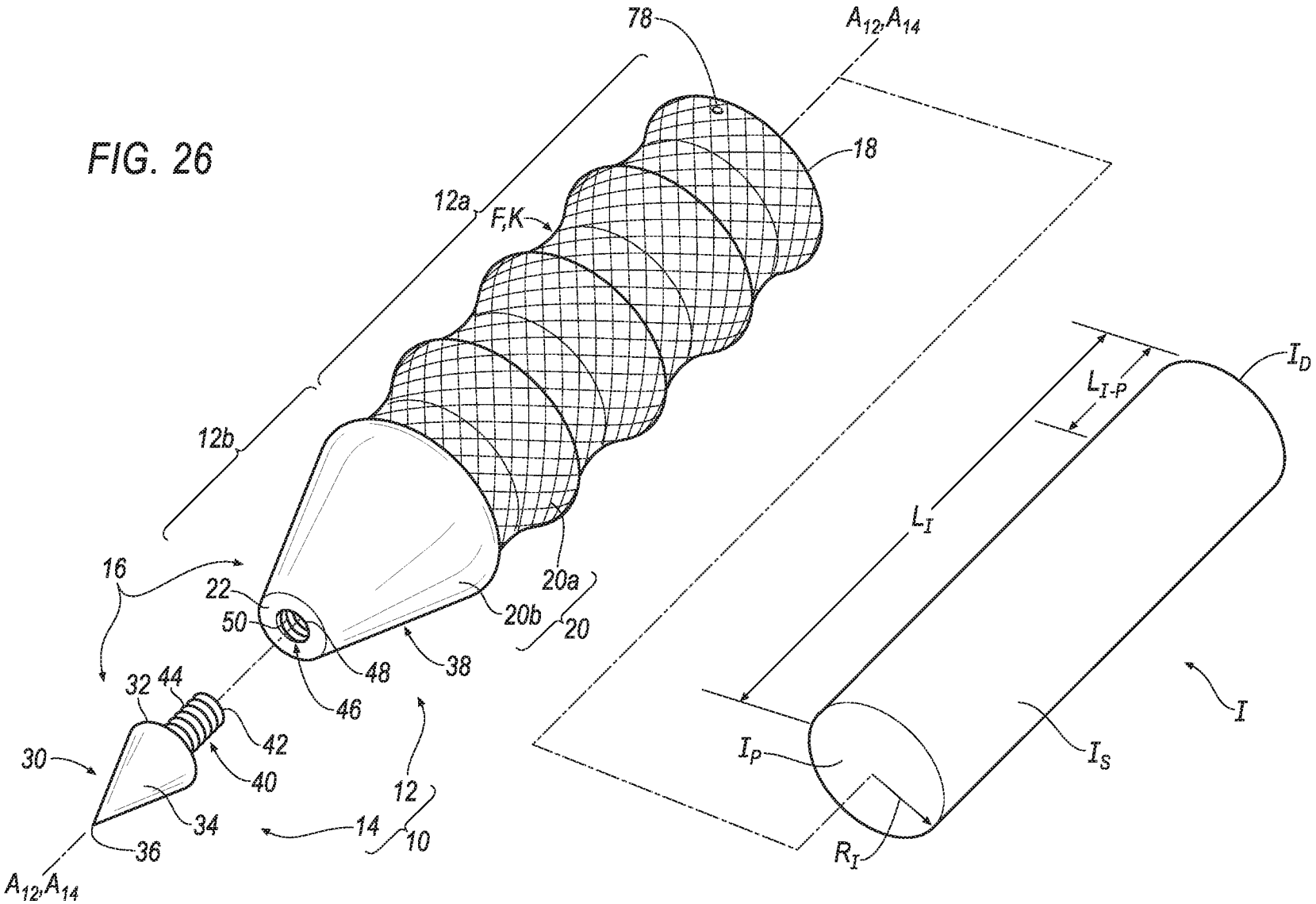
FIG. 26 is an exploded view of an exemplary self-defense apparatus having a handle portion defining a plurality of finger-receiving grooves and a frictional surface.
Figure 27:
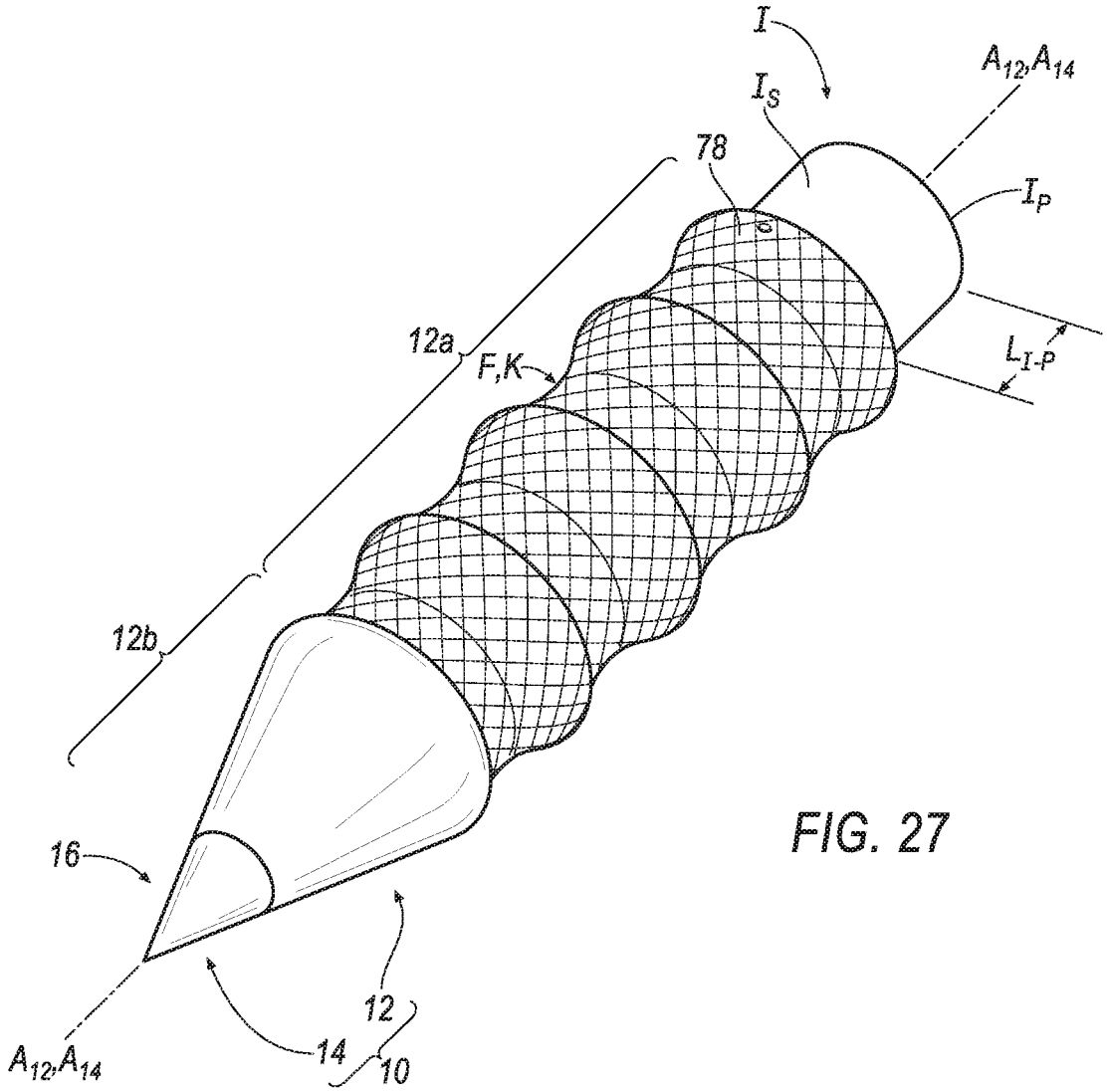
FIG. 27 is an assembled view of the self-defense apparatus of FIG. 26.

The proximal portion 20*a* of the outer side surface 20 of the sleeve portion 12 is not limited to a design including one or more finger grooves or finger channels F that is/are sized for receiving fingers of a user. Referring to FIGS. 24-25,

26-27, 28-29 and 30-31, other exemplary configurations of proximal portion 20*a* of the outer side surface 20 of the sleeve portion 12 are also disclosed. Accordingly, any desirable configuration of a self-defense apparatus 10 shown at to FIGS. 24-25, 26-27, 28-29 and 30-31 may include any configuration of the sleeve portion 12 (see, e.g., alternative configurations of the sleeve portion 12 at FIGS. 4, 9, 12$C_1$'-12$C_2$', 13A-13C, 13', 13", 14A-14C, 15A-15C, 16A-16C, 17A-17C, 18A-18C, 19A-19B, 21A-21, 22A-22B and 23A-23B) or any configuration of the adapter portion 14 (see, e.g., alternative configurations of the adapter portion 14 at FIGS. 5, 11, 12$C_1$"-12$C_2$", 20A-20B, 21A-21B, 22A-22B and 23A-23B) described in the present disclosure.

In some alternative configurations seen at, for example, FIGS. 24 and 25, the proximal portion 20*a* of the outer side surface 20 of the sleeve portion 12 may be optionally defined by non-undulating profile (i.e., the outer side surface 20 of the sleeve portion 12 does not include one or more finger grooves or finger channels that is/are sized for receiving fingers of a user) with a frictional surface such as, for example, a knurled surface K. In yet other optional configurations seen at FIGS. 26 and 27, the proximal portion 20*a* of the outer side surface 20 of the sleeve portion 12 may be optionally defined by a combination of the surface profiles seen at FIGS. 1 and 2 and 24 and—25 by having an undulating profile forming one or more finger grooves or finger channels F that is/are sized for receiving fingers of a user while also having a frictional surface such as, for example, a knurled surface K.

Figure 28:
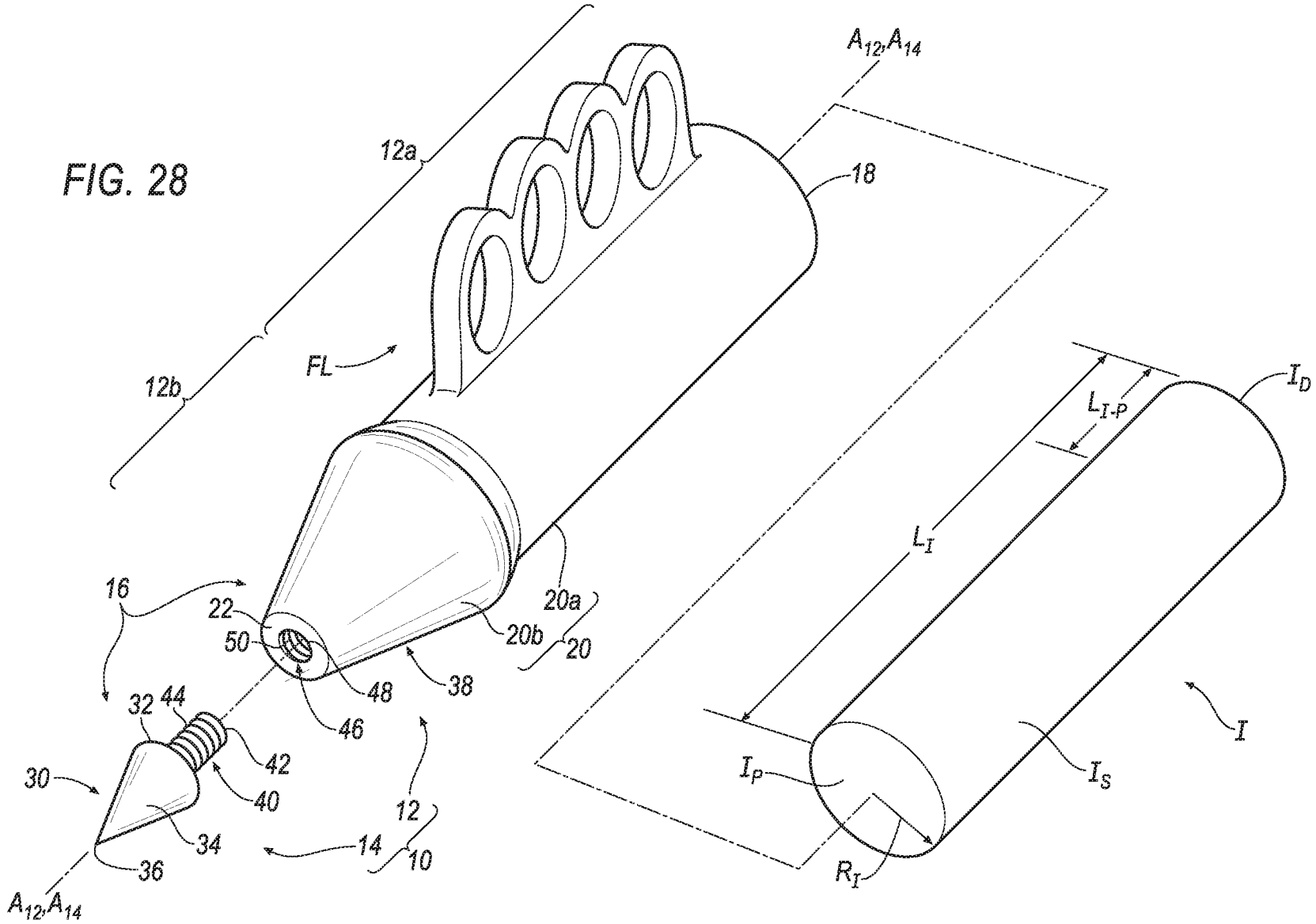
FIG. 28 is an exploded view of an exemplary self-defense apparatus having a handle portion defining a plurality of connected finger-receiving loops.
Figure 29:
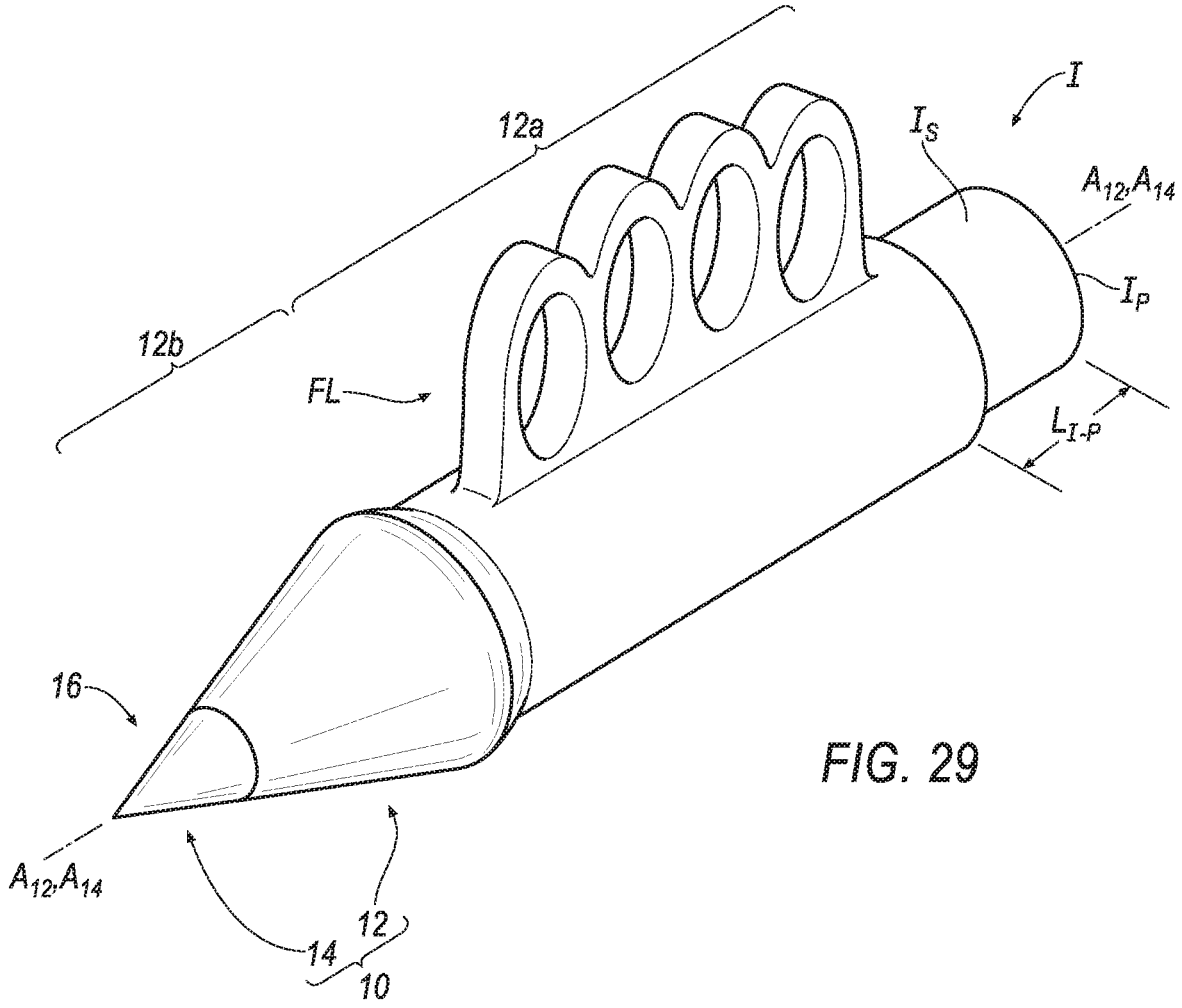
FIG. 29 is an assembled view of the self-defense apparatus of FIG. 28.

Other optional configurations seen at, for example, FIGS. 28 and 29, the proximal portion 20*a* of the outer side surface 20 of the sleeve portion 12 optionally defines, for example, a non-undulating profile (i.e., the outer side surface 20 of the sleeve portion 12 does not include one or more finger grooves or finger channels that is/are sized for receiving fingers of a user) with a plurality of connected finger-receiving loops FL integrally extending from the outer side surface 20 of the sleeve portion 12 that may define what is commonly referred to as "brass knuckles." The plurality of connected finger-receiving loops FL extending from the proximal portion 20*a* of the outer side surface 20 of the sleeve portion 12 of the self-defense apparatus 10 may provide another supplement self-defense function of the self-defense apparatus 10 by assisting a user in providing the sleeve portion 12 with a supplemental weapon for punching an assailant.

Figure 30:
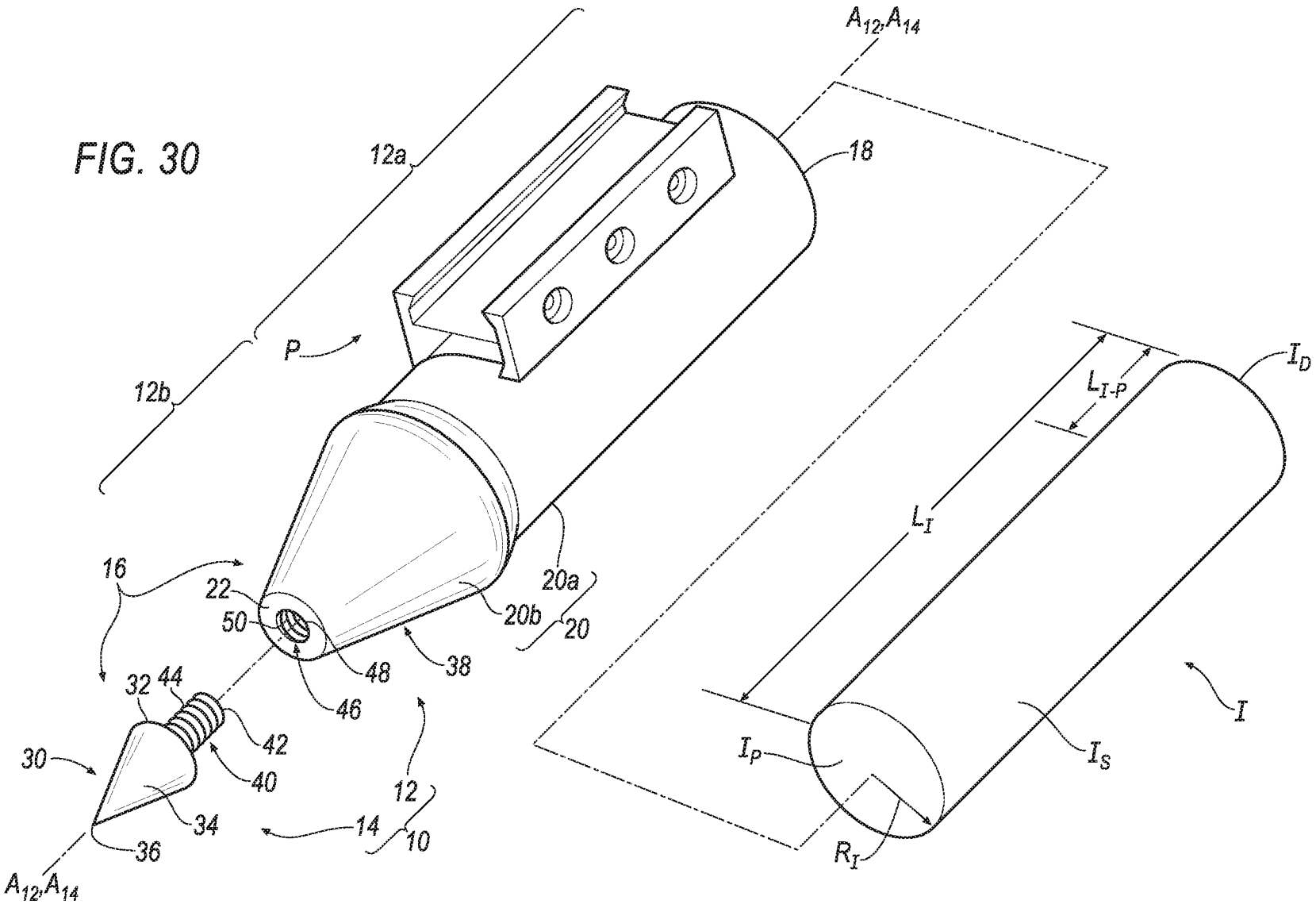
FIG. 30 is an exploded view of an exemplary self-defense apparatus having a handle portion defining a primary weapon attachment portion.
Figure 31:
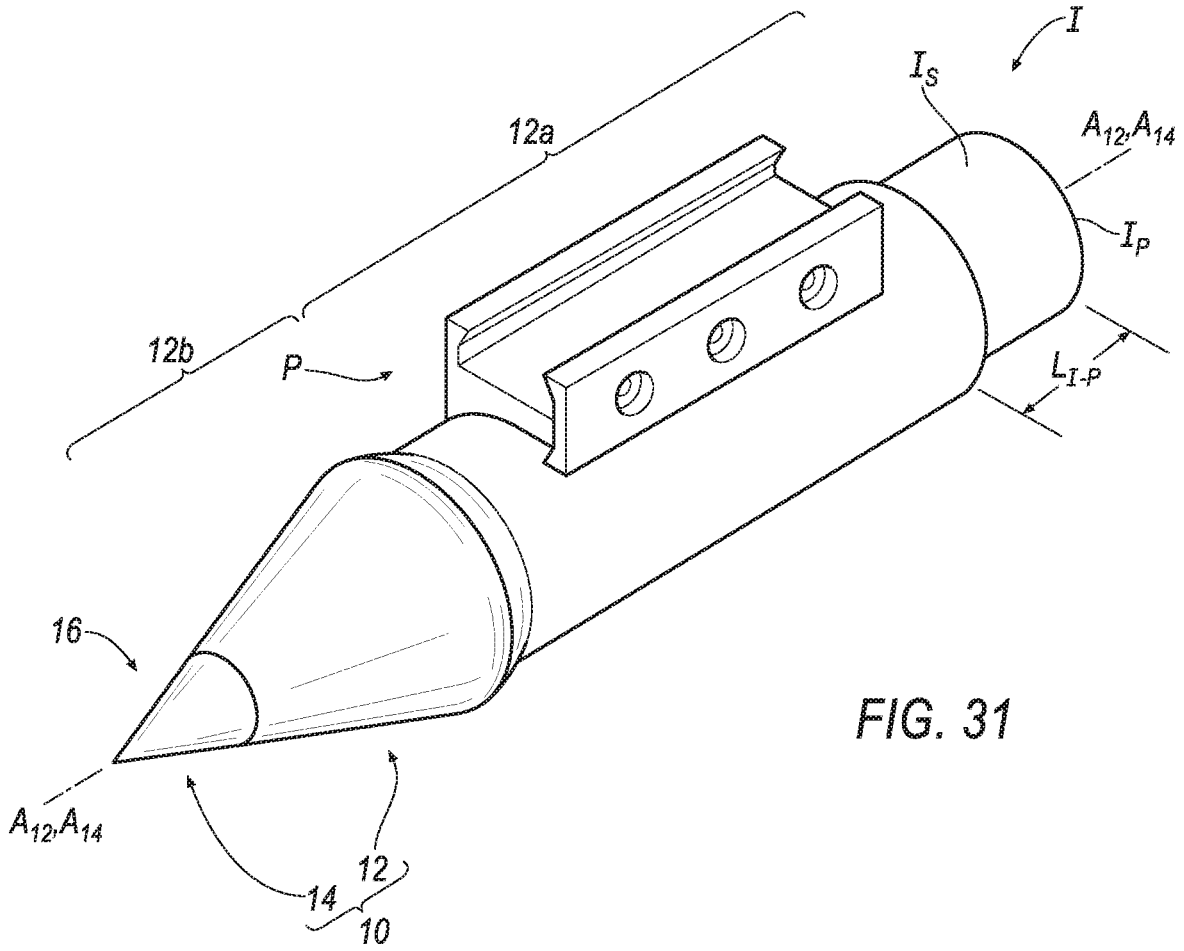
FIG. 31 is an assembled view of the self-defense apparatus of FIG. 30.

In yet other optional configurations seen at FIGS. 30 and 31, the proximal portion 20*a* of the outer side surface 20 of the sleeve portion 12 optionally defines, for example, a non-undulating profile (i.e., the outer side surface 20 of the sleeve portion 12 does not include one or more finger grooves or finger channels that is/are sized for receiving fingers of a user) with a weapon interface or a primary weapon attachment portion P. An exemplary primary weapon attachment portion P includes a "Picatinny-style rail", which is seen at FIGS. 30 and 31. Although a Picatinny-style rail P is shown at FIGS. 30 and 31, other types of weapon attachment surfaces may be utilized in other configurations of the sleeve portion 12; an exemplary primary weapon attachment portion P rail style configuration includes, for example, a dovetail-style rail configuration (rather than, e.g., a Picatinny-style rail P). In some examples, the Picatinny-style rail P is interfaced with a corresponding profile for receiving the Picatinny-style rail P that is formed by or attached to a primary weapon (e.g., a projectile-firing weapon) such as, for example, an assault rifle, bow or the like that fires projectiles (e.g., bullets, arrows or the like); in other configurations, the Picatinny-style rail P is interfaced with, for example, an article of clothing, such as, for example, military clothing or combat clothing such as, for example, a combat helmet that includes a corresponding profile for receiving the Picatinny-style rail P.

Accordingly, when the Picatinny-style rail P is interfaced with a rifle, bow, helmet or the like, the self-defense apparatus 10 may be selectively detached from the rifle, bow or helmet if, for example, the user depletes ammunition, arrows or the like and therefore relies on the self-defense apparatus 10 in a hand-to-hand combat situation whereby the user is combating an assailant, bear or the like.

Furthermore, if the self-defense apparatus 10 is attached to, for example, a rifle with the Picatinny-style rail P, the self-defense apparatus 10 may be selectively attached to the rifle in a first orientation whereby the weapon 16 of the self-defense apparatus 10 functions as, for example, a bayonet that extends from the rifle. If an exemplary function of the self-defense apparatus 10 is a bayonet as described above, in some implementations whereby the implement I that is secured within the self-defense apparatus 10 is a light source (e.g., a flashlight), the user may selectively attach the self-defense apparatus 10 to the Picatinny-style rail P in second orientation (i.e., an 180° offset orientation whereby the weapon 16 or bayonet is pointed toward the user) whereby the self-defense apparatus 10 may be utilized as a flashlight that is attached to the rifle in the aiming or firing direction of the rifle. Accordingly, in a third configuration, if the user depletes all of his/her ammunition, the user may disconnect the self-defense apparatus 10 from the Picatinny-style rail P and utilize the weapon 16 or bayonet portion of the self-defense apparatus 10 in a hand-to-hand combat situation for defending oneself or attacking an assailant.

Figure 3:
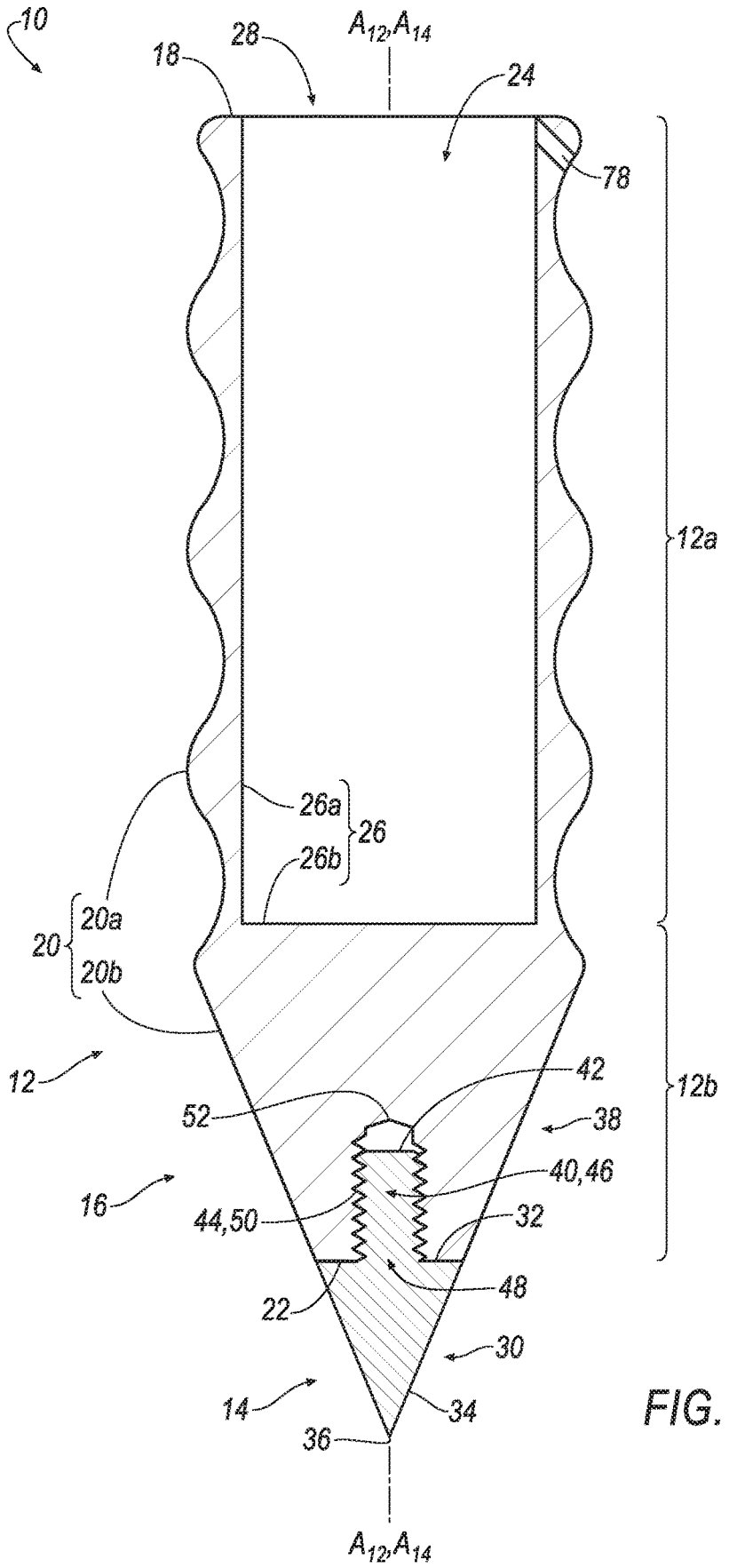
FIG. 3 is a cross-sectional view of the self-defense apparatus according to line 3-3 of FIG. 2.

Referring to FIG. 4, the trailing portion 12*b* of the weapon 16 is generally defined by the distal portion 20*b* of the outer side surface 20 of the sleeve portion 12. As will be described in greater detail in the following disclosure, the distal portion 20*b* of the outer side surface 20 of the sleeve portion 12 defines a portion of a cone or conical shape that defines the weapon 16 such that when the adapter portion 14 is selectively joined to the sleeve portion 12 (as seen at FIGS. 2 and 3), the trailing portion of the weapon 16 (defined by the distal sleeve portion 12*b*) and the leading portion of the weapon 16 (defined by the adapter portion 14) forms a cone shape with the adapter portion 14 defining a sharp distal stabbing tip (see, e.g., distal end surface 36 of the adapter portion 14) of the weapon 16.

As seen at FIG. 4, a substantially cylindrical cavity 24 axially extends into the sleeve portion 12 from the proximal end surface 18 along a central axis $A_{12}$-$A_{12}$ that extends through the axial center of the sleeve portion 12. The substantially cylindrical cavity 24 may be defined by an inner surface 26 of the sleeve portion 12. The inner surface 26 may include an inner side surface 26*a* and an inner base surface 26*b*. The inner side surface 26*a* may extend substantially perpendicularly from the proximal end surface 18. The inner base surface 26*b* may extend substantially perpendicularly from the inner side surface 26*a*.

The inner side surface 26*a* defines the substantially cylindrical cavity 24 to have a cavity radius $R_{24}$ extending from the central axis $A_{12}$-$A_{12}$ that extends through the axial center of the sleeve portion 12. Access to the substantially cylindrical cavity 24 may be permitted by a proximal sleeve opening 28 formed by the proximal end surface 18 of the sleeve portion 12. The proximal sleeve opening 28 may be defined by a proximal sleeve opening radius $R_{28}$ extending from the central axis $A_{12}$-$A_{12}$ that extends through the axial center of the sleeve portion 12. The proximal sleeve opening radius $R_{28}$ may be approximately equal to the cavity radius $R_{24}$.

The substantially cylindrical cavity 24 may be defined by an axial cavity depth $D_{26}$. The axial cavity depth $D_{26}$ extends between the proximal end surface 18 and the inner base surface 26*b*.

One or both of the cavity radius $R_{24}$ and the proximal sleeve opening radius $R_{28}$ may be approximately equal to but slightly greater than an implement radius RI (see, e.g., FIG. 1) of the substantially cylindrical implement I such that upon disposing the substantially cylindrical implement I within the substantially cylindrical cavity 24, the substantially cylindrical implement I may be selectively retained within the substantially cylindrical cavity 24 of the sleeve portion 12 in, for example, a friction-fit relationship. As will be explained in the following disclosure at FIGS. 16A-16C, 17A-17C and 18A-18C, alternative configurations of the inner surface 26 of the sleeve portion 12 may further include or be sized for receiving one or more implement retaining portions 62, 64 that may alternatively retain the substantially cylindrical implement I or supplement the friction-fit relationship described above for selectively-retaining the substantially cylindrical implement I within the substantially cylindrical cavity 24 of the sleeve portion 12. The friction-fit relationship functions to not only retain the substantially cylindrical implement I within the substantially cylindrical cavity 24 of the sleeve portion 12 when the user carries the self-defense apparatus 10 on his/her person, but also for mitigating an unintended ejection of the substantially cylindrical implement I from within the substantially cylindrical cavity 24 of the sleeve portion 12 when, for example, the user wields the weapon 16 of the self-defense apparatus 10 in, for example, a quickly reciprocating back-and-forth stabbing motion.

Figure 6A:
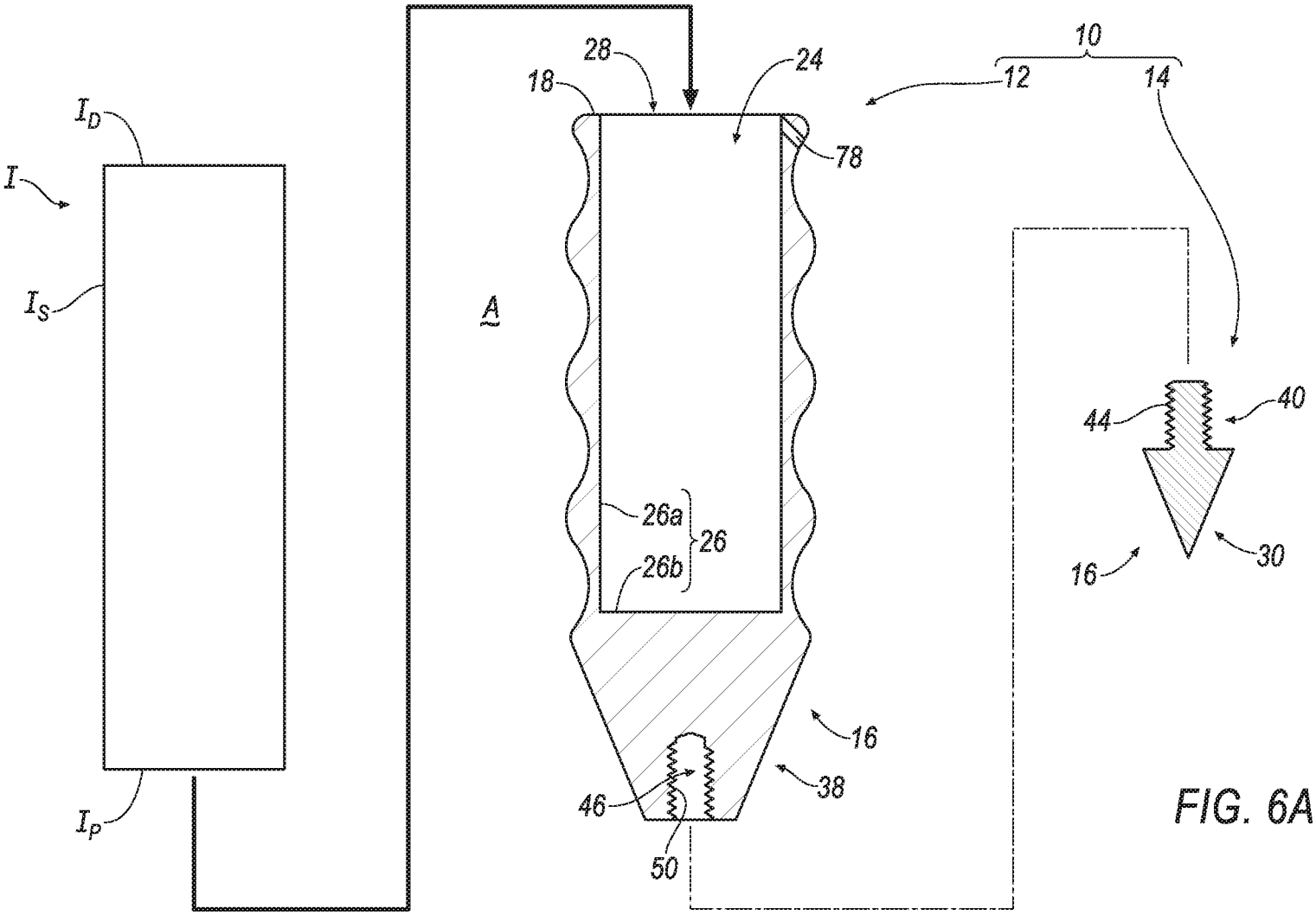
FIGS. 6A-6D are exemplary cross-sectional views illustrating a methodology for assembling and utilizing the self-defense assembly of FIGS. 1-3.
Figure 6B:
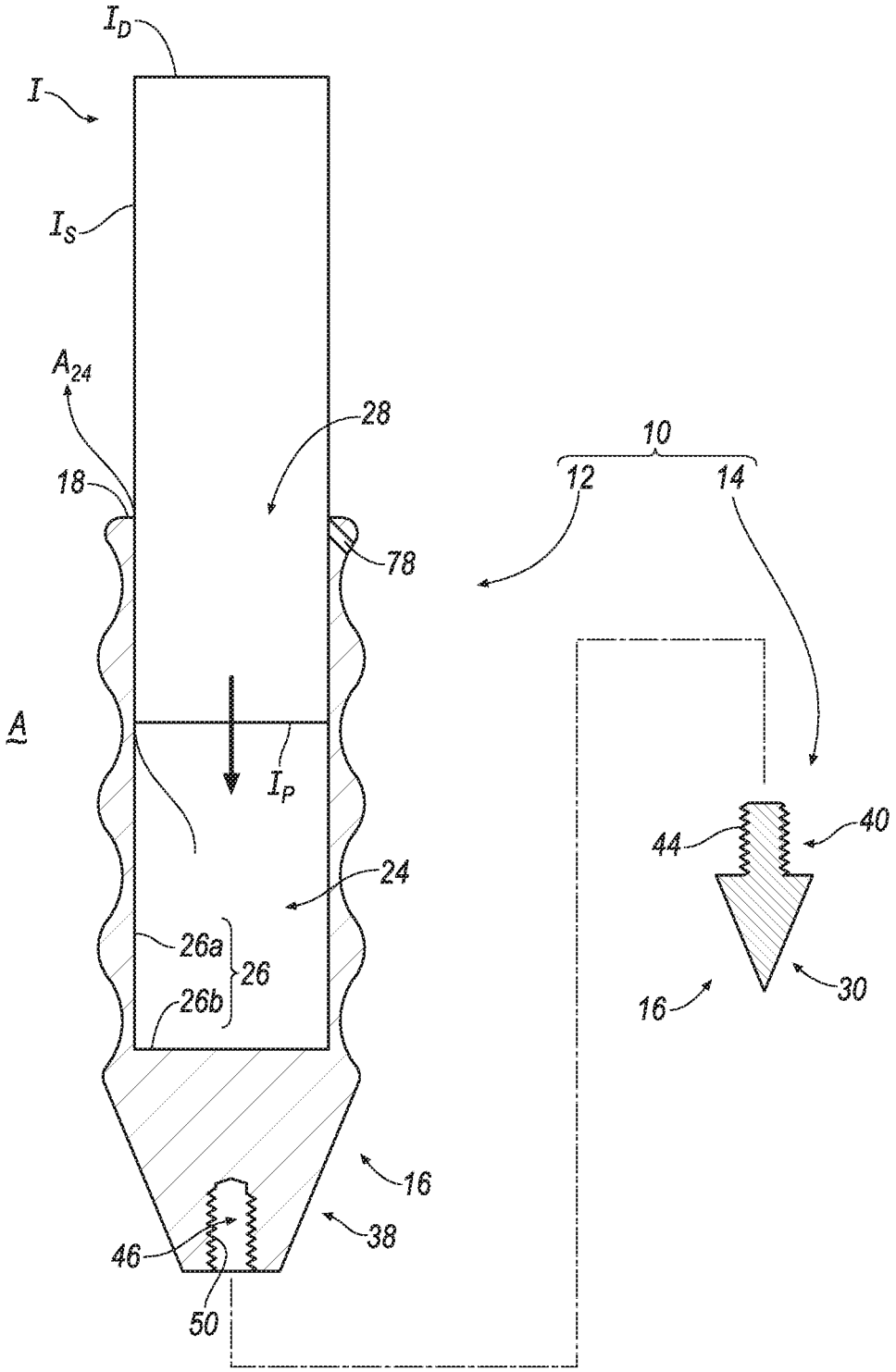
Figure 6C:
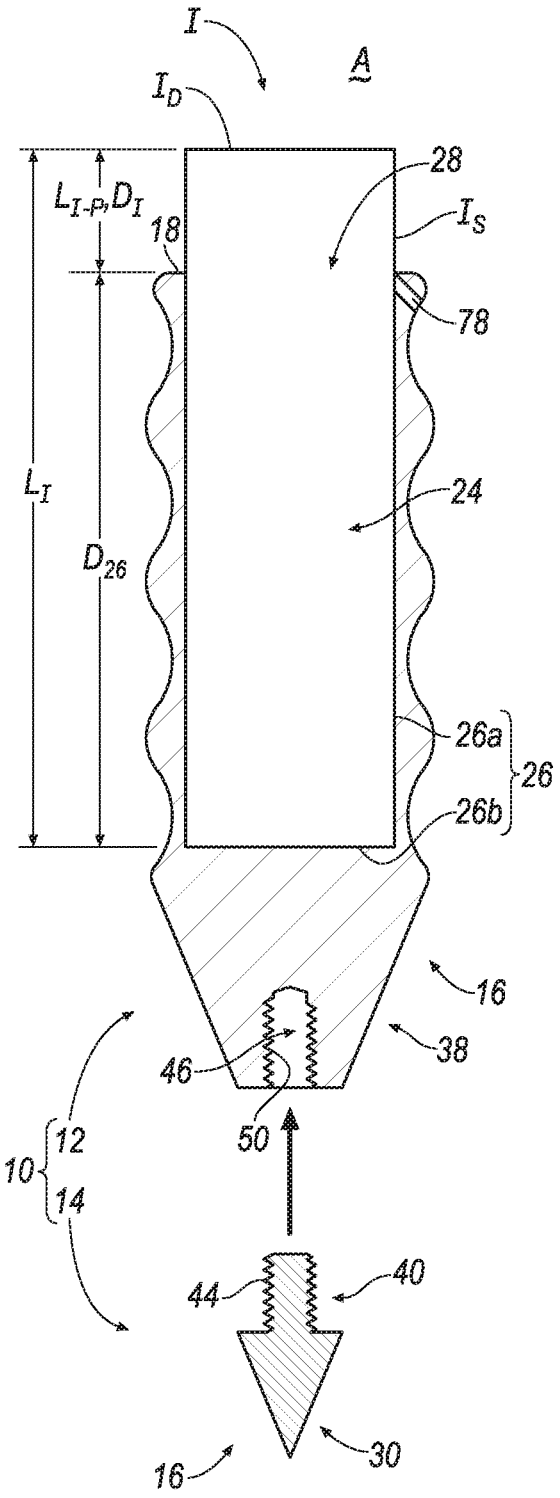

Furthermore, with reference to FIGS. 1-2, 4 and 6C, the axial cavity depth $D_{26}$ of the substantially cylindrical cavity 24 may be selectively sized to be less than an implement length $L_I$ of the substantially cylindrical implement I. Therefore, as seen at FIG. 6C, upon fully inserting the substantially cylindrical implement I within the substantially cylindrical cavity 24 (i.e., when a proximal end $I_P$ (see, e.g., FIG. 1) of the substantially cylindrical implement I is disposed adjacent the inner base surface 26*b* of the inner surface 26 of the sleeve portion 12), a portion $L_{I\text{-}P}$ (see, e.g., FIGS. 1 and 6C-6D) of the implement length $L_I$ (see, e.g., FIG. 1) of the substantially cylindrical implement I extends through the proximal sleeve opening 28 and axially beyond the proximal end surface 18 of the sleeve portion 12 at a distance DI (see, e.g., FIGS. 6C-6D).

Figure 6D:
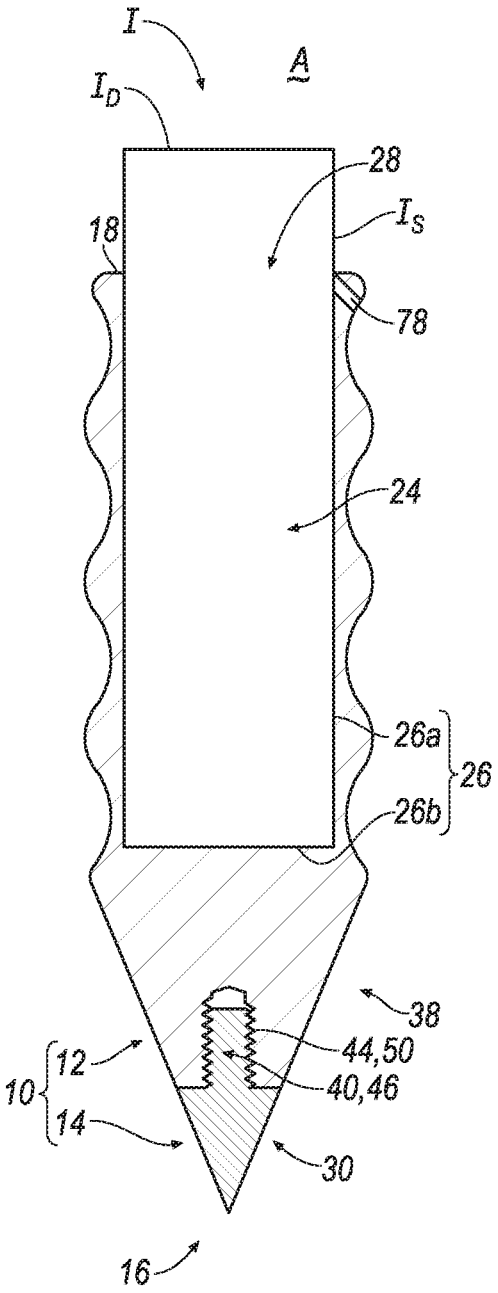

With reference to FIGS. 6C and 6D, as a result of the axial cavity depth $D_{26}$ of the substantially cylindrical cavity 24 being selectively sized to be less than an implement length $L_I$ of the substantially cylindrical implement I, the portion $L_{I\text{-}P}$ of the implement length $L_I$ of the substantially cylindrical implement I that extends between the distal end ID of the substantially cylindrical implement I and the proximal end surface 18 of the sleeve portion 12 is fully accessible by a user such that the user may manipulate or utilize the substantially cylindrical implement I while the substantially cylindrical implement I is selectively retained within the sleeve portion 12. In some examples, manipulation or utilization of an aerosol spray canister I (i.e., an exemplary substantially cylindrical implement I) includes depressing a trigger of the aerosol spray canister I for permitting the aerosol spray canister to spray an aerosol (e.g., pepper spray, bear spray, Chemical Mace or the like) contained therein. In other examples, manipulation or utilization of a flash light I or a strobe light I (i.e., exemplary substantially cylindrical implements I) includes rotating or depressing an on/off switch of the flash light I or the strobe light I for turning on or turning off a light source of the flash light I or the strobe light I.

Figure 5:
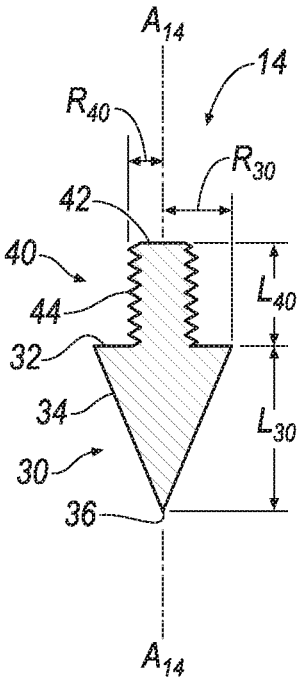
FIG. 5 is a cross-sectional view of an exemplary sleeve portion of the self-defense apparatus according to line 5-5 of FIG. 1.

Referring to FIG. 5, some exemplary configurations of the adapter portion 14 will now be described. The self-defense apparatus 10, however, is not limited to the design of the adapter portion 14 seen at FIG. 5, and, therefore, other exemplary designs of the adapter portion 14 (see also, e.g., alternative configurations of the adapter portion 14 at FIGS. 11, 12$C_1$"-12$C_2$", 20A-20B, 21A-21B, 22A-22B and 23A-23B) may be utilized in combination with the sleeve portion 12 (see also, e.g., alternative configurations of the sleeve portion 12 at FIGS. 9, 12$C_1$'-12$C_2$', 13A-13C, 13', 13", 14A-14C, 15A-15C, 16A-16C, 17A-17C, 18A-18C, 19A-19B, 21A-21, 22A-22B and 23A-23B) for assembling the self-defense apparatus 10.

Referring to FIG. 5, the adapter portion 14 may include an adapter body 30 defined by a proximal end surface 32, an outer side surface 34 and a distal end surface 36. An adapter body length $L_{30}$ of the adapter body 30 extends between the proximal end surface 32 of the adapter body 30 and the distal end surface 36 of the adapter body 30.

The adapter body 30 may be defined by a cone or conical shape having an adapter body radius $R_{30}$ extending from a central axis $A_{14}$-$A_{14}$ that extends through an axial center of the adapter portion 14. The adapter body radius $R_{30}$ progressively increases along the adapter body length $L_{30}$ from the distal end surface 36 of the adapter body 30 to the proximal end surface 32 of the adapter body 30 such that the outer side surface 34 defines the adapter body 30 generally defines the cone or conical shape of the adapter body 30. The distal end surface 36 of the adapter body 30 defines the smallest adapter body radius $R_{30}$, and, therefore, the distal end surface 36 of the adapter body 30 forms a sharp distal tip of the adapter body 30.

Referring to FIG. 4, the distal portion 20*b* of the outer side surface 20 of the sleeve portion 12 defines an adapter-interfacing body 38. Furthermore, the adapter-interfacing body 38 generally extends between the distal end surface 22 of the sleeve portion 12 and the inner base surface 26*b* of the inner surface 26 of the sleeve portion 12.

The adapter-interfacing body 38 is defined by an adapter-interfacing body radius $R_{38}$ extending from the central axis $A_{12}$-$A_{12}$ that extends through the axial center of the sleeve portion 12. The adapter-interfacing body 38 is further defined by an adapter-interfacing body length $L_{38}$ that extends between the distal end surface 22 of the sleeve portion 12 and the inner base surface 26*b* of the inner surface 26 of the sleeve portion 12. The adapter-interfacing body radius $R_{38}$ progressively increases along the adapter-interfacing body length $L_{38}$ of the adapter-interfacing body 38 in an axial direction from the distal end surface 22 of the sleeve portion 12 toward the inner base surface 26*b* of the inner surface 26 of the sleeve portion 12. Accordingly, the distal portion 20*b* of the outer side surface 20 of the sleeve portion 12 defines the adapter-interfacing body 38 to partially form a cone or conical shape.

Referring to FIGS. 4 and 5, the adapter body radius $R_{30}$ defined by proximal end surface 32 of the adapter body 30 may be approximately equal to but slightly less than the adapter body radius $R_{38}$ defined by the distal end surface 22 of the sleeve portion 12. Accordingly, as seen at FIG. 3, when the proximal end surface 32 of the adapter body 30 is disposed adjacent the distal end surface 22 of the sleeve portion 12, the adapter-interfacing body 38 of the sleeve portion 12 and the adapter body 30 of the adapter portion 14 collectively define the weapon 16 to have a cone shape with the distal end surface 36 of the adapter body 30 forming a sharp distal stabbing tip of the weapon 16.

Referring to FIG. 5, the adapter portion 14 further includes a fastener 40 extending axially away from the proximal end surface 32 of the adapter body 30. In some examples, the fastener 40 extends away from the proximal end surface 32 of the adapter body 30 along the central axis $A_{14}$-$A_{14}$ that extends through the axial center of the adapter portion 14.

In other examples, the fastener 40 includes a proximal end surface 42 and an outer side surface 44. The fastener 40 is defined by a fastener length $L_{40}$. The fastener length $L_{40}$ extends between the proximal end surface 42 of the fastener 40 and the proximal end surface 32 of the adapter body 30.

In some implementations, the fastener 40 is defined by a fastener radius $R_{40}$ extending from the central axis $A_{14}$-$A_{14}$ that extends through the axial center of the adapter portion 14. In some examples, the fastener radius $R_{40}$ is substantially the same for the entire fastener length $L_{40}$; accordingly, the outer side surface 44 may define the fastener 40 to have a substantially cylindrical shape. Furthermore, in some examples, the outer side surface 44 of the fastener 40 may define a threaded surface such that the fastener 40 may be referred to as a threaded fastener.

Referring to FIG. 4, the sleeve portion 12 further defines a fastener-receiving passage 46 extending axially into the adapter-interfacing body 38. In other examples, the fastener-receiving passage 46 extends into the distal end surface 22 of the sleeve portion 12 along the central axis $A_{12}$-$A_{12}$ that extends through the axial center of the sleeve portion 12.

The fastener-receiving passage 46 extends into the distal end surface 22 of the sleeve portion 12 at a distance defined by a fastener-receiving passage length $L_{46}$. Furthermore, in some examples, the fastener-receiving passage 46 is defined by a fastener-receiving passage radius $R_{46}$ extending from the central axis $A_{12}$-$A_{12}$ that extends through the axial center of the sleeve portion 12.

Access to the fastener-receiving passage 46 may be permitted by a proximal fastener-receiving passage opening 48 formed by the distal end surface 22 of the sleeve portion 12. The proximal fastener-receiving passage opening 48 may be defined by a proximal fastener-receiving passage opening radius $R_{48}$ extending from the central axis $A_{12}$-$A_{12}$ that extends through the axial center of the sleeve portion 12. The proximal fastener-receiving passage opening radius $R_{48}$ may be approximately equal to the fastener-receiving passage radius $R_{46}$.

The fastener-receiving passage 46 is defined by at least an inner side surface 50. In some examples, a proximal end 50*p* of the inner side surface 50 of the fastener-receiving passage 46 extends substantially perpendicularly from the distal end surface 22 of the sleeve portion 12 at the proximal fastener-receiving passage opening 48.

In other examples, the fastener-receiving passage radius $R_{46}$ is substantially the same for the entire fastener-receiving passage length $L_{46}$. Accordingly, the inner side surface 50 may define the fastener-receiving passage 46 to have a substantially cylindrical shape. Furthermore, in some examples, the inner side surface 50 of the fastener-receiving passage 46 may define a threaded surface such that the fastener-receiving passage 46 may be referred to as a threaded fastener-receiving passage.

In examples when the fastener-receiving passage 46 extends partially through the adapter-interfacing body 38, the fastener-receiving passage 46 further defines by an inner base surface 52. The inner base surface 52 of the fastener-receiving passage 46 may extend substantially perpendicularly from the inner side surface 50 of the fastener-receiving passage 46. Accordingly, in some examples, when the fastener-receiving passage 46 extends partially through the adapter-interfacing body 38, the fastener-receiving passage length $L_{46}$ is less than the adapter-interfacing body length $L_{38}$ and extends between the distal end surface 22 of the sleeve portion 12 and the inner base surface 52 of the fastener-receiving passage 46. Furthermore, when the fastener-receiving passage 46 extends partially through the adapter-interfacing body 38, the fastener-receiving passage 46 is not in direct fluid communication with or axial fluid communication with the substantially cylindrical cavity 24 of the sleeve portion 12.

Figure 8:
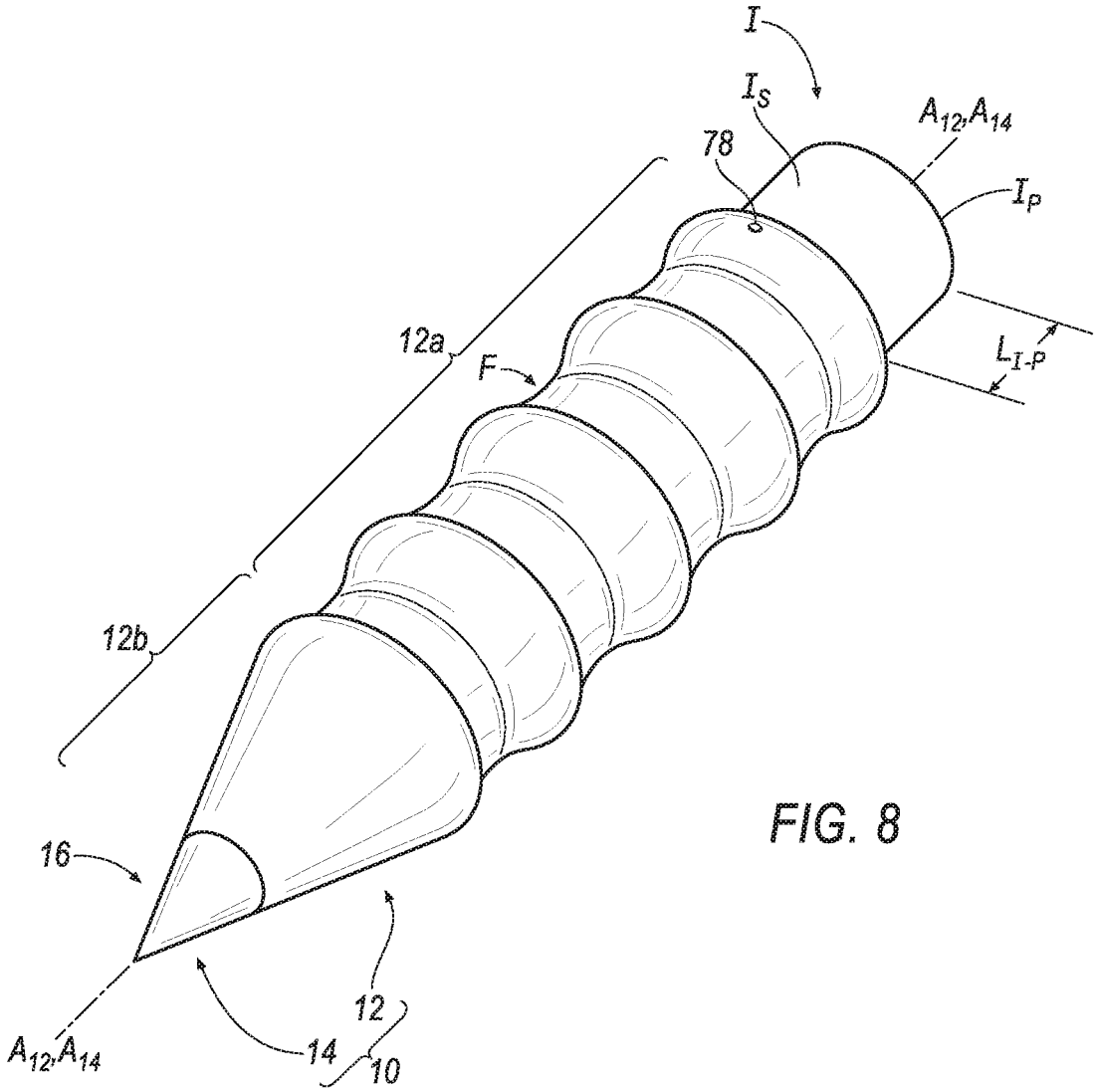
FIG. 8 is an assembled view of the self-defense apparatus of FIG. 7.
Figure 9:
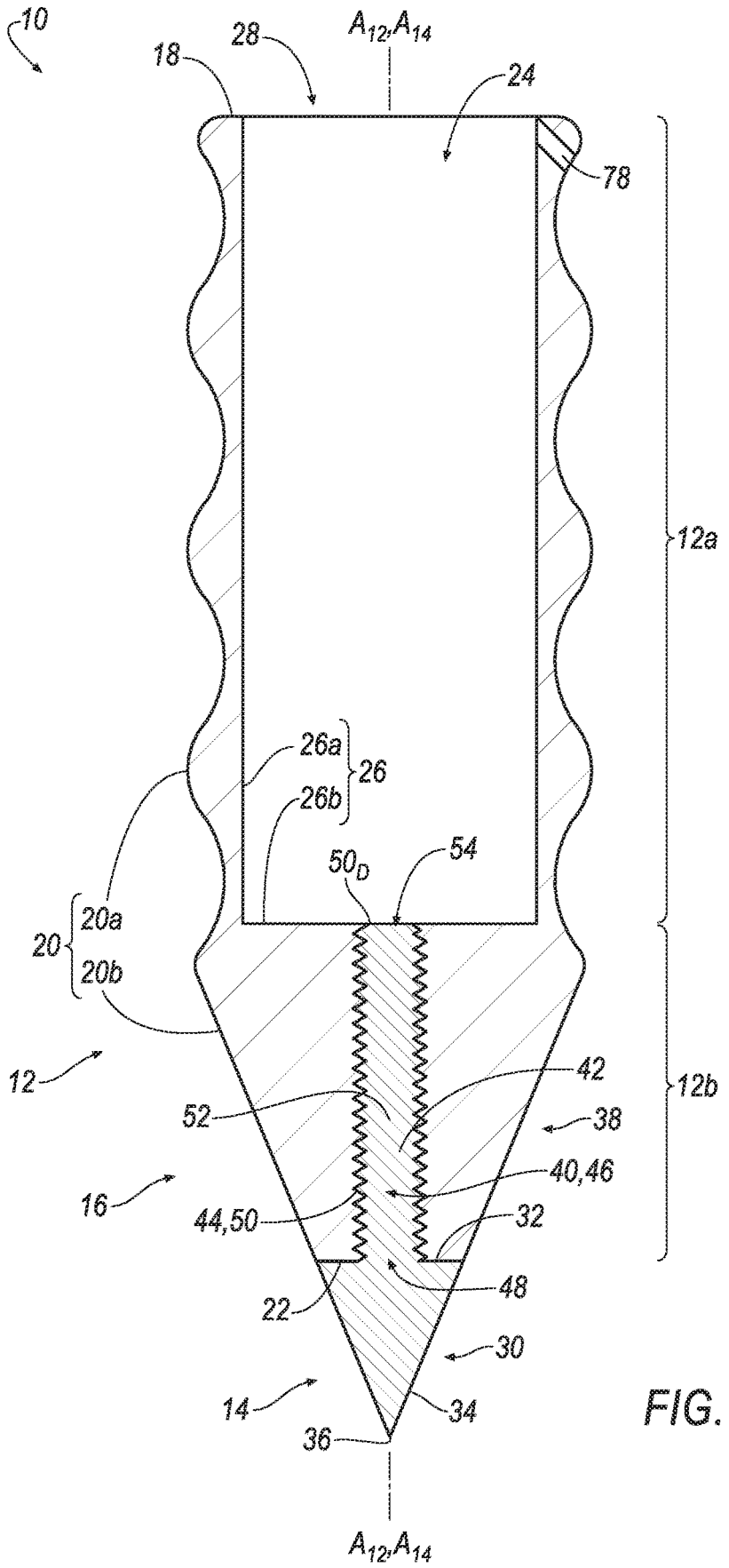
FIG. 9 is a cross-sectional view of the self-defense apparatus according to line 9-9 of FIG. 8.
Figure 10:
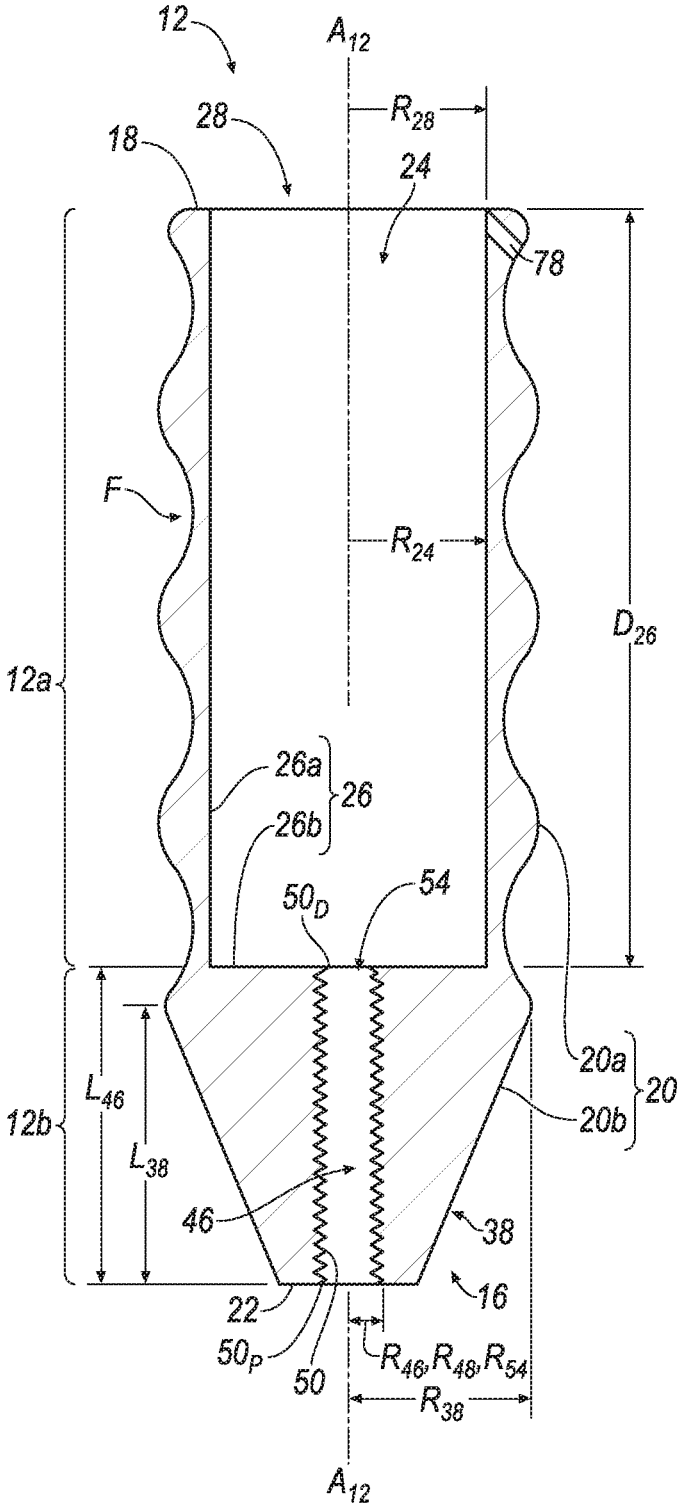
FIG. 10 is a cross-sectional view of an exemplary sleeve portion of the self-defense apparatus according to line 10-10 of FIG. 7.

In other configurations of the self-defense apparatus 10 seen at, for example, FIGS. 7-11, an exemplary sleeve portion 12 seen at FIG. 10 defines a fastener-receiving passage 46 that extends entirely through the adapter-interfacing body 38. In such an example when the fastener-receiving passage 46 extends entirely through the adapter-interfacing body 38, access to the fastener-receiving passage 46 is also permitted by a distal fastener-receiving passage opening 54 formed by the inner base surface 26*b* of the inner surface 26 of the sleeve portion 12 that defines the substantially cylindrical cavity 24; accordingly the distal fastener-receiving passage opening 54 permits the fastener-receiving passage 46 to be in direct fluid communication with or axial fluid communication with the substantially cylindrical cavity 24 of the sleeve portion 12.

Figure 11:
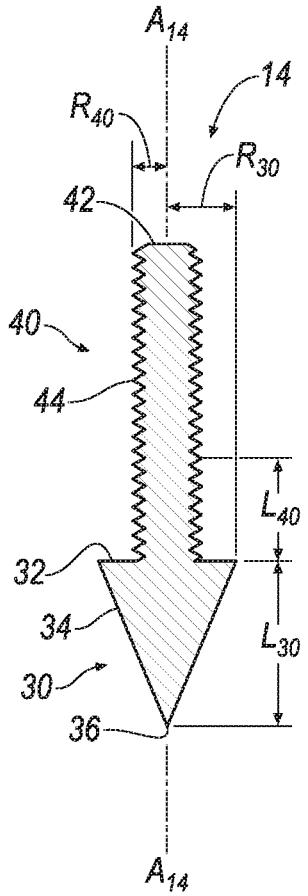
FIG. 11 is a cross-sectional view of an exemplary sleeve portion of the self-defense apparatus according to line 11-11 of FIG. 7.

Although some exemplary cross-sectional configurations of the sleeve portion 12 is seen at FIG. 10, some cross-sectional configurations of the sleeve portion 12 may include one or more aspects of the exemplary designs of sleeve portions 12 seen at, for example, FIG. 12$C_1$'-12$C_2$', 13A-13C, 13', 13", 14A-14C, 15A-15C, 16A-16C, 17A-17C, 18A-18C, 19A-19B, 21A-21, 22A-22B and 23A-23B for assembling the self-defense apparatus 10. Furthermore, although some exemplary cross-sectional configurations of the adapter portion 14 is seen at FIG. 11, some cross-sectional configurations of the adapter portion 14 may include one or more aspects of the exemplary designs of adapter portions 14 seen at, for example, FIG. 12$C_1$"-12$C_2$", 20A-20B, 21A-21B, 22A-22B and 23A-23B) for assembling the self-defense apparatus 10.

As seen at FIG. 10, the distal fastener-receiving passage opening 54 may be defined by a distal fastener-receiving passage opening radius $R_{54}$ extending from the central axis $A_{12}$-$A_{12}$ that extends through the axial center of the sleeve portion 12. The distal fastener-receiving passage opening radius $R_{54}$ may be approximately equal to the fastener-receiving passage radius $R_{46}$.

Furthermore, as seen at FIG. 10, the fastener-receiving passage radius $R_{46}$ of the fastener-receiving passage 46 is less than the cavity radius $R_{24}$ of the substantially cylindrical cavity 24. Accordingly, when the proximal end $I_P$ of the substantially cylindrical implement I is disposed adjacent the inner base surface 26*b* of the inner surface 26 of the sleeve portion 12, a portion of the proximal end $I_P$ of the substantially cylindrical implement I may be disposed over the distal fastener-receiving passage opening 54 and the substantially cylindrical implement I is not permitted to enter or pass into the fastener-receiving passage 46. Yet even further, as seen at FIG. 10, when the fastener-receiving passage 46 extends entirely through the adapter-interfacing body 38: (1) the proximal end 50*p* of the inner side surface 50 of the fastener-receiving passage 46 may extend substantially perpendicularly from the distal end surface 22 of the sleeve portion 12; and (2) a distal end 50D of the inner side surface 50 of the fastener-receiving passage 46 may extend substantially perpendicularly from the inner base surface 26*b* of the inner surface 26 of the sleeve portion 12.

With reference to each of FIGS. 3-5 and 9-11, when each of the outer side surface 44 of the fastener 40 and the inner side surface 50 of the fastener-receiving passage 46 are defined by a threaded surface, the fastener 40 extending axially away from the proximal end surface 32 of the adapter body 30 of the adapter portion 14 may be sized for being selectively fastened within the fastener-receiving passage 46 extending axially into the adapter-interfacing body 38 of the sleeve portion 12. Accordingly, the fastener radius $R_{40}$ defining the fastener 40 may be approximately equal to but slightly less than the fastener-receiving passage radius $R_{46}$ of the fastener-receiving passage 46.

With reference to FIGS. 6A-6D, an exemplary methodology for assembling and utilizing the self-defense assembly 10 of FIGS. 1-3 is now described. Accordingly, the methodology shown and described at FIGS. 6A-6D relates to some exemplary implementations of the sleeve portion 12 whereby the fastener-receiving passage 46 extends partially through the adapter-interfacing body 38 and therefore is not in direct fluid communication with or axial fluid communication with the substantially cylindrical cavity 24 of the sleeve portion 12.

Referring to FIGS. 6A and 6B, an optional first step includes axially aligning (see, e.g., FIG. 6A) and then axially inserting (see, e.g., FIG. 6B) the proximal end $I_P$ of the substantially cylindrical implement I with and subsequently through the proximal sleeve opening 28 formed by the proximal end surface 18 of the sleeve portion 12. As seen at FIGS. 6B-6C, a second optional step includes arranging the proximal end $I_P$ of the substantially cylindrical implement I in the substantially cylindrical cavity 24 of the sleeve portion 12 and displacing air $A_{24}$ (see, e.g., FIG. 6B) within the substantially cylindrical cavity 24 to surrounding atmosphere A as the substantially cylindrical implement I is further inserted into the substantially cylindrical cavity 24 until the proximal end $I_P$ of the substantially cylindrical implement I is disposed adjacent the inner base surface 26*b* of the inner surface 26 (as seen at FIG. 6C) that defines the substantially cylindrical cavity 24. With reference to FIG. 6C, the substantially cylindrical implement I is selectively retained within the substantially cylindrical cavity 24 in, for example, a friction-fit relationship such that an outer side surface Is of the substantially cylindrical implement I is disposed substantially adjacent the inner side surface 26*a* that defines the substantially cylindrical cavity 24.

As seen at FIG. 6B, the air $A_{24}$ that is displaced from substantially cylindrical cavity 24 to surrounding atmosphere A may axially pass through: firstly, (1) one or more air displacement gaps formed between the outer side surface Is of the substantially cylindrical implement I and the inner side surface 26*a* that defines the substantially cylindrical cavity 24; and secondly, (2) out of the proximal sleeve opening 28 formed by the proximal end surface 18 of the sleeve portion 12. The one or more air displacement gaps may be temporality formed as a result of, for example, the material (which may be, e.g., a deformable or flexible material) defining one or both of the substantially cylindrical implement I and the sleeve portion 12 temporarily deforming or flexing. In other examples, the one or more air displacement gaps may arise from surface imperfections of one or more of the outer side surface Is of the substantially cylindrical implement I and the inner side surface 26*a* that defines the substantially cylindrical cavity 24.

In addition to the friction-fit relationship defined by the outer side surface Is of the substantially cylindrical implement I being disposed substantially adjacent the inner side surface 26*a* that defines the substantially cylindrical cavity 24, an air vacuum within the substantially cylindrical cavity 24 may also assist in selectively retaining the substantially cylindrical implement I within the substantially cylindrical cavity 24. Like the function of the friction-fit relationship described above, the air vacuum functions to not only retain the substantially cylindrical implement I within the substantially cylindrical cavity 24 of the sleeve portion 12 when the user carries the self-defense apparatus 10 on his/her person, but also mitigates an unintended ejection of the substantially cylindrical implement I from within the substantially cylindrical cavity 24 of the sleeve portion 12 when, for example, the user wields the weapon 16 of the self-defense apparatus 10 in, for example, a quickly reciprocating back-and-forth stabbing motion. For example, with reference to FIG. 6C, if a user were to attempt to axially pull the substantially cylindrical implement I out of the substantially cylindrical cavity 24, the snug or friction-fit relationship of the cylindrical implement I within the substantially cylindrical cavity 24 may prevent or inhibit air from surrounding atmosphere A from being drawn into the substantially cylindrical cavity 24; therefore, because the above-described exemplary design of the self-defense assembly 10 prevents or inhibits air from surrounding atmosphere A to be drawn into the substantially cylindrical cavity 24, the substantially cylindrical implement I may be non-removably secured within the substantially cylindrical cavity 24 in a manner resulting from a combination of the friction-fit relationship and an air vacuum. However, is some instances, if a user were to attempt to axially pull the substantially cylindrical implement I out of the substantially cylindrical cavity 24, air from surrounding atmosphere A may be permitted to enter into the substantially cylindrical cavity 24 by way of the one or more air displacement gaps formed between the outer side surface Is of the substantially cylindrical implement I and the inner side surface 26*a* that defines the substantially cylindrical cavity 24 as described above such that the user may be able to overcome the friction-fit connection and the air vacuum for removing the substantially cylindrical implement I from the substantially cylindrical cavity 24.

Referring to FIGS. 6C and 6D, the method may include axially aligning the fastener 40 of the adapter portion 14 with the fastener-receiving passage 46 of the sleeve portion 12. The fastener 40 may be inserted into the fastener-receiving passage 46 of the sleeve portion 12. As described above in some exemplary implementations, each of the outer side surface 44 of the fastener 40 and the inner side surface 50 of the fastener-receiving passage 46 are defined by a threaded surface; accordingly, the fastener 40 may be threadingly-coupled to the fastener-receiving passage 46 for selectively fastening the adapter portion 14 to the sleeve portion 12.

Figure 7:
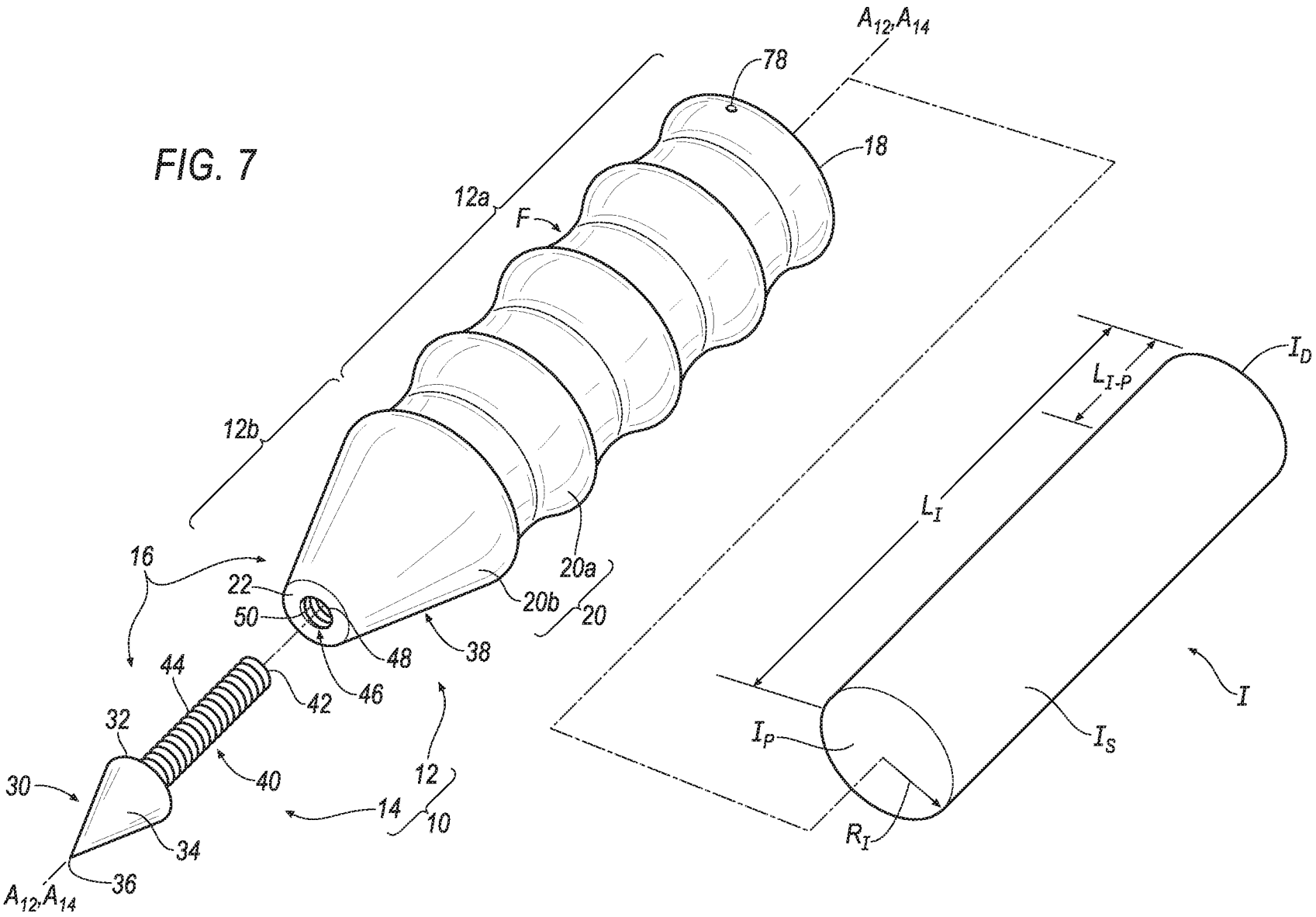
FIG. 7 is an exploded view of an exemplary self-defense apparatus.

Referring to FIGS. 12A-12G another exemplary methodology for assembling and utilizing the self-defense assembly 10 of FIGS. 7-9 is now described. Accordingly, the methodology shown and described at FIGS. 12A-12G relates to some exemplary implementations of the sleeve portion 12 whereby the fastener-receiving passage 46 extends entirely through the adapter-interfacing body 38 and therefore is in direct fluid communication with or axial fluid communication with the substantially cylindrical cavity 24 of the sleeve portion 12.

Figure 12A:
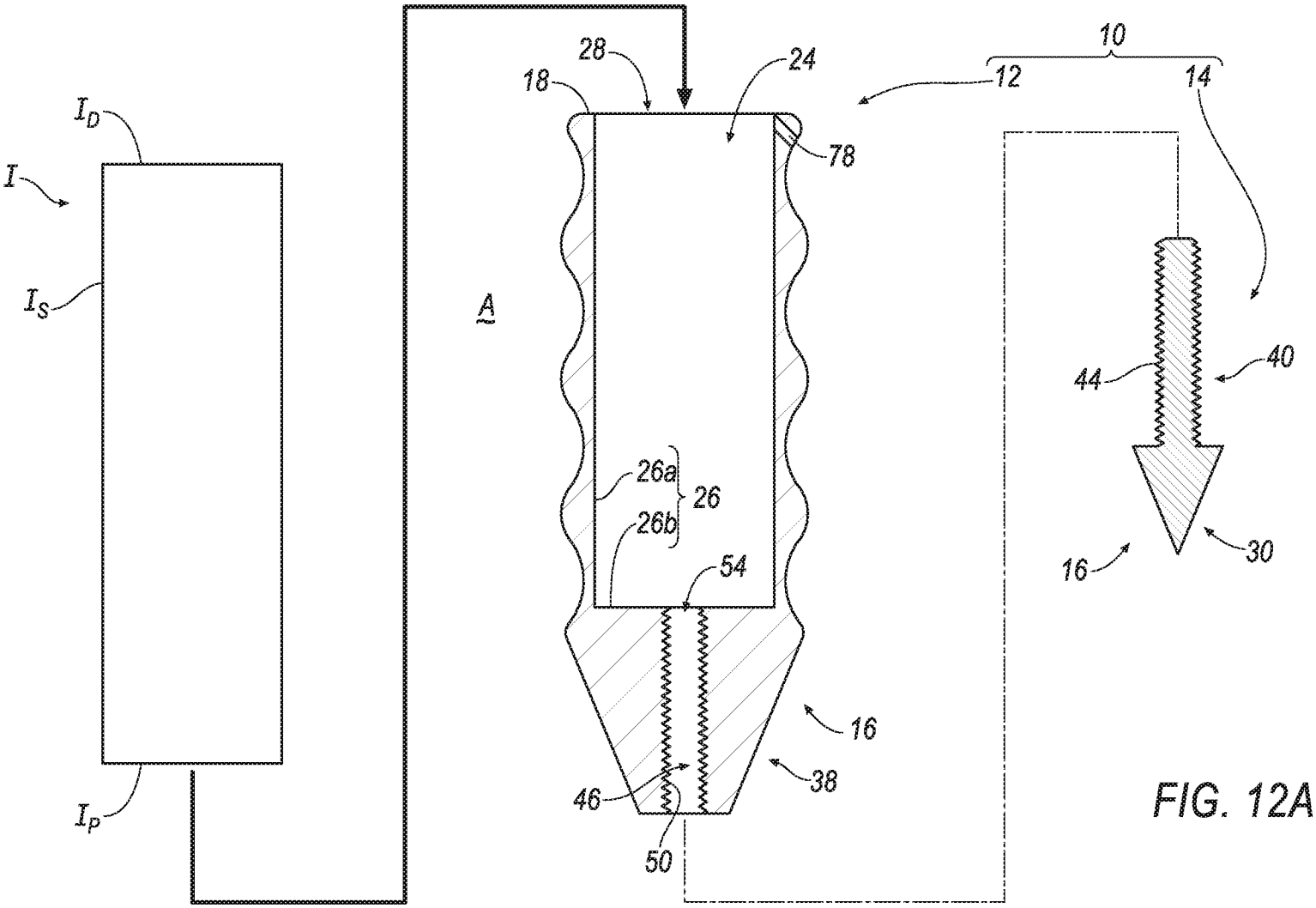
FIGS. 12A-12G are exemplary cross-sectional views illustrating a methodology for assembling and utilizing the self-defense assembly of FIGS. 7-9.
Figure 12B:
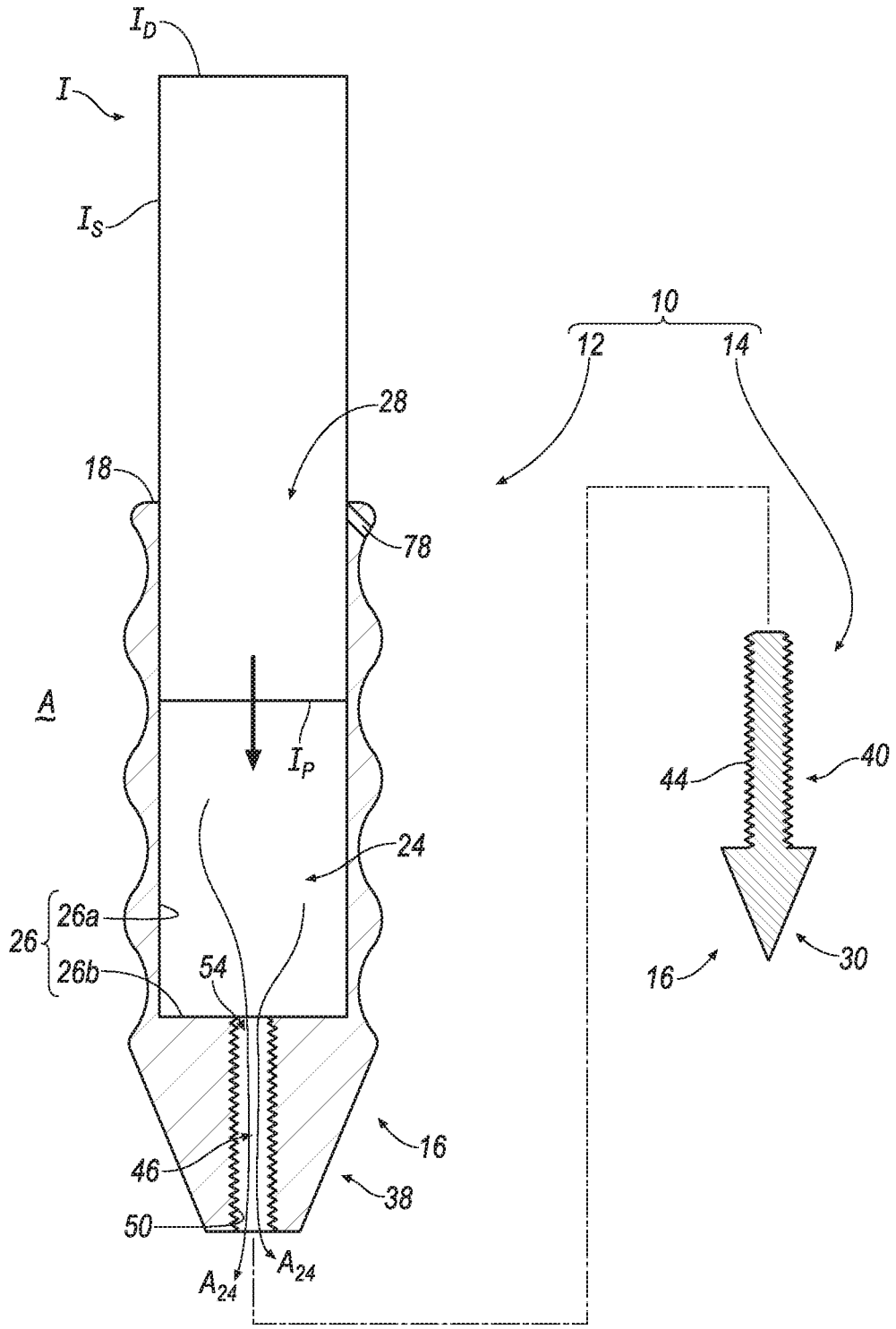
Figure 12C:
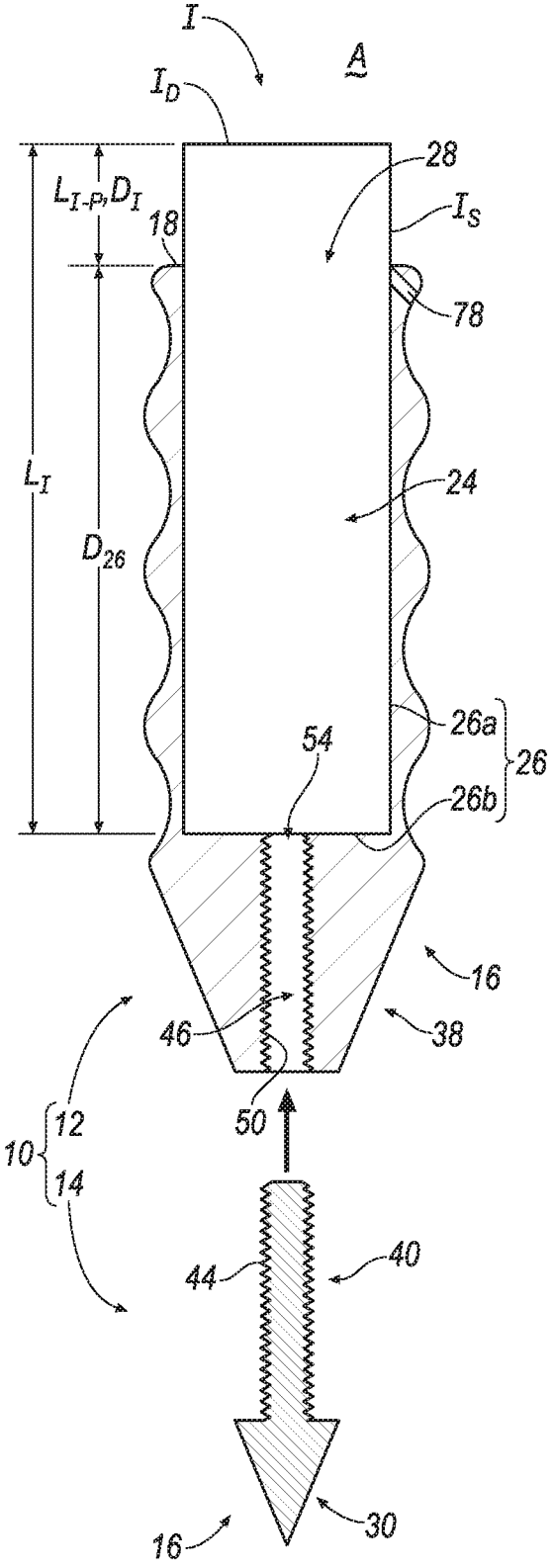

Referring to FIGS. 12A and 12B, an optional first step includes axially aligning (see, e.g., FIG. 12A) and the axially inserting (see, e.g., FIG. 12B) the proximal end $I_P$ of the substantially cylindrical implement I with and subsequently through the proximal sleeve opening 28 formed by the proximal end surface 18 of the sleeve portion 12. As seen at FIGS. 12B and 12C, a second optional step includes arranging the proximal end $I_P$ of the substantially cylindrical implement I in the substantially cylindrical cavity 24 of the sleeve portion 12 and axially displacing air $A_{24}$ within the substantially cylindrical cavity 24 through the fastener-receiving passage 46 to surrounding atmosphere A as the substantially cylindrical implement I is further inserted into the substantially cylindrical cavity 24 until the proximal end $I_P$ of the substantially cylindrical implement I is disposed adjacent the inner base surface 26*b* of the inner surface 26 that defines the substantially cylindrical cavity 24. With reference to FIG. 12C, the substantially cylindrical implement I is selectively retained within the substantially cylindrical cavity 24 in, for example, a friction-fit relationship such that the outer side surface Is of the substantially cylindrical implement I is disposed substantially adjacent the inner side surface 26*a* that defines the substantially cylindrical cavity 24.

As seen at FIG. 12B, the air $A_{24}$ that is displaced from substantially cylindrical cavity 24 to surrounding atmosphere A may axially pass through: firstly, (1) the distal fastener-receiving passage opening 54 formed by the inner base surface 26*b* of the inner surface 26 of the sleeve portion 12 that defines the substantially cylindrical cavity 24; secondly, (2) axially through the fastener-receiving passage 46; and (3) out of the proximal fastener-receiving passage opening 48 formed by the distal end surface 22 of the sleeve portion 12.

Figure 12D:
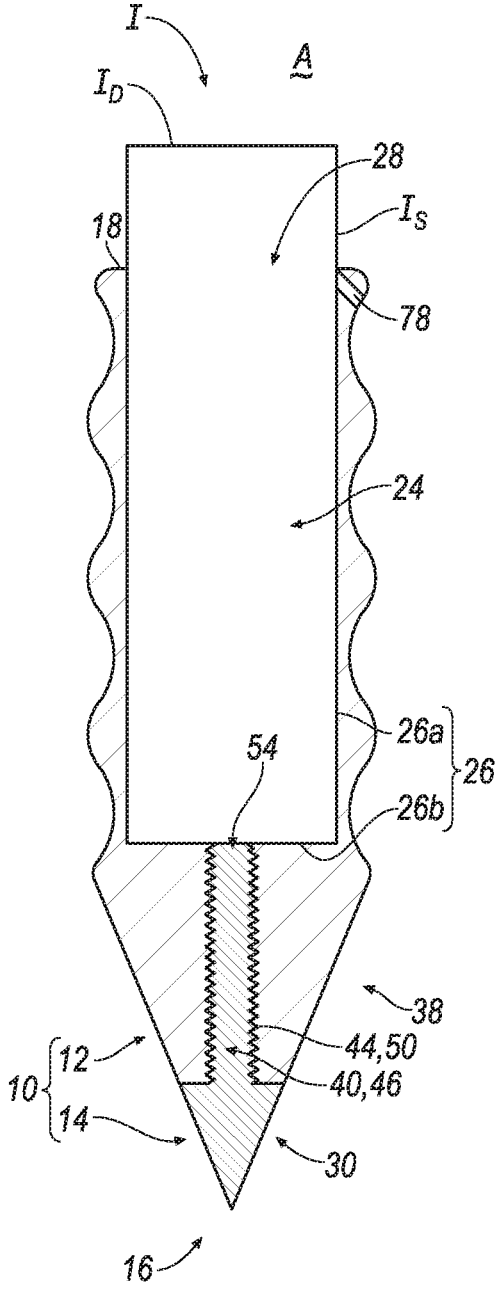

Referring to FIGS. 12C and 12D, the method may include axially aligning the fastener 40 of the adapter portion 14 with the fastener-receiving passage 46 of the sleeve portion 12. As seen at FIG. 12D, the fastener 40 may be inserted into the fastener-receiving passage 46 of the sleeve portion 12. As described above in other exemplary implementations, each of the outer side surface 44 of the fastener 40 and the inner side surface 50 of the fastener-receiving passage 46 are defined by a threaded surface; accordingly, as seen at FIG. 12D, the fastener 40 may be threadingly coupled to the fastener-receiving passage 46 for selectively fastening the adapter portion 14 to the sleeve portion 12. Upon threadingly connecting the fastener 40 of the adapter portion 14 with the fastener-receiving passage 46 of the sleeve portion 12 as seen at FIG. 12D, the adapter portion 14 may at least partially seal the proximal fastener-receiving passage opening 48 formed by the distal end surface 22 of the sleeve portion 12 such that air from surrounding atmosphere A is not permitted to enter the substantially cylindrical cavity 24 from the fastener-receiving passage 46; accordingly, the substantially cylindrical implement I may be secured within the substantially cylindrical cavity 24 as a result of a combination of the friction-fit relationship and an air vacuum within the substantially cylindrical cavity 24 as a result of the adapter portion 14 at least partially sealing the proximal fastener-receiving passage opening 48.

With reference to FIGS. 12$C_1$'-12$C_2$' and 12$C_1$"-12$C_2$", an alternative arrangement of each of the sleeve portion 12 and the adapter 14 of the self-defense apparatus 10 of FIGS. 7-11 is shown for providing exemplary arrangements for sealing the air vacuum within the substantially cylindrical cavity 24 from surrounding atmosphere A. In a first example as seen at FIG. 12$C_1$'-12$C_2$', the distal end surface 22 of the sleeve portion 12 defines, for example, an annular groove or recess 22' that is sized for receiving an annular seal 23; upon securing the adapter portion 14 to the sleeve portion 12 as described above, the proximal end surface 32 of the adapter body 30 of the adapter portion 14 is disposed adjacent and compresses the annular seal 23 and the distal end surface 22 of the sleeve portion 12 for sealing the air vacuum within the substantially cylindrical cavity 24 from surrounding atmosphere A. Upon compressing the annular seal 23, the air vacuum in the substantially cylindrical cavity 24 may be substantially sealed such that air within the substantially cylindrical cavity 24 is not permitted to escape axially through the fastener-receiving passage 46 and then radially outwardly through an air gap formed between the distal end surface 22 of the sleeve portion 12 and the proximal end surface 32 of the adapter body 30 of the adapter portion 14.

In a second example as seen at FIGS. 12$C_1$" and 12$C_2$", the proximal end surface 32 of the adapter body 30 of the adapter portion 14 defines, for example, an annular groove or recess 32' that is sized for receiving an annular seal 33; upon securing the adapter portion 14 to the sleeve portion 12 as described above, the distal end surface 22 of the sleeve portion 12 is disposed adjacent and compresses the annular seal 33 and the proximal end surface 32 of the adapter body 30 of the adapter portion 14 for sealing the air vacuum within the substantially cylindrical cavity 24 from surrounding atmosphere A. Upon compressing the annular seal 23, the air vacuum in the substantially cylindrical cavity 24 may be substantially sealed such that air within the substantially cylindrical cavity 24 is not permitted to escape axially through the fastener-receiving passage 46 and then radially outwardly through an air gap formed between the distal end surface 22 of the sleeve portion 12 and the proximal end surface 32 of the adapter body 30 of the adapter portion 14.

Figure 12E:
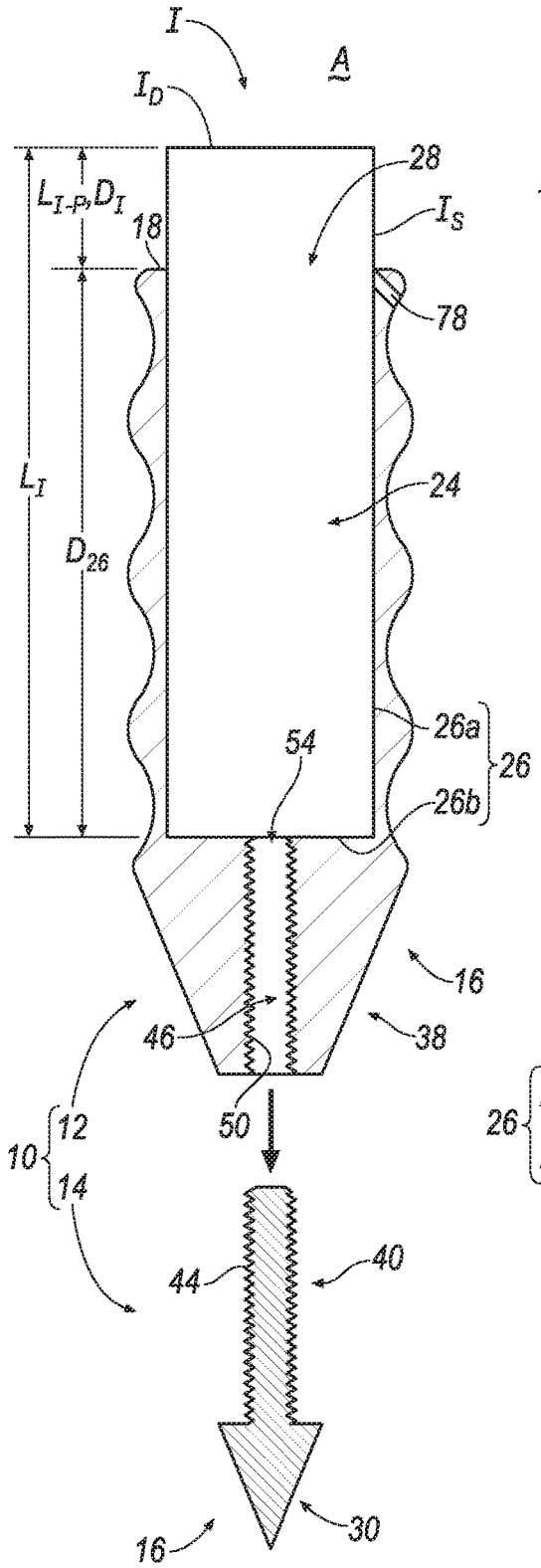
Figure 12F:
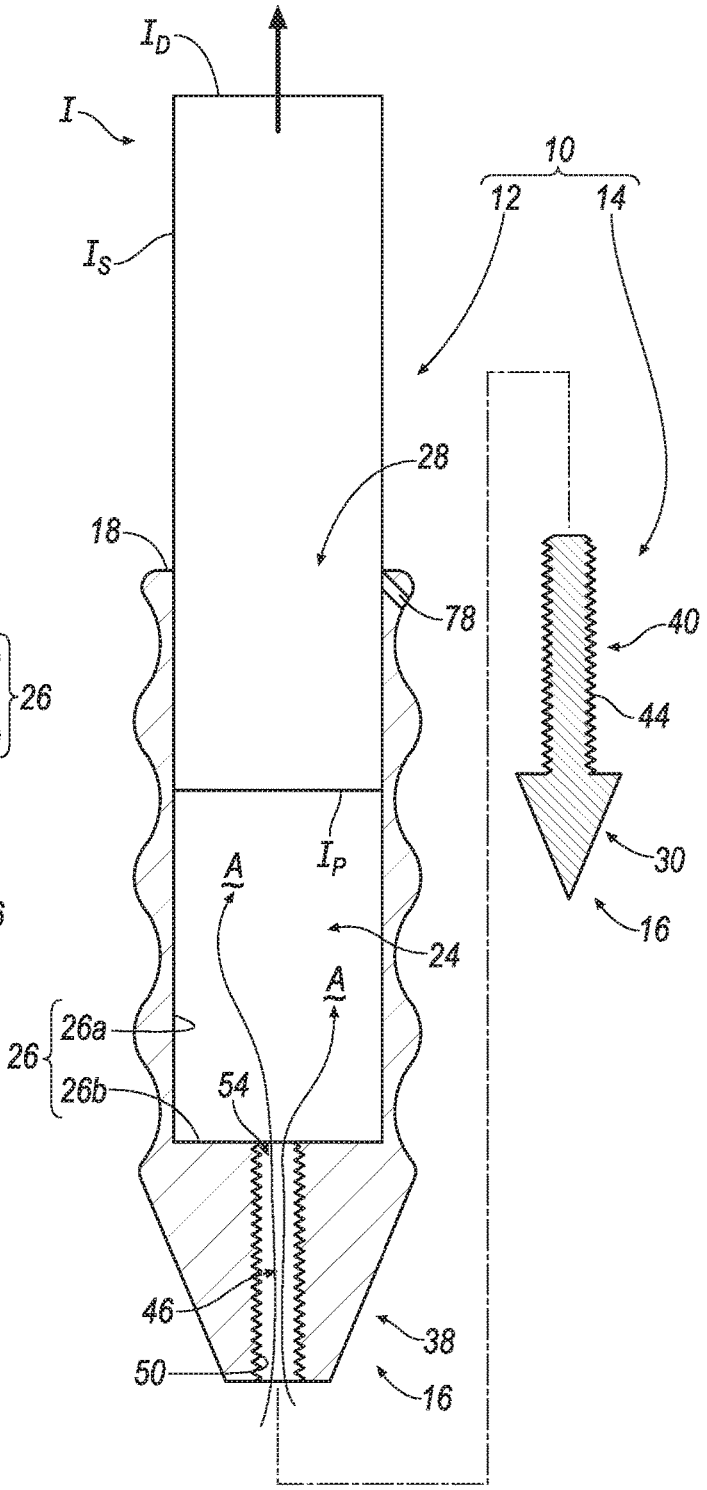
Figure 12G:
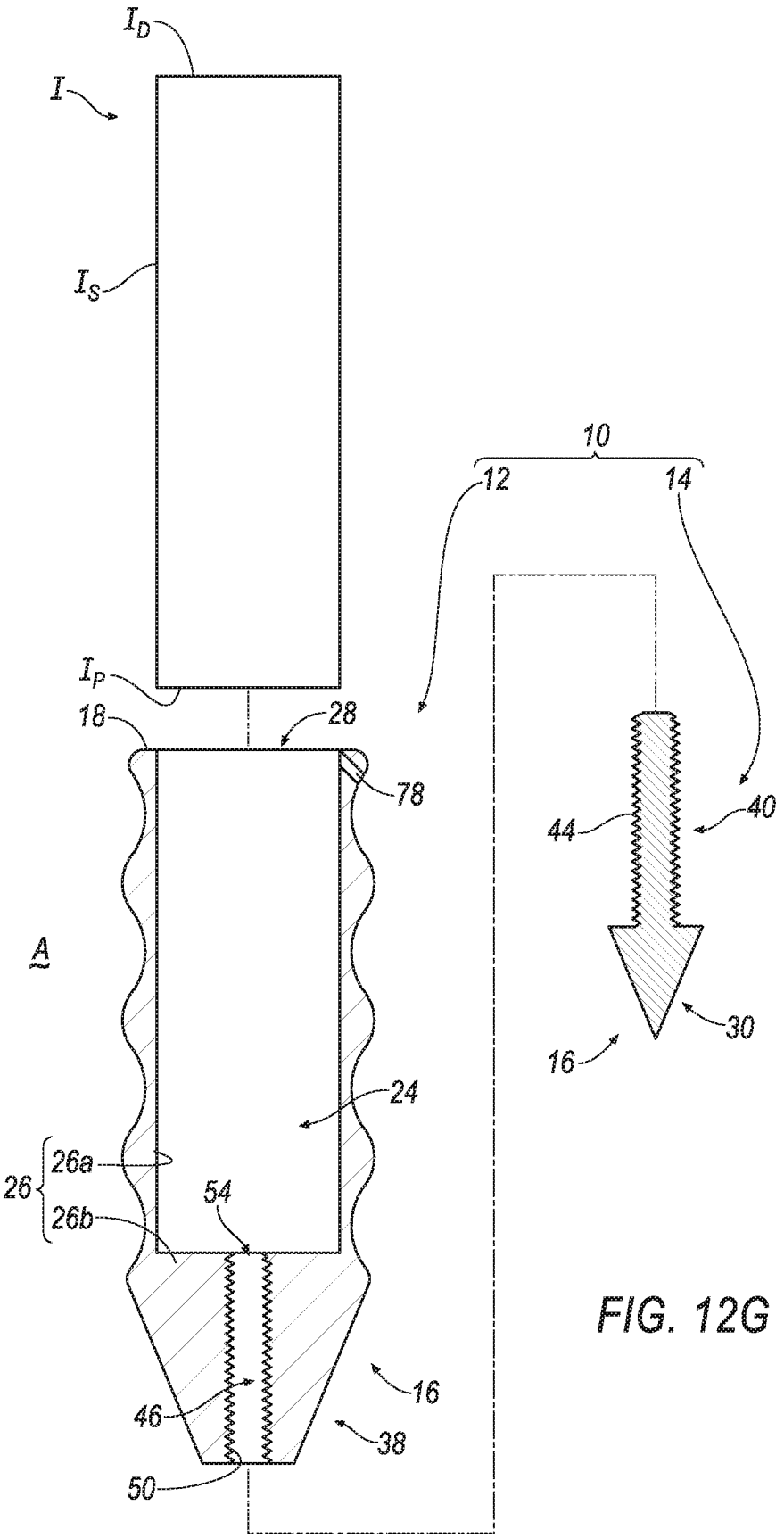

As described above at FIGS. 12A-12G and in the preceding exemplary methodology at FIGS. 6A-6D (when the fastener-receiving passage 46 extends partially through the adapter-interfacing body 38 and therefore is not in direct fluid communication with or axial fluid communication with the substantially cylindrical cavity 24 of the sleeve portion 12), the substantially cylindrical implement I may be non-removably secured within the substantially cylindrical cavity 24 as a result of a combination of the friction-fit relationship and an air vacuum within the substantially cylindrical cavity 24. However, as seen in the methodology at FIGS. 12A-12G, when the fastener-receiving passage 46 extends entirely through the adapter-interfacing body 38 and therefore is in direct fluid communication with or axial fluid communication with the substantially cylindrical cavity 24 of the sleeve portion 12, the substantially cylindrical implement I may then be selectively-removably secured within the substantially cylindrical cavity 24 by unsealing (see, e.g., FIGS. 12E and 12F) the proximal fastener-receiving passage opening 48 formed by the distal end surface 22 of the sleeve portion 12. In some examples as seen at FIG. 12E, the method may further include the step of threadingly decoupling the fastener 40 from the fastener-receiving passage 46 for selectively unfastening the adapter portion 14 from the sleeve portion 12; accordingly, the adapter portion 14 no longer at least partially seals the proximal fastener-receiving passage opening 48 formed by the distal end surface 22 of the sleeve portion 12 from surrounding atmosphere A. With reference to FIGS. 12F and 12G, as a result, if a user wishes to attempt to axially pull the substantially cylindrical implement I out of the substantially cylindrical cavity 24 (see, e.g., FIGS. 12F and 12G), air from surrounding atmosphere A is permitted to axially enter the substantially cylindrical cavity 24 from the fastener-receiving passage 46 thereby relieving the air vacuum that would otherwise be present within the substantially cylindrical cavity 24; accordingly, the exemplary design of the self-defense apparatus 10 of FIGS. 7-9 provides a fastener-receiving passage 46 having a secondary function as a cavity vacuum-relief air passage. With reference to FIG. 12G, when the air vacuum is relieved as described above at FIGS. 12E and 12F, upon overcoming the friction-fit relationship provided by the outer side surface Is of the substantially cylindrical implement I being disposed substantially adjacent the inner side surface 26*a* that defines the substantially cylindrical cavity 24, the user may selectively remove the substantially cylindrical implement I from the substantially cylindrical cavity 24.

With reference to FIG. 10, although an exemplary arrangement of the fastener-receiving passage 46 extending in an axial direction entirely through the adapter-interfacing body 38 and being in direct fluid communication with or axial fluid communication with the substantially cylindrical cavity 24 of the sleeve portion 12 provides a secondary function as a cavity vacuum-relief air passage as seen at FIGS. 12E and 12F, alternative configurations of the sleeve portion 12 includes a dedicated cavity vacuum-relief air passage that is not associated with or in fluid communication with the fastener-receiving passage 46. Referring to FIGS. 13A-13C, 14A-14C and 15A-15C, several exemplary configurations of the sleeve portion 12 includes one or more cavity vacuum-relief air passages 56 that is/are not associated with or in fluid communication with the fastener-receiving passage 46.

Figure 13A:
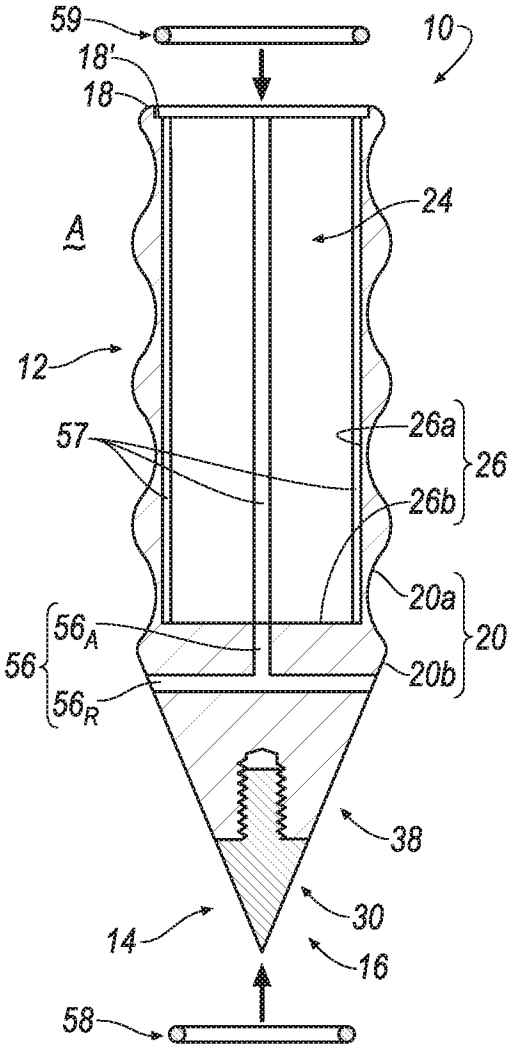
FIGS. 13A-13C are cross-sectional views of an exemplary sleeve portion and a seal for assembling and disassembling the self-defense assembly of FIGS. 1-3.
Figure 15B:
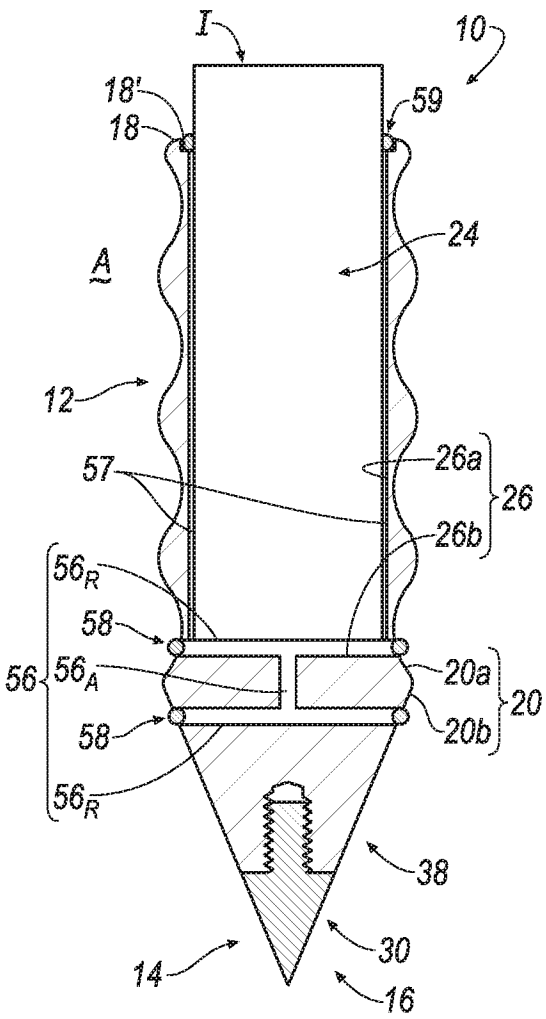
Figure 14B:
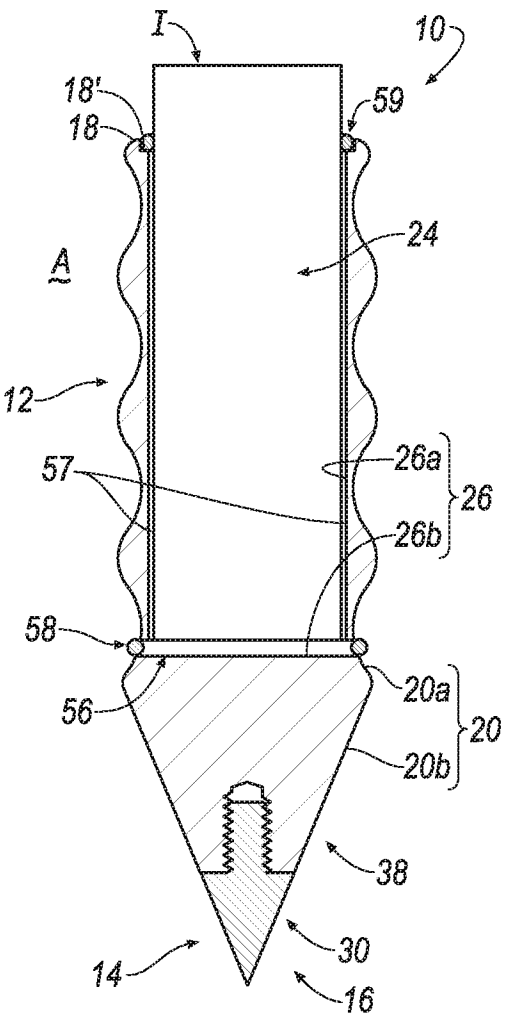

Referring to FIG. 13A, in a first example, when the when the fastener-receiving passage 46 extends partially through the adapter-interfacing body 38 and therefore is not in direct fluid communication with or axial fluid communication with the substantially cylindrical cavity 24 of the sleeve portion 12, the adapter-interfacing body 38 may form at least one cavity vacuum-relief air passage 56. In some examples, the at least one cavity vacuum-relief air passage 56 includes at least one axial air flow passage $\mathbf{56}_A$ and at least one radial air flow passage $\mathbf{56}_R$. The at least one axial air flow passage $\mathbf{56}_A$ is in fluid communication with the substantially cylindrical cavity 24 and extends from the inner base surface 26*b* that defines the substantially cylindrical cavity 24. The at least one radial air flow passage $\mathbf{56}_R$ is in fluid communication with the at least one axial air flow passage $\mathbf{56}_A$ and extends from and is in fluid communication with surrounding atmosphere A at the distal portion 20*b* of the outer side surface 20 of the sleeve portion 12 defines the adapter-interfacing body 38.

Figure 14A:
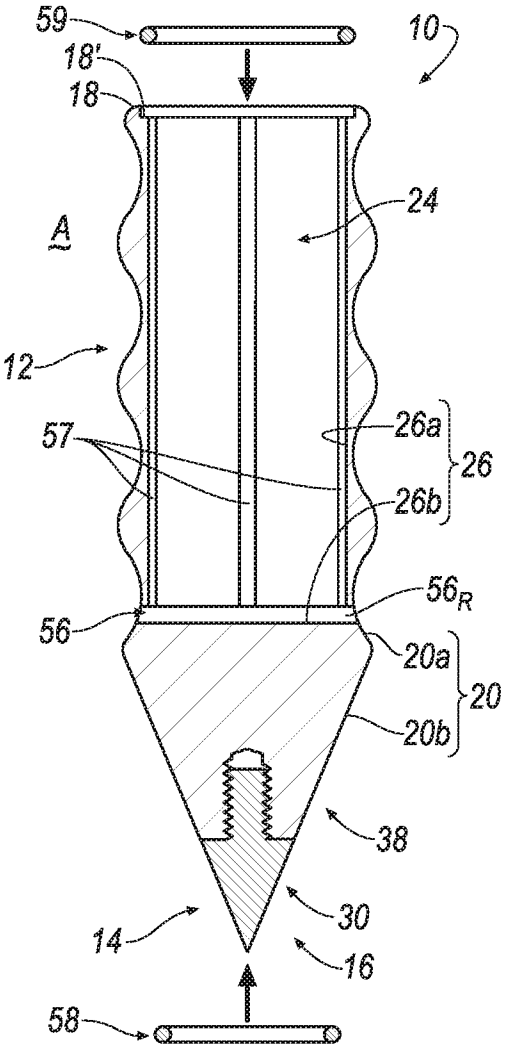
FIGS. 14A-14C are cross-sectional views of an exemplary sleeve portion and a plurality of seals for assembling and disassembling the self-defense assembly of FIGS. 1-3.

Referring to FIG. 14A, in other examples, when the when the fastener-receiving passage 46 extends partially through the adapter-interfacing body 38 and therefore is not in direct fluid communication with or axial fluid communication with the substantially cylindrical cavity 24 of the sleeve portion 12, the adapter-interfacing body 38 may form at least one cavity vacuum-relief air passage 56. In yet other examples, the at least one cavity vacuum-relief air passage 56 includes at least one radial air flow passage $\mathbf{56}_R$. A first end of the at least one radial air flow passage $\mathbf{56}_R$ is in fluid communication with the substantially cylindrical cavity 24 and extends from the inner side surface 26*a* that defines the substantially cylindrical cavity 24. A second end of the at least one radial air flow passage $\mathbf{56}_R$ is in fluid communication extends from and is in fluid communication with surrounding atmosphere A at the proximal portion 20*a* of the outer side surface 20 of the sleeve portion 12 defines the handle portion 12*a* of the sleeve portion 12.

Figure 15A:
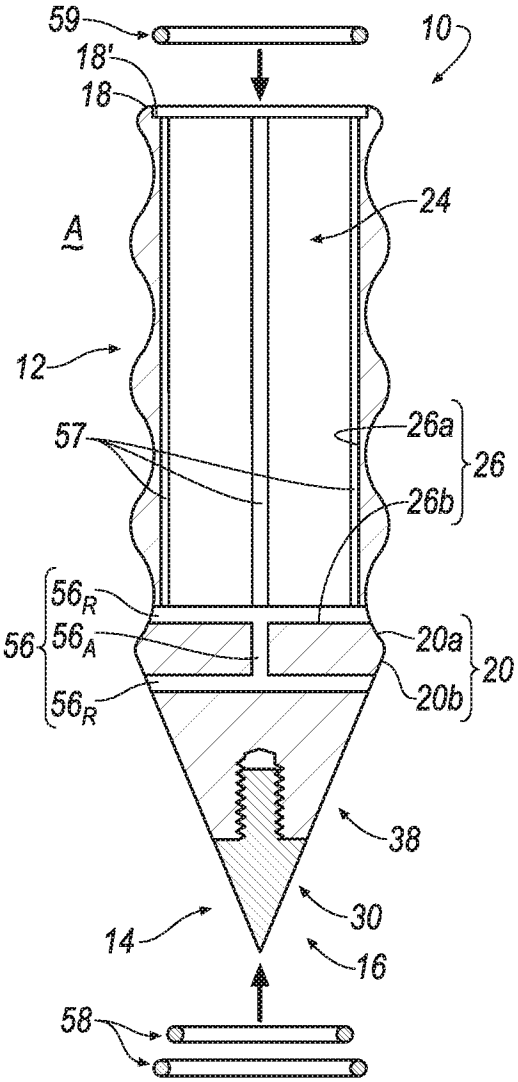
FIGS. 15A-15C are cross-sectional views of an exemplary sleeve portion and a plurality of seals for assembling and disassembling the self-defense assembly of FIGS. 1-3.

Referring to FIG. 15A, in yet another example, when the when the fastener-receiving passage 46 extends partially through the adapter-interfacing body 38 and therefore is not in direct fluid communication with or axial fluid communication with the substantially cylindrical cavity 24 of the sleeve portion 12, the adapter-interfacing body 38 may form at least one cavity vacuum-relief air passage 56. In some implementations as seen at, FIG. 15A, for example, the sleeve portion 12 includes a combination of the embodiments described above at FIGS. 13A and 14A such that at least one cavity vacuum-relief air passage 56 extends through: (1) the distal portion 20*b* of the outer side surface 20 of the sleeve portion 12 defines the adapter-interfacing body 38; and (2) the proximal portion 20*a* of the outer side surface 20 of the sleeve portion 12 defines the handle portion 12*a* of the sleeve portion 12.

Although a plurality of configurations of a sleeve portion 12 including at least one cavity vacuum-relief air passage 56 are described above at FIGS. 13A, 14A and 15A in order to provide fluid communication with surrounding atmosphere A to the substantially cylindrical cavity 24 for relieving an air vacuum with the substantially cylindrical cavity 24, one or more of the at least one cavity vacuum-relief air passage 56 may be selectively sealed such that the air vacuum within the substantially cylindrical cavity 24 is maintained for removably securing the substantially cylindrical implement I within the substantially cylindrical cavity 24 in a manner resulting from a combination of the friction-fit relationship and the vacuum. For example, as seen at FIGS. 13A and 13B, 14A-14B and 15A-15B, one or more seals 58 (e.g. one or more o-rings) may be selectively disposed over a region of one or more of the proximal portion 20*a* of the outer side surface 20 of the sleeve portion 12 and the distal portion 20*b* of the outer side surface 20 of the sleeve portion 12 that at least partially forms the at least one cavity vacuum-relief air passage 56. Referring to FIGS. 13B-13C, 14B-14C and 15B-15C, in the event that a user wishes to relieve the vacuum within the substantially cylindrical cavity 24 for removing the substantially cylindrical implement I from the substantially cylindrical cavity 24, the user may remove the one or more seals 58 from being selectively disposed over a region of one or more of the proximal portion 20*a* of the outer side surface 20 of the sleeve portion 12 and the distal portion 20*b* of the outer side surface 20 of the sleeve portion 12 that at least partially forms the at least one cavity vacuum-relief air passage 56.

In other configurations as seen at FIGS. 13A-13C, 14A-14C and 15A-15C, the inner side surface 26*a* that defines the substantially cylindrical cavity 24 also includes one or more cavity vacuum-relief air passages 57. The one or more cavity vacuum-relief air passages 57 may axially extend along the inner side surface 26*a* in an axial direction from the inner base surface 26*b* that defines the substantially cylindrical cavity 24 to the proximal end surface 18 of the sleeve portion 12.

Figure 13B:
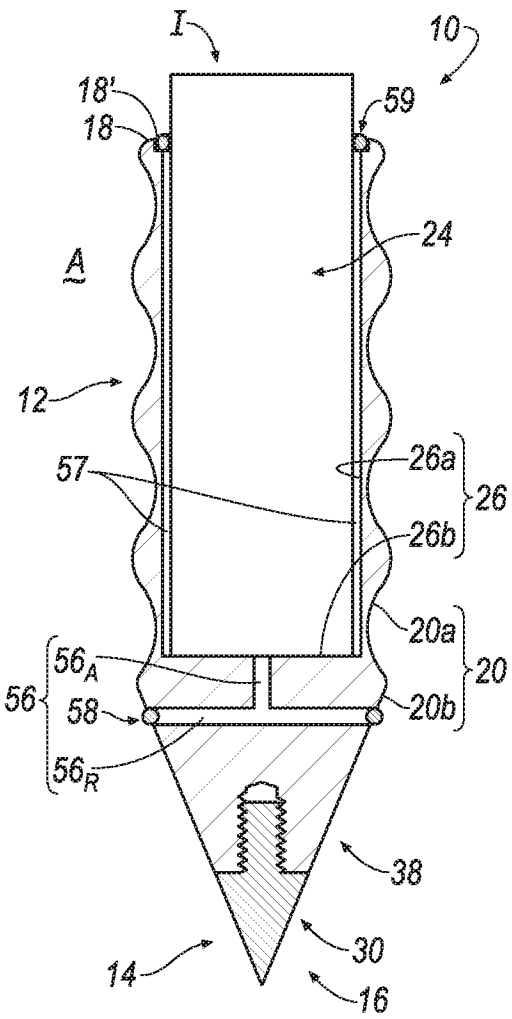
Figure 15C:
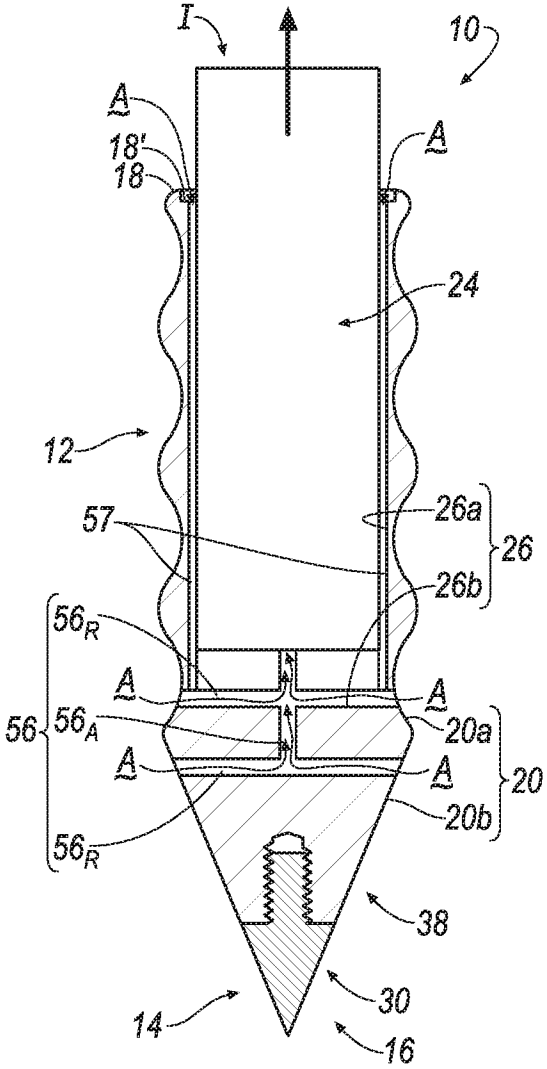
Figure 14C:
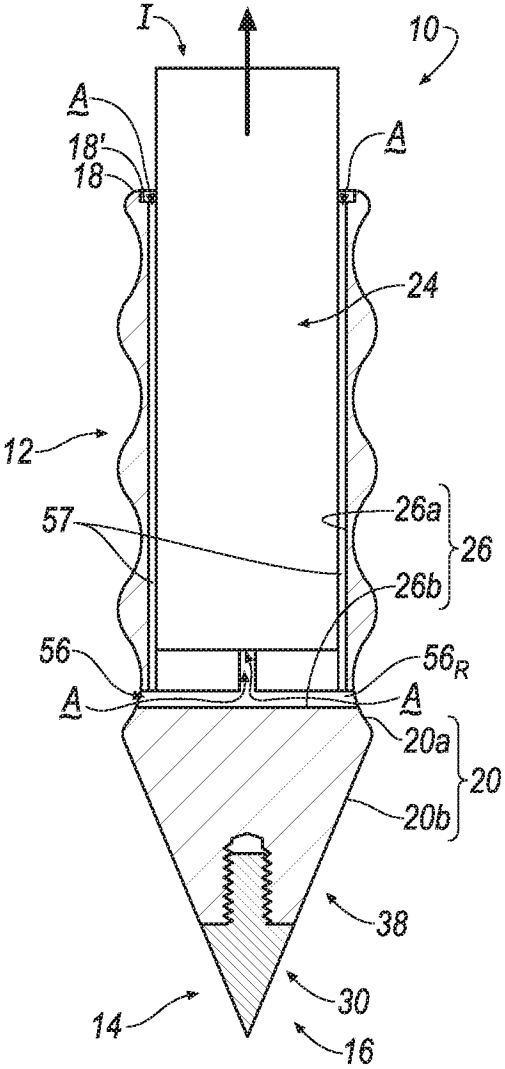
Figure 13C:
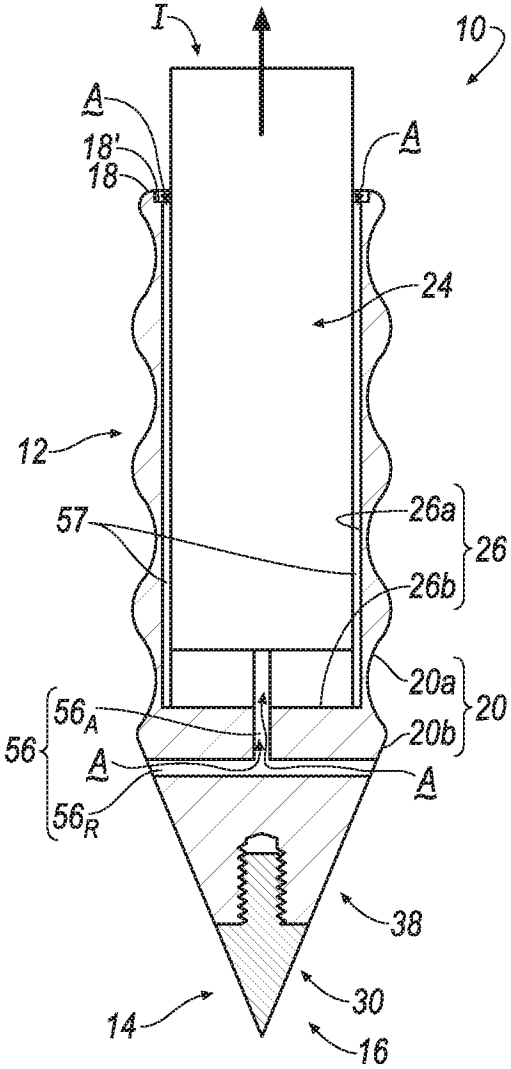

Referring to FIG. 13', in other exemplary configurations, the one or more cavity vacuum-relief air passages 57 define four cavity vacuum-relief air passages 57 radially extending into the inner side surface 26*a* that may be spaced apart approximately 90°. Furthermore, as seen at FIGS. 13A-13C, 14A-14C and 15A-15C and 13'-13", the proximal end surface 18 of the sleeve portion 12 may define an annular recess 18' that is sized for receiving annular seal 59 for sealing the one or more cavity vacuum-relief air passages 57 from surrounding atmosphere A for sealing the air vacuum within the substantially cylindrical cavity 24 from surrounding atmosphere A. As seen at FIGS. 13', 13B, 14B and 15B, the annular seal 59 may also circumscribe and be disposed directly adjacent the outer side surface Is of the substantially cylindrical implement I.

Although a friction-fit relationship arising from the outer side surface Is of the being disposed substantially adjacent the inner side surface 26*a* that defines the substantially cylindrical cavity 24 may selectively retain the substantially cylindrical implement I within the substantially cylindrical cavity 24, with reference to FIGS. 16A-16C, 17A-17B and 18A-18C, other configurations of the sleeve portion 12 includes one or more implement retainers 62, and, as such, the design of the self-defense apparatus 10 may not solely rely upon a sleeve portion 12 providing a friction-fit relationship for selectively retaining the substantially cylindrical implement I within the substantially cylindrical cavity 24. Furthermore, the exemplary implementations of the sleeve portion described at FIGS. 16A-16C, 17A-17B and 18A-18C utilizes the one or more implement retainers 62 disposed adjacent the outer side surface Is of the substantially cylindrical implement I for retaining the substantially cylindrical implement I within the substantially cylindrical cavity 24 without the outer side surface Is of the substantially cylindrical implement I directly contacting the inner side surface 26*a* that defines the substantially cylindrical cavity 24 (i.e., the inner side surface 26*a* that defines the substantially cylindrical cavity 24 for the implementations described at FIGS. 16A-16C, 17A-17B and 18A-18C may not provide a friction-fit relationship for retaining the substantially cylindrical implement I within the substantially cylindrical cavity 24). Alternatively, the exemplary implementations of the sleeve portion described at FIGS. 16A-16C, 17A-17B and 18A-18C may utilize the one or more implement retainers 62 for supplementing the friction-fit relationship (i.e., one or more portions of the inner side surface 26*a* that defines the substantially cylindrical cavity 24 for the implementations described at FIGS. 16A-16C, 17A-17B and 18A-18C may still directly contact the outer side surface Is of the substantially cylindrical implement I to provide a friction-fit relationship for retaining the substantially cylindrical implement I within the substantially cylindrical cavity 24).

Figure 16A:
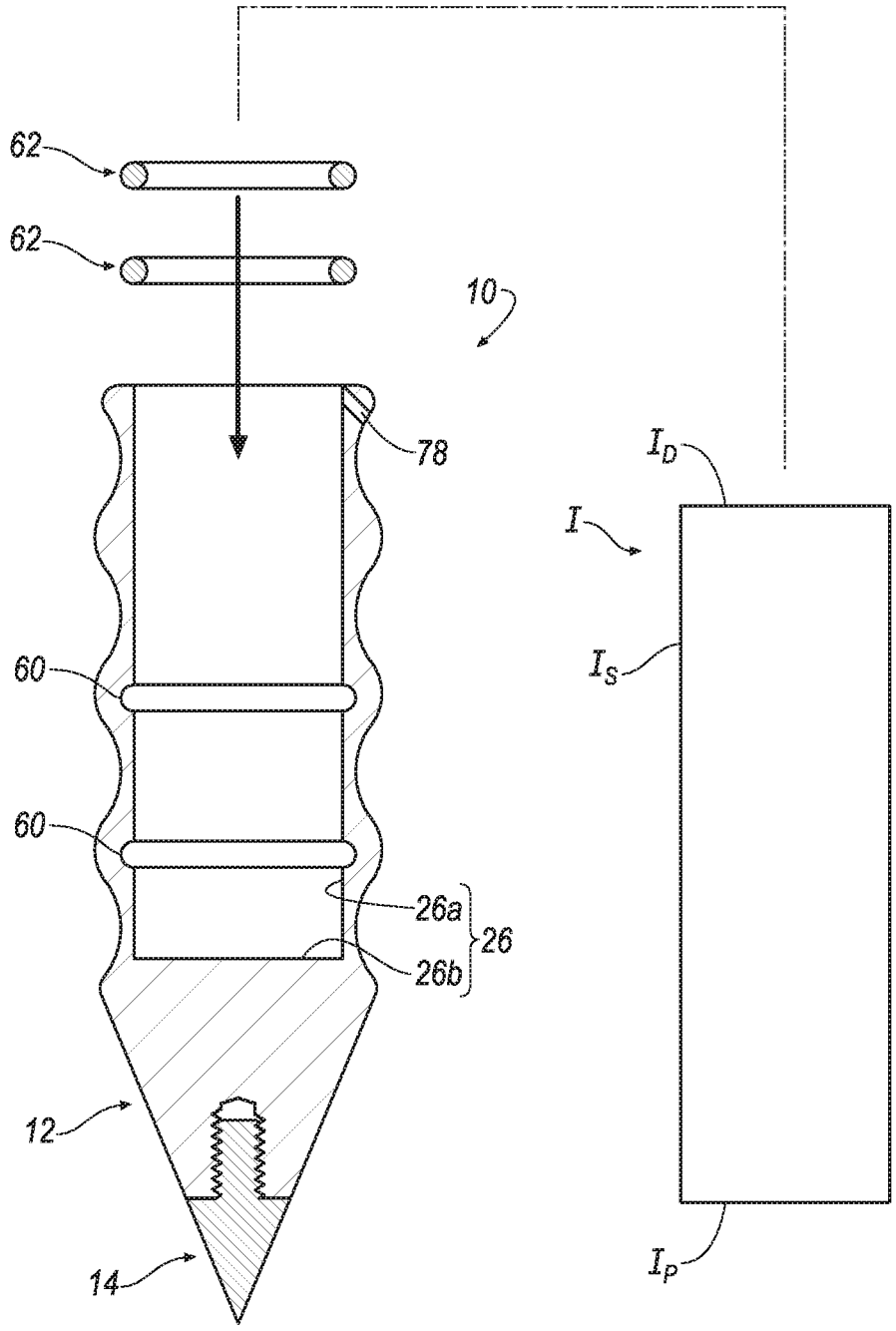
FIGS. 16A-16C are cross-sectional views of an exemplary sleeve portion and a seal for assembling and disassembling the self-defense assembly of FIGS. 1-3.
Figure 16B:
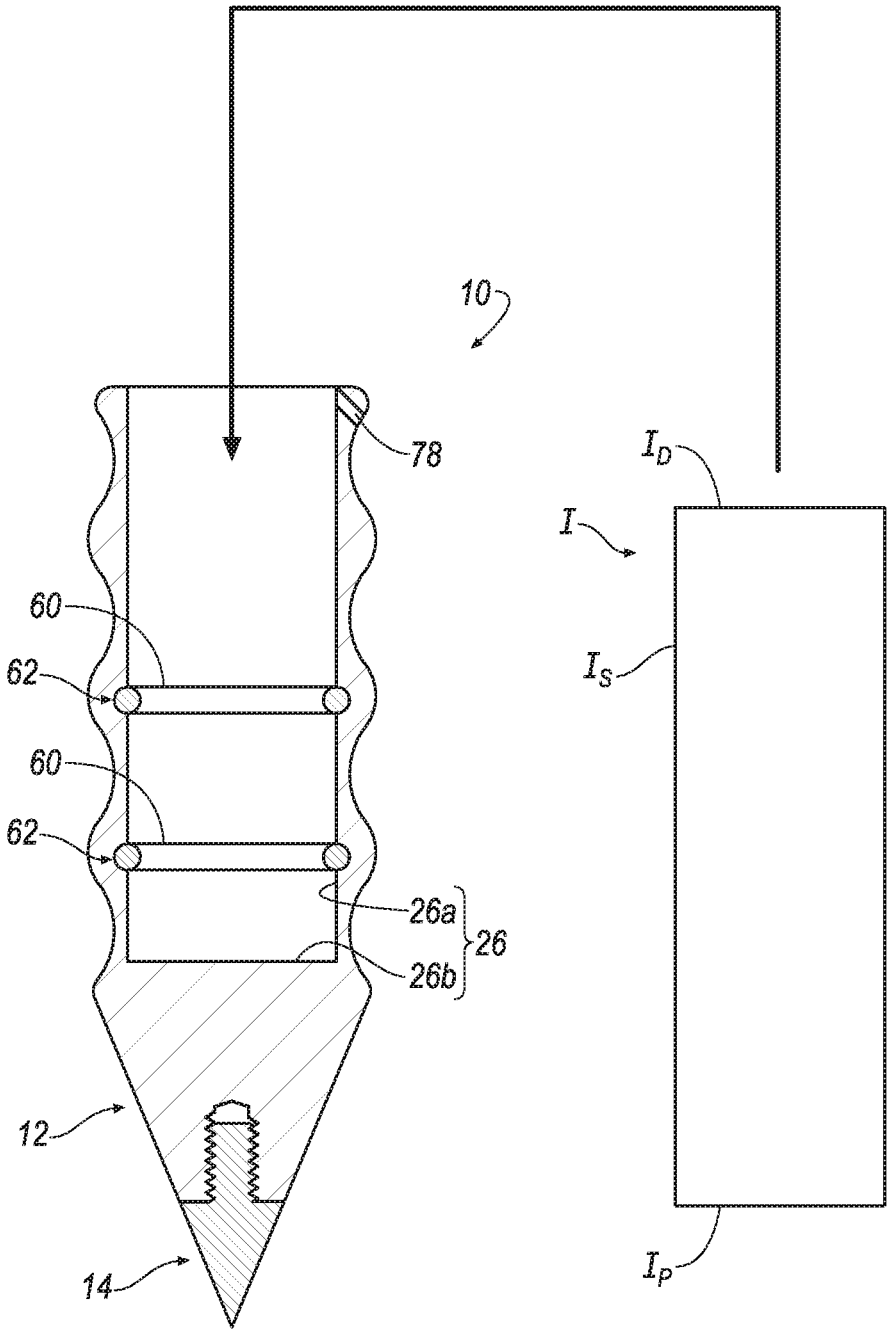
Figure 16C:
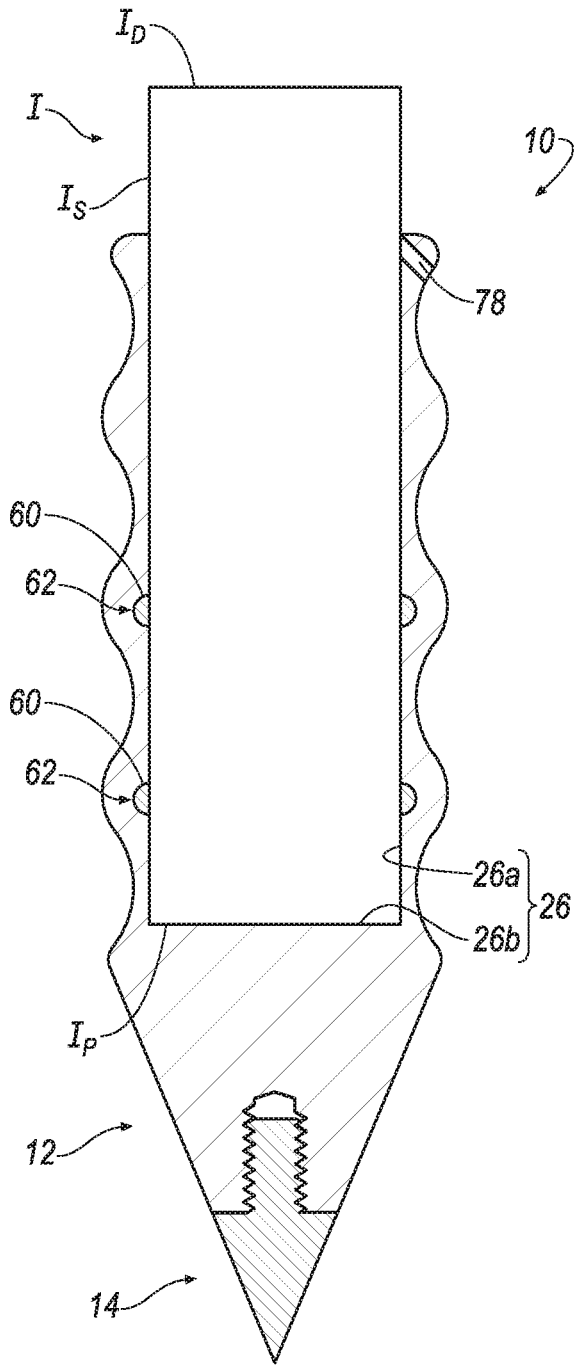

In a first example as seen at FIG. 16A, some exemplary implementations of the sleeve portion 12 include one or more annular grooves 60 formed within the inner side surface 26*a* that defines the substantially cylindrical cavity 24. As seen at FIGS. 16A and 16B, each annular groove 60 may be sized for receiving an implement retainer 62 (e.g., a gasket or o-ring). Accordingly, as seen at FIG. 16C, when the substantially cylindrical implement I is disposed within the substantially cylindrical cavity 24, each implement retainer 62 may directly engage and circumscribe the outer side surface Is of the substantially cylindrical implement I in order to frictionally engage the outer side surface Is of the substantially cylindrical implement I.

Figure 17A:
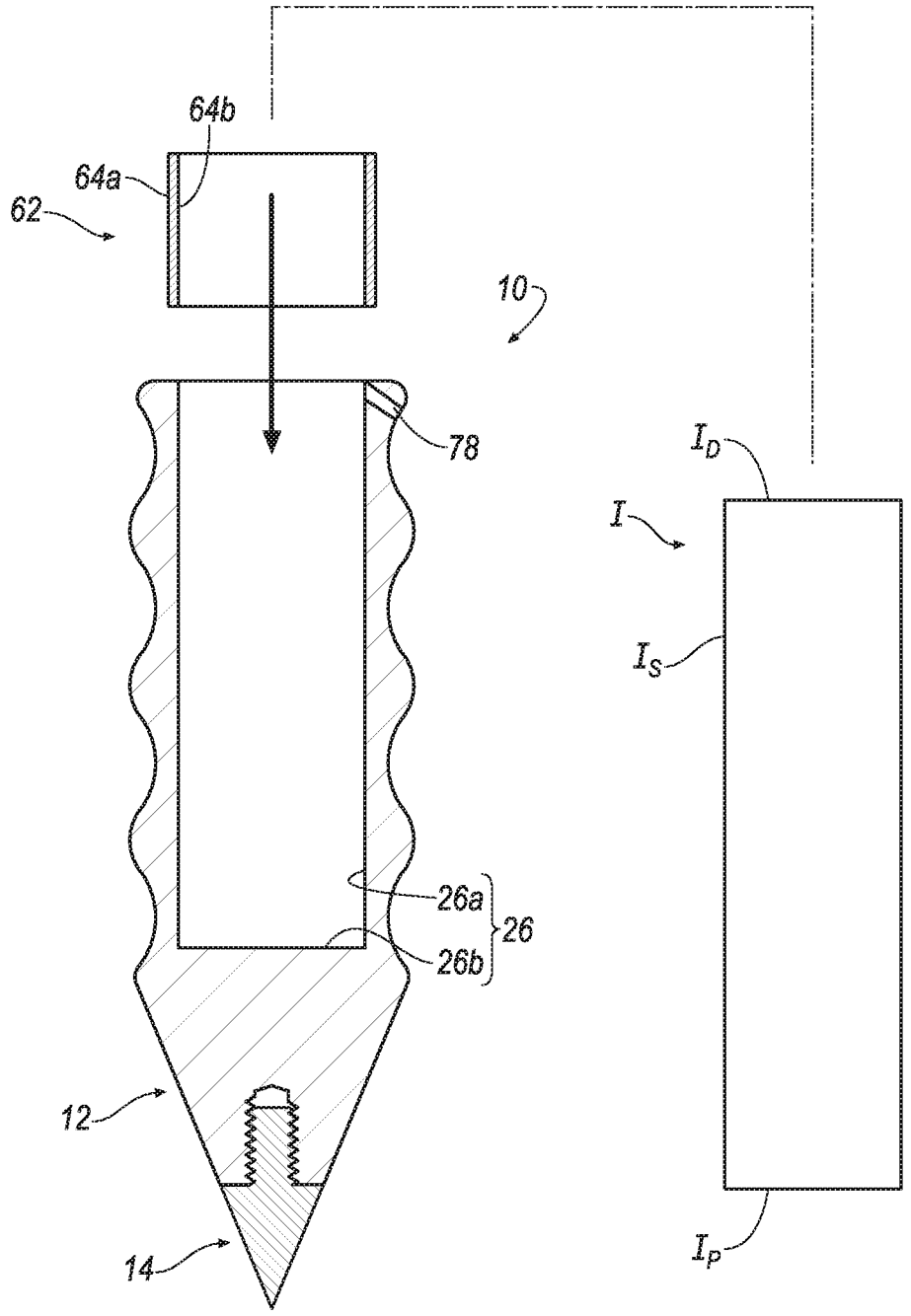
FIGS. 17A-17C are cross-sectional views of an exemplary sleeve portion and a seal for assembling and disassembling the self-defense assembly of FIGS. 1-3.

Referring to FIG. 17A, other exemplary implementations of the sleeve portion 12 includes the inner side surface 26*a* not defining one or more annular grooves (as described above at, for example, FIG. 16A). However, at least one implement retainer 64 may be disposed directly adjacent the groove-less inner side surface 26*a* of some exemplary implementations of the sleeve portion 12 of FIG. 17A. In some examples, the at least one implement retainer 64 of FIG. 17A includes a sticky coating, a tacky coating or a double-sided tape. Although several examples (e.g., coatings or tape) are mentioned above, the following discussion is directed to a double-side tape but could be equally applied to a coating. Furthermore, although the at least one implement retainer 64 is described as being secured to the inner side surface 26*a* of the sleeve portion 12, the at least one implement retainer 64 may be applied to or circumscribe the outer side surface Is of the substantially cylindrical implement I prior to inserting the substantially cylindrical implement I within the substantially cylindrical cavity 24.

Figure 17B:
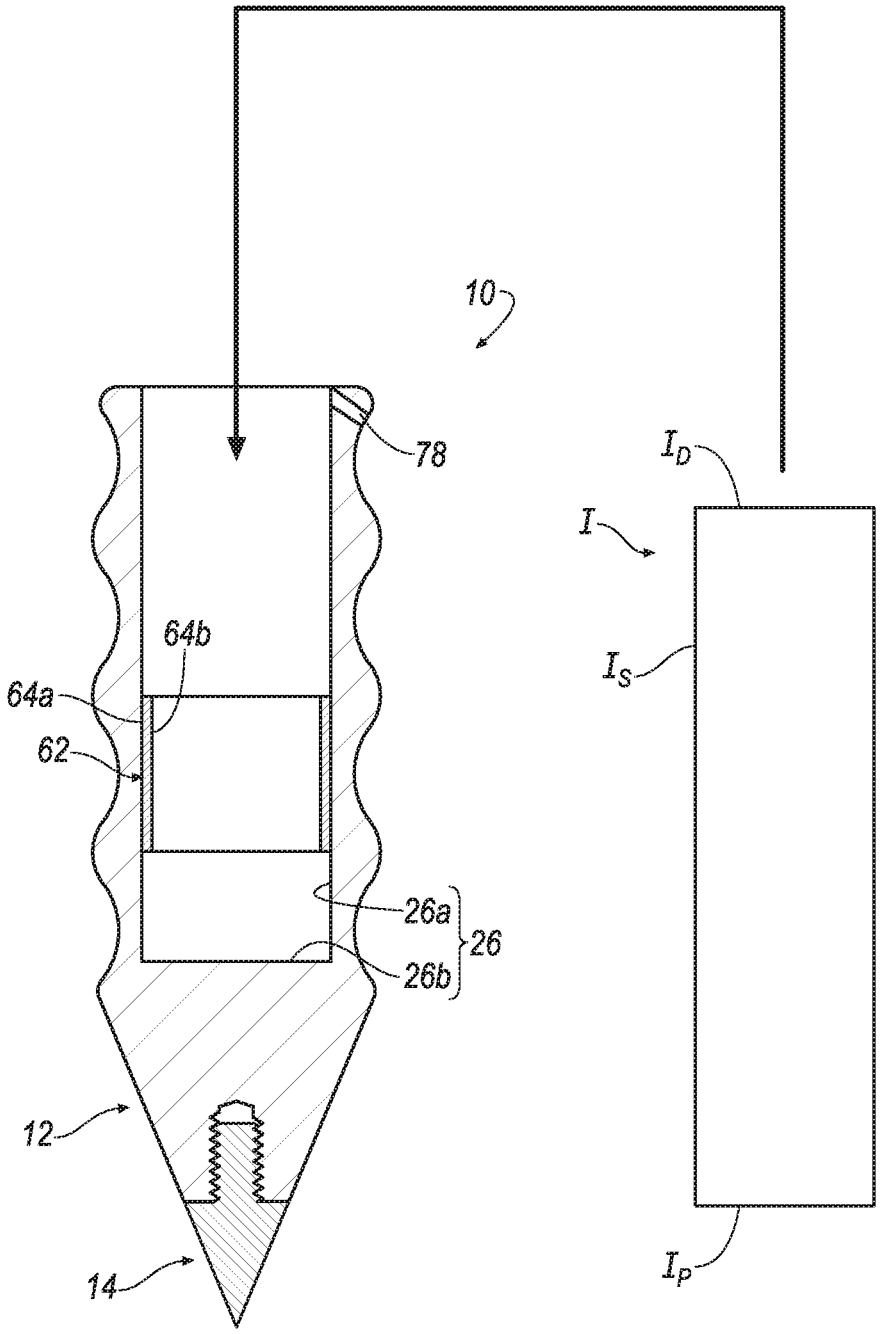
Figure 17C:
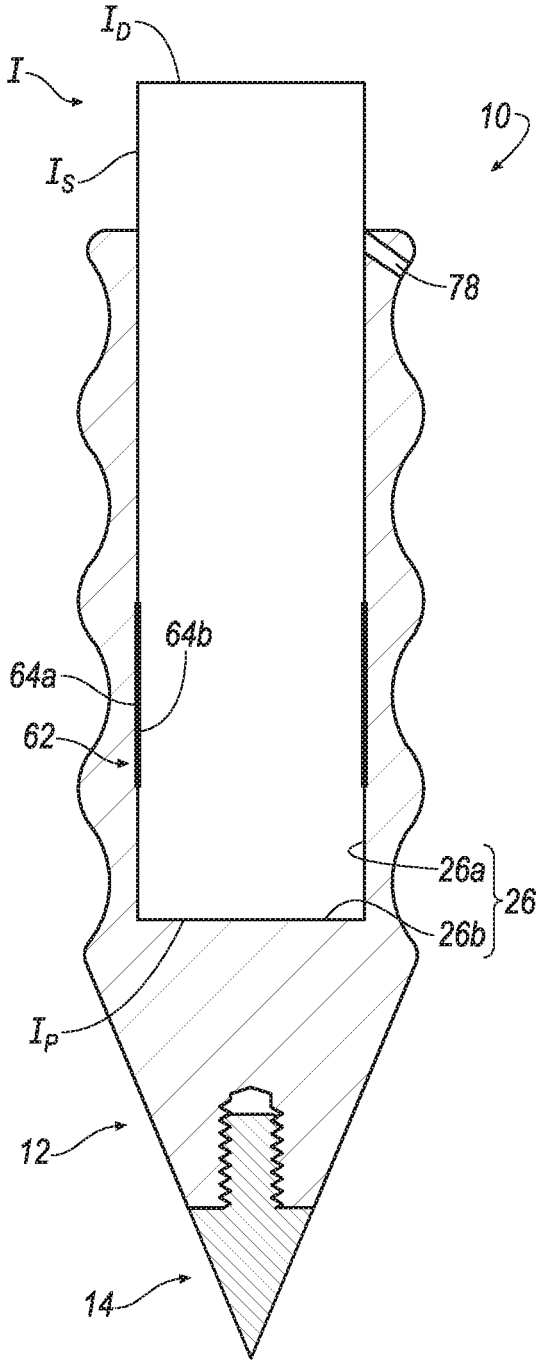

As seen at FIG. 17A, a first tacky side 64*a* of the double-sided tape 64 is utilized for securing the double-sided tape 64 to the groove-less inner side surface 26*a* defining the substantially cylindrical cavity 24. As seen at FIGS. 17B and 17C, a second tacky side 64*b* of the double-sided tape 64 is utilized for circumscribing the outer side surface Is of the substantially cylindrical implement I in order to frictionally engage the outer side surface Is of the substantially cylindrical implement I.

Figure 18A:
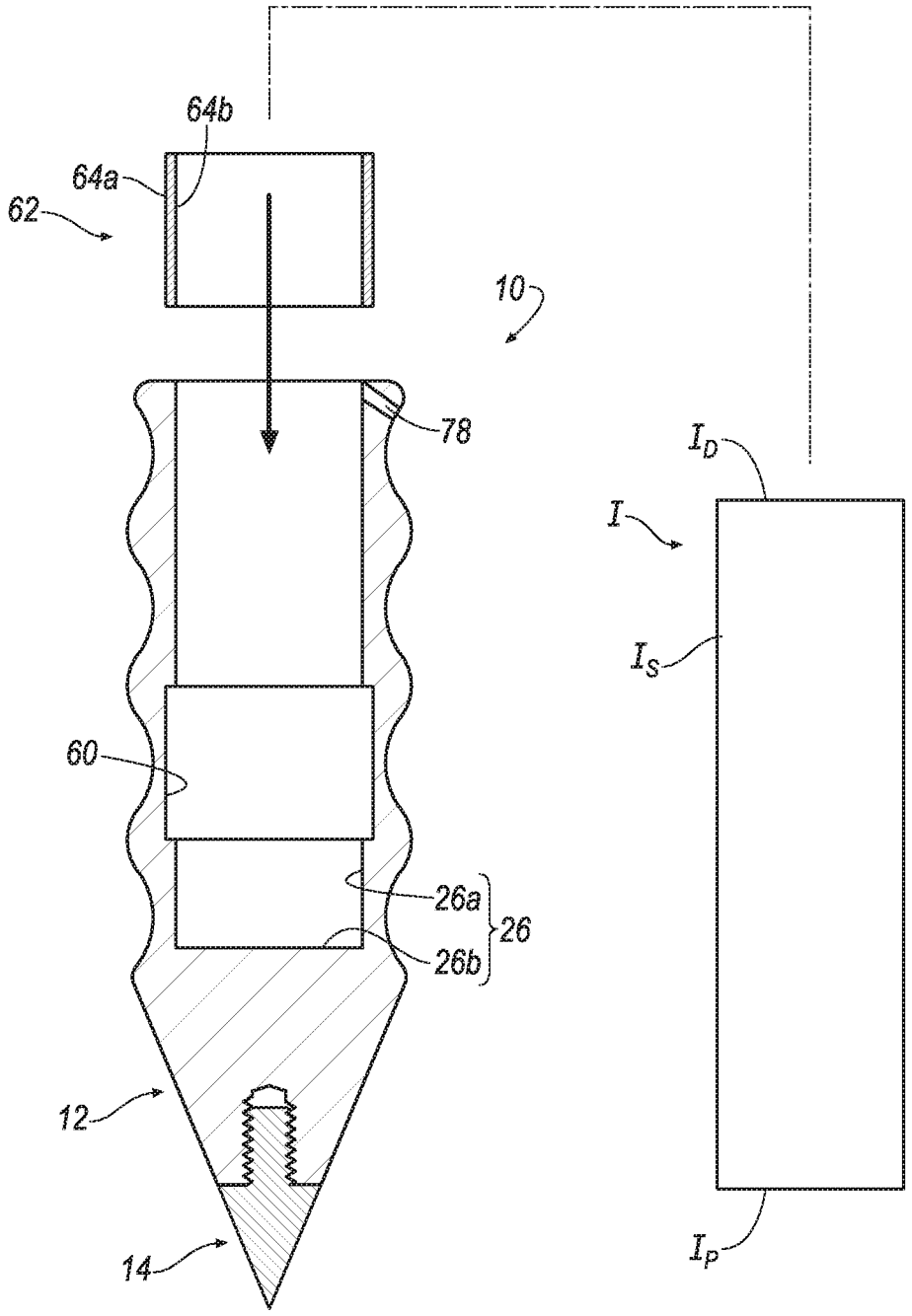
FIGS. 18A-18C are cross-sectional views of an exemplary sleeve portion and a seal for assembling and disassembling the self-defense assembly of FIGS. 1-3.
Figure 18B:
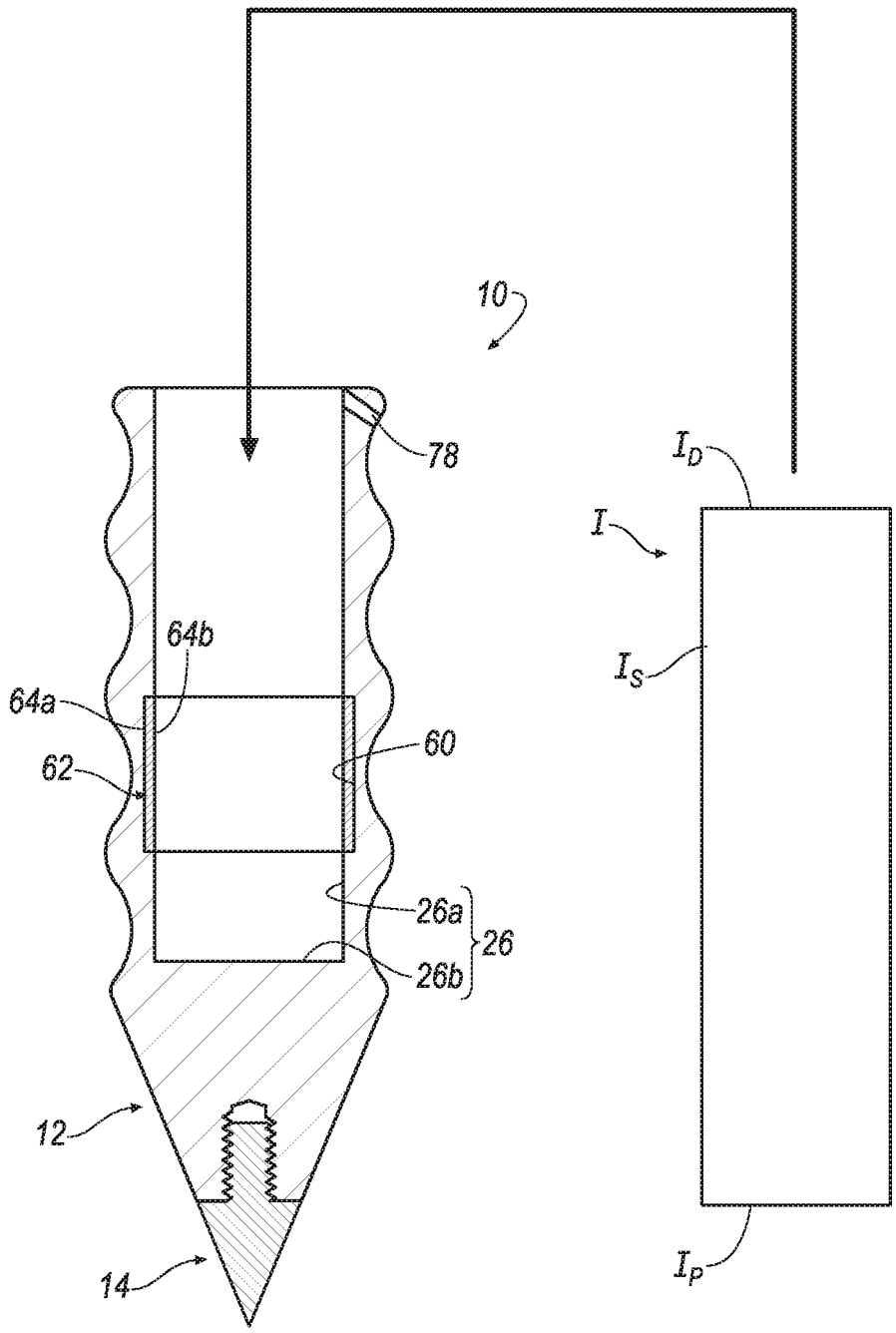
Figure 18C:
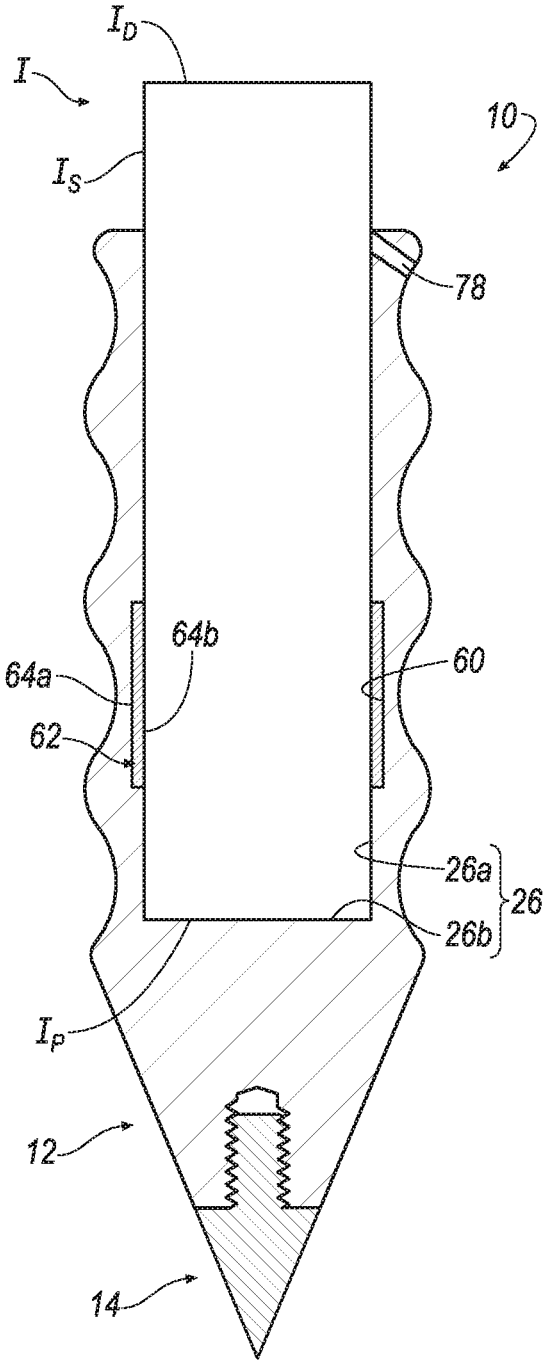

In other configurations seen at FIG. 18A, the inner side surface 26*a* that defines the substantially cylindrical cavity 24 includes one or more annular grooves 60 that is/are sized for receiving the sticky coating, the tacky coating, the double-sided tape 64 or the like. The depth of the one or more annular grooves 60 may be approximately equal to but slightly less than a thickness of the sticky coating, the tacky coating, the double-sided tape 64. As seen at FIGS. 18B and 18C, the second tacky side 64*b* of the sticky coating, tacky coating, double-sided tape 64 may be substantially flush with the inner side surface 26*a* that defines the substantially cylindrical cavity 24 so that the cavity radius $R_{24}$ of the substantially cylindrical cavity 24 remains substantially constant after the sticky coating, tacky coating, double-sided tape 64 is disposed within the one or more annular grooves 60. Accordingly, some exemplary implementations of FIGS. 18A-18C may function in a substantially similar manner to some exemplary implementations of FIGS. 17A-17C whereby the second tacky side 64*b* of the double-sided tape 64 is utilized for circumscribing the outer side surface Is of the substantially cylindrical implement I in order to frictionally engage the outer side surface Is of the substantially cylindrical implement I.

Referring to FIGS. 19A-19B and 20A-20B, other configurations of one or both of the sleeve portion 12 and the adapter portion 14 includes one or more biometric-retaining grooves 66. The one or more biometric-retaining grooves 66 may collect biometrics (e.g., blood, skin tissue, hair and the like) of an assailant in the event that a user wields the weapon 66 provided by the self-defense apparatus 10. If biometrics of an assailant is captured by the self-defense apparatus 10, the self-defense apparatus 10 may be provided to an authority (e.g., police) for helping to biometrically identify the assailant.

Figure 19A:
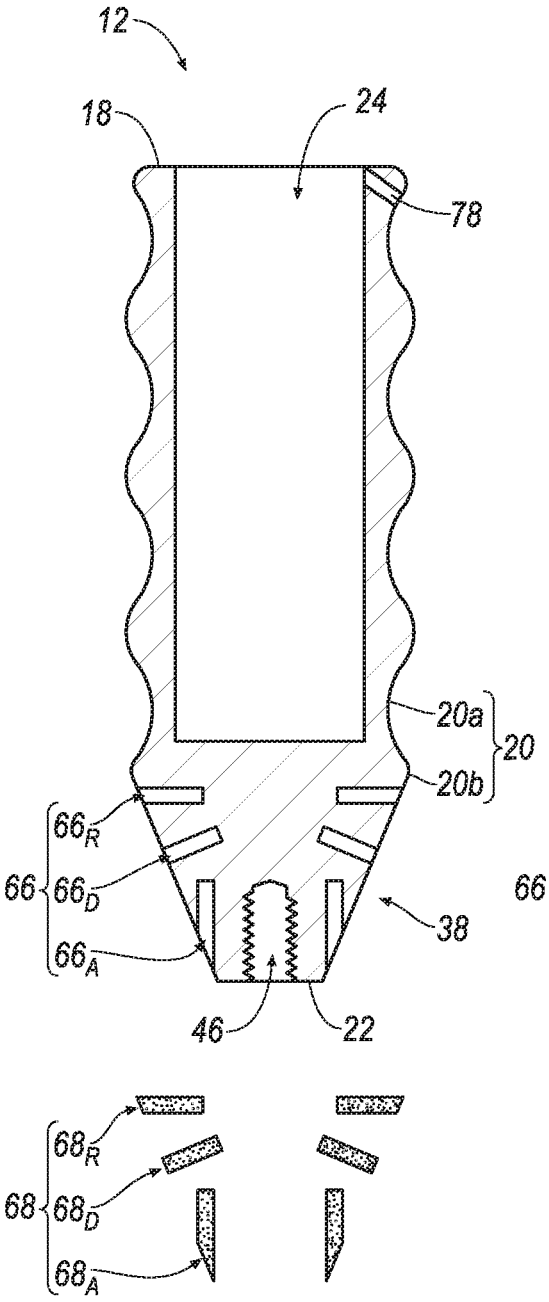
FIGS. 19A-19B are cross-sectional views of an exemplary sleeve portion including one or more biometric-retaining grooves and/or one or more biometric retainers.
Figure 19B:
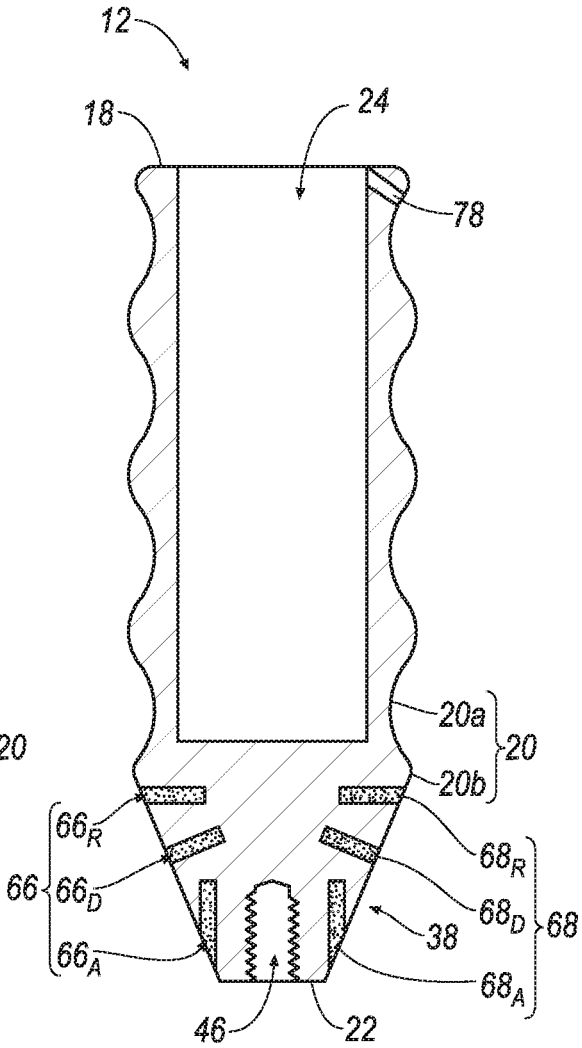
Figure 20A:
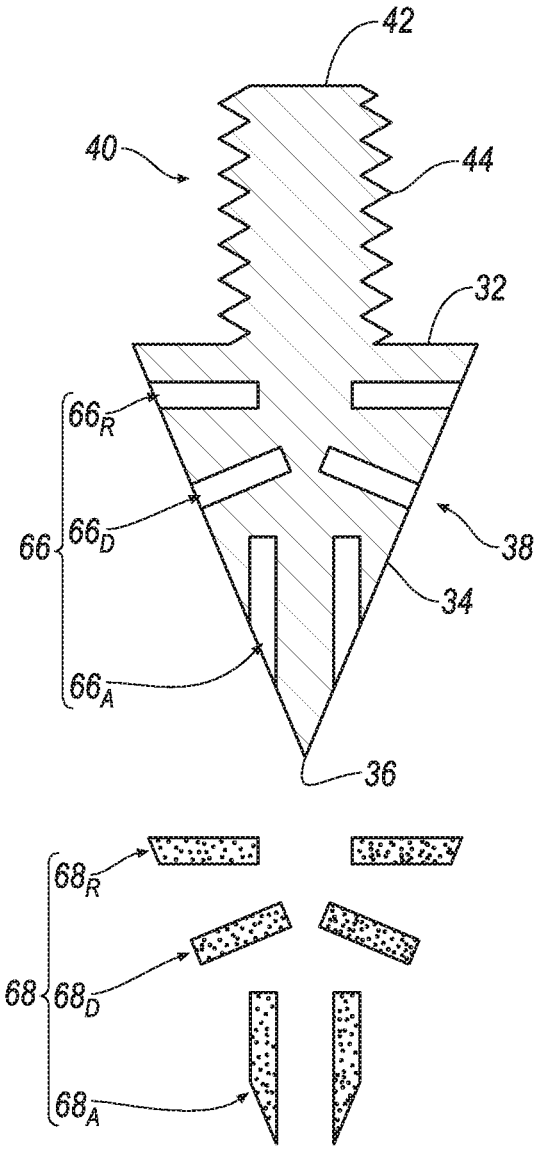
FIGS. 20A-20B are cross-sectional views of an exemplary sleeve portion including one or more biometric-retaining grooves and/or one or more biometric retainers.
Figure 20B:
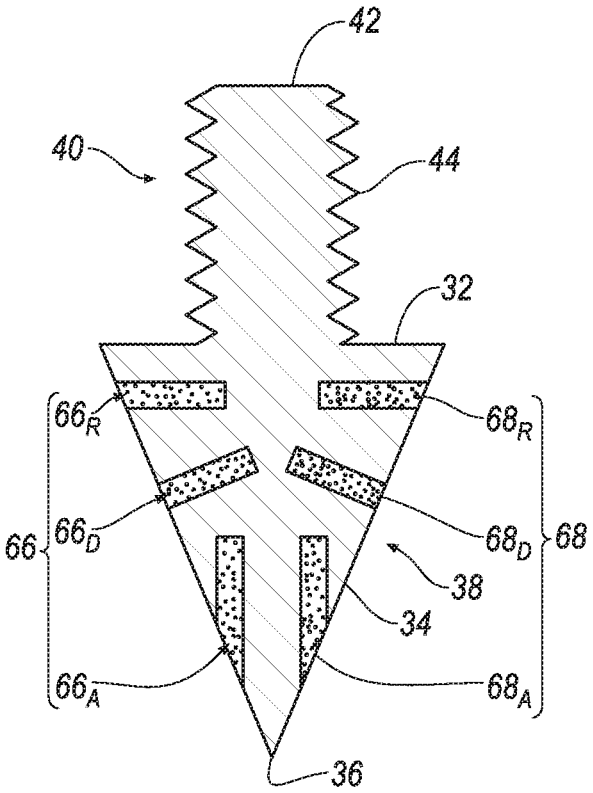

In other examples, one or more biometric-retaining grooves 66 extend into one or more of: (1) the trailing portion of the weapon 16 defined by the distal sleeve portion 12*b* as seen at FIGS. 19A and 19B; and (2) the leading portion of the weapon 16 defined by the adapter portion 14 as seen at FIGS. 20A and 20B. The one or more biometric-retaining grooves 66 may include one or more axially extending biometric-retaining grooves $\mathbf{66}_A$, one or more radially extending biometric-retaining grooves $\mathbf{66}_R$, and one or more diagonally extending biometric-retaining grooves $\mathbf{66}_D$. Each of the one or more biometric-retaining grooves 66 may be arranged in a random configuration or a pattern. If arranged in a pattern, the one or more biometric-retaining grooves 66 may circumscribe the central axis $A_{12}$-$A_{12}$ that extends through the axial center of the sleeve portion 12 and/or the central axis $A_{14}$-$A_{14}$ that extends through the axial center of the adapter portion 14.

Referring to FIGS. 19A-19B and 20A-20B, other configurations of one or both of the sleeve portion 12 and the adapter portion 14 includes one or more biometric retainers 68 disposed within the one or more biometric-retaining grooves 66. The one or more biometric retainers 68 may be defined by, for example, a sponge, a paper, a cloth material or the like that will fluidly absorb and/or provide a frictional retaining surface for retaining one or more biometrics (e.g., blood, skin tissue, hair and the like) of an assailant in the event that a user wields the weapon 66 provided by the self-defense apparatus 10.

Figure 21A:
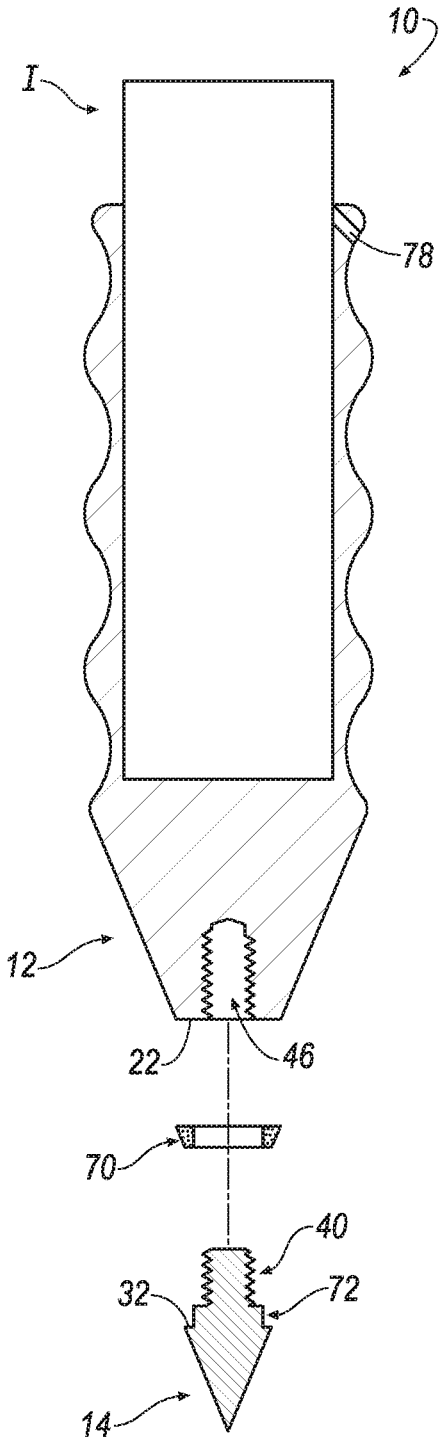
FIGS. 21A-21B illustrate an exemplary self-defense apparatus including an exemplary biometric retainer, the sleeve portion of FIG. 4 and exemplary adapter portion that collectively-forms a biometric retainer gap that selectively retains the exemplary biometric retainer.
Figure 21B:
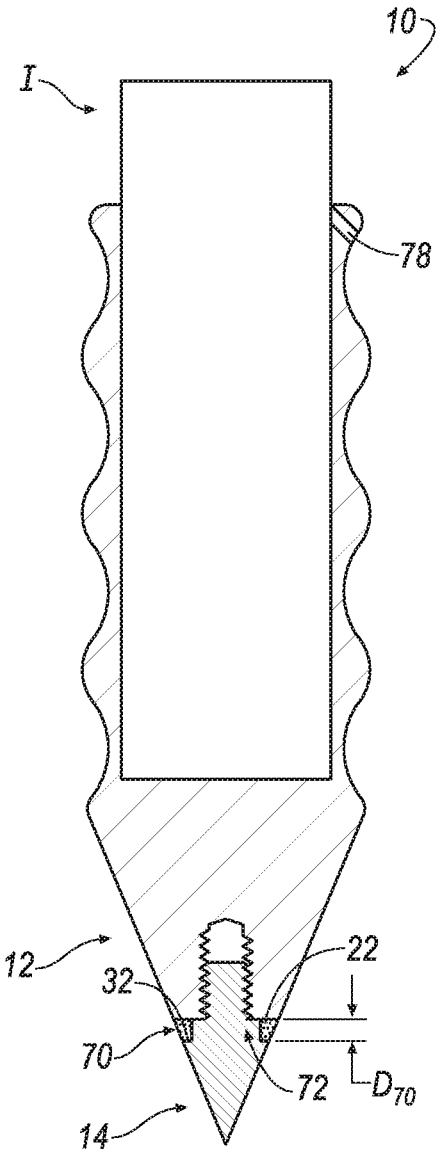

Referring to FIGS. 21A and 21B, other configurations of one or both of the sleeve portion 12 and the adapter portion 14 forms a gap between the proximal end surface 32 of the adapter body 30 of the adapter portion 14 and the distal end surface 22 of the sleeve portion 12 that is sized for removably-securing a biometric retainer 70. In some examples, the proximal end surface 32 of the adapter body 30 integrally includes an adapter-side spacer 72 that includes the fastener 40 extending therefrom. When the adapter portion 14 is selectively fastened to the sleeve portion 12 as described above, the adapter-side spacer 72 results in the proximal end surface 32 of the adapter body 30 being spaced apart from the distal end surface 22 of the sleeve portion 12 at a gap defined by a distance $D_{70}$ for removably-securing the biometric retainer 70.

Figure 22A:
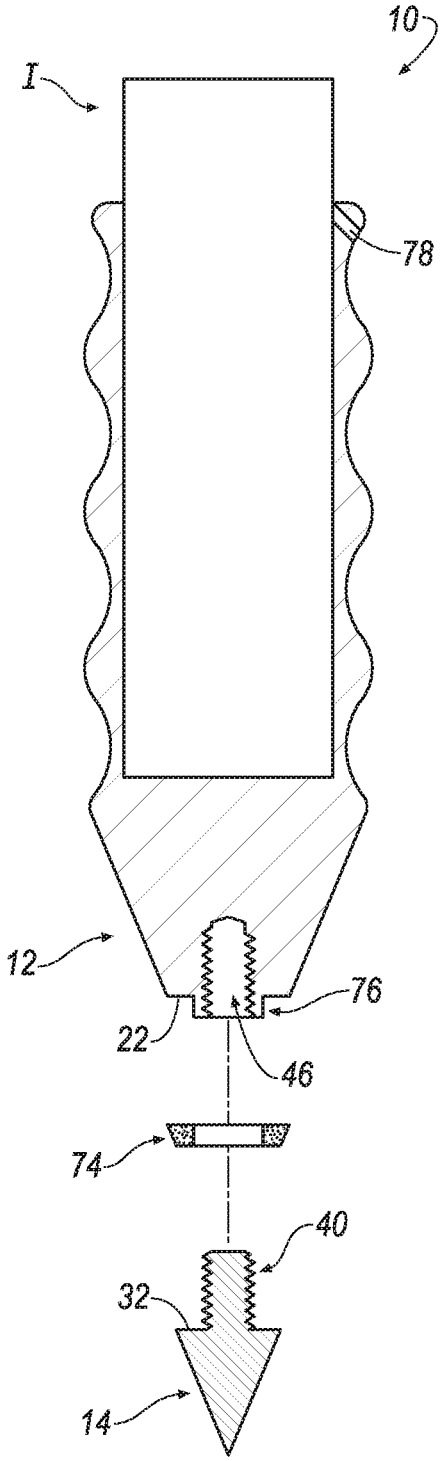
FIGS. 22A-22B illustrate an exemplary self-defense apparatus including an exemplary biometric retainer, the adapter portion of FIG. 5 and exemplary sleeve portion that collectively-forms a biometric retainer gap that selectively retains the exemplary biometric retainer.
Figure 22B:
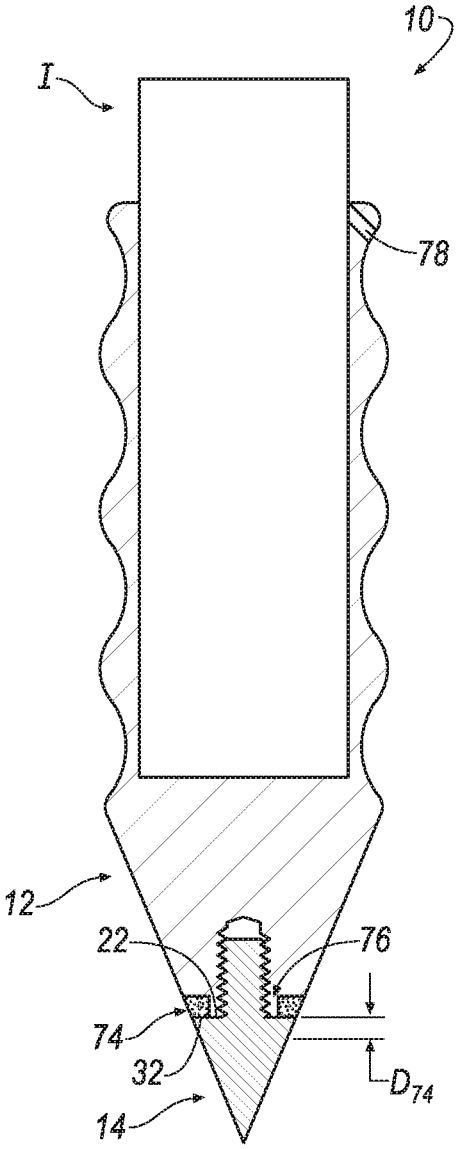

Referring to FIGS. 22A and 22B, other configurations of one or both of the sleeve portion 12 and the adapter portion 14 forms a gap between the proximal end surface 32 of the adapter body 30 of the adapter portion 14 and the distal end surface 22 of the sleeve portion 12 that is sized for removably-securing a biometric retainer 74. In other examples, the distal end surface 22 of the sleeve portion 12 integrally includes a sleeve-side spacer 76 that partially forms the fastener-receiving passage 46. When the adapter portion 14 is selectively fastened to the sleeve portion 12 as described above, the sleeve-side spacer 76 results in the proximal end surface 32 of the adapter body 30 being spaced apart from the distal end surface 22 of the sleeve portion 12 at a gap defined by a distance $D_{74}$ for removably-securing the biometric retainer 74.

Figure 23A:
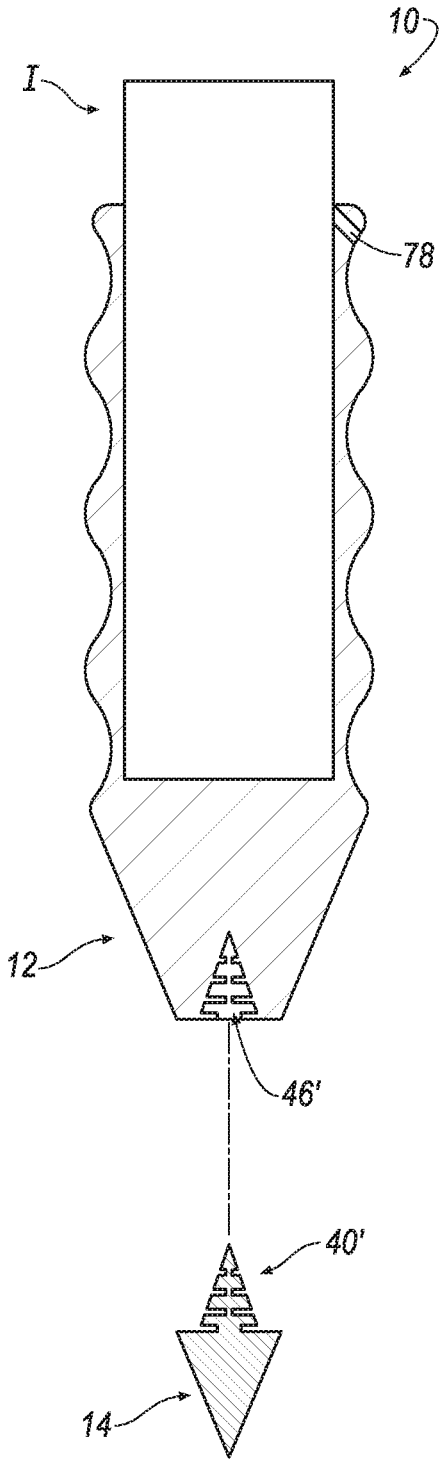
FIGS. 23A-23B illustrate an exemplary self-defense apparatus including an exemplary sleeve portion forming a one-way fastener passage and an exemplary adapter portion including a one-way fastener that is sized for receipt in the one-way fastener passage.
Figure 23B:
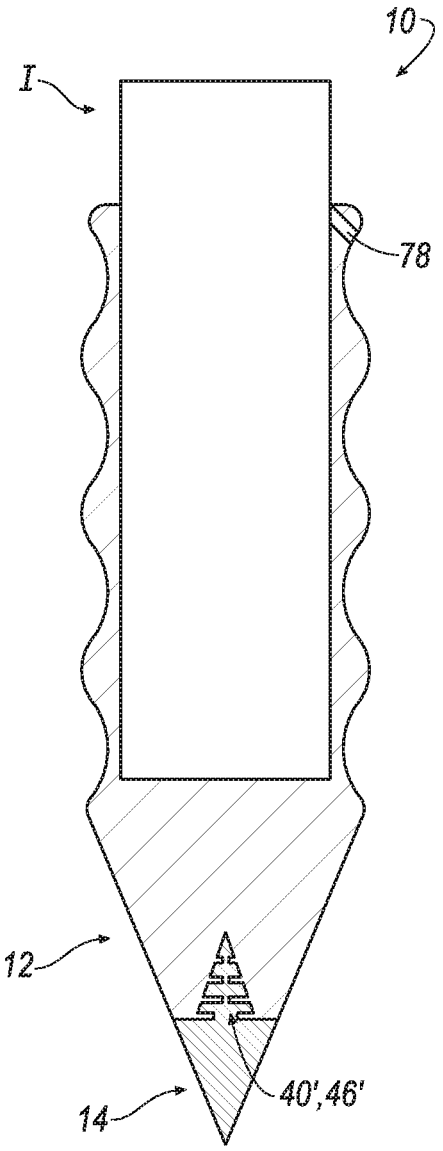

Referring to FIGS. 23A and 23B, other configurations of one or both of the sleeve portion 12 and the adapter portion 14 includes an alternative fastener that is seen generally at 40' and an alternative fastener-receiving passage that is seen generally at 46'. The fastener 40' may be referred to as a one-way fastener, and the fastener-receiving passage 46' may be referred to as a one-way fastener-receiving passage. As seen at FIGS. 23A and 23B, the one-way fastener 40' may include barbs that project radially away from an axial stem portion. In some implementations, the one-way fastener 40' is referred to as a "Christmas Tree fastener."

Unlike the threaded fastener 40 and the threaded fastener-receiving passage 46 described above in the preceding exemplary implementations, when the one-way fastener 40' is inserted in the one-way fastener-receiving passage 46', the one-way fastener 40' is non-removably disposed within the one-way fastener-receiving passage 46'. Accordingly, the adapter portion 14 including the one-way fastener 40' is non-removably connected to the sleeve portion 12 defining the one-way fastener-receiving passage 46'. Although FIGS. 23A and 23B describe the adapter portion 14 including the one-way fastener 40' and the sleeve portion 12 defining the one-way fastener-receiving passage 46', alternative configurations include the sleeve portion 12 including the one-way fastener 40' and the adapter portion 14 defining the one-way fastener-receiving passage 46' in order to non-removably connect the adapter portion 14 to the sleeve portion 12.

Referring to FIGS. 1-4, 7-9, 13A-13C, 14A-14C, 15A-15C, 16A-16C, 17A-17B, 18A-18C, 19A-19B, 21A-21B, 22A-22B, 24-25, 26-27, 28-29 and 30-31, other configurations of the sleeve portion 12 includes a lanyard or key-ring passage 78 extending through, for example, the proximal sleeve portion/the handle portion 12*a*. An implement such as a lanyard or key-ring may be extended through the lanyard or key-ring passage 78 such that a user may not have to grasp the proximal sleeve portion/the handle portion 12*a* in order to carry the self-defense apparatus 10.

A number of implementations have been described. Nevertheless, it will be understood that various modifications may be made without departing from the spirit and scope of the disclosure. Accordingly, other implementations are within the scope of the following claims.

What is claimed is:

1. A self-defense apparatus comprising:

a sleeve portion including a proximal end surface, an outer side surface, and a distal end surface, wherein the sleeve portion defines an implement-receiving cavity that extends axially into the proximal end surface, wherein the sleeve portion defines an adapter-receiving passage that extends axially into the distal end surface, wherein a proximal portion of the outer side surface defines a handle portion, wherein the handle portion includes one or more finger grooves, and wherein a distal portion of the outer side surface defines an adapter-interfacing body; and an adapter body connected to the sleeve portion, wherein a first portion of the adapter body is disposed within the adapter-receiving passage, wherein a second portion of the adapter body extends beyond the distal end surface, and wherein a distal portion of the second portion of the adapter body defines a conical body.

2. The self-defense apparatus of claim 1, wherein the implement-receiving cavity is sized for selectively retaining at least a portion of a length of an implement.

3. The self-defense apparatus of claim 1, wherein the implement-receiving cavity is cylindrically shaped, and the implement is cylindrically shaped.

4. The self-defense apparatus of claim 3, wherein the cylindrically-shaped implement includes a pepper spray canister.

5. The self-defense apparatus of claim 1, wherein the conical body defines a stabbing tip.

6. The self-defense apparatus of claim 1, wherein the conical body defines a sharp stabbing tip.

7. The self-defense apparatus of claim 1, wherein the proximal portion of the outer side surface defines a passage.

8. The self-defense apparatus of claim 1, wherein the adapter body is non-removably attached to the sleeve portion.

9. The self-defense apparatus of claim 1, wherein the sleeve portion and the adapter body are separate components that are integrated.

10. The self-defense apparatus of claim 9, wherein the sleeve portion and the adapter body are integrated by over-molding.

11. The self-defense apparatus of claim 10, wherein the sleeve portion is molded over the adapter body.

12. The self-defense apparatus of claim 1, wherein the sleeve portion is formed from a first material, wherein the adapter body is formed from a second material.

13. The self-defense apparatus of claim 12, wherein the first material is a non-metallic material, wherein the second material is a metallic material.

14. The self-defense apparatus of claim 12, wherein the first material is a plastic material, wherein the second material is a metallic material.

15. The self-defense apparatus of claim 12, wherein the first material is a non-metallic material, wherein the second material is steel.

16. A self-defense apparatus comprising:

a sleeve portion formed from a non-metallic material, wherein the sleeve portion includes a proximal end surface, an outer side surface, and a distal end surface, wherein the sleeve portion defines an implement-receiving cavity that extends axially into the proximal end surface, wherein the sleeve portion defines an adapter-receiving passage that extends axially into the distal end surface, wherein a proximal portion of the outer side surface defines a handle portion, wherein the handle portion includes one or more finger grooves, and wherein a distal portion of the outer side surface defines an adapter-interfacing body; and an adapter body formed from a metallic material, wherein the adapter body is connected to the sleeve portion, wherein a first portion of the adapter body is disposed within the adapter-receiving passage, wherein a second portion of the adapter body extends beyond the distal end surface, and wherein a distal portion of the second portion of the adapter body defines a conical body.

17. The self-defense apparatus of claim 16, wherein the non-metallic material is plastic, wherein the metallic material is steel.

18. A self-defense apparatus comprising:

a sleeve portion formed from a non-metallic material; and an adapter body formed from a metallic material, wherein the sleeve portion and the adapter portion are integrated by over-molding the non-metallic material over the metallic material, wherein the sleeve portion includes a proximal end surface, an outer side surface, and a distal end surface, wherein the sleeve portion defines an implement-receiving cavity that extends axially into the proximal end surface, wherein the sleeve portion defines an adapter-receiving passage that extends axially into the distal end surface, wherein a proximal portion of the outer side surface defines a handle portion, wherein the handle portion includes one or more finger grooves, and wherein a distal portion of the outer side surface defines an adapter-interfacing body, wherein a first portion of the adapter body is disposed within the adapter-receiving passage, wherein a second portion of the adapter body extends beyond the distal end surface, and wherein a distal portion of the second portion of the adapter body defines a conical body.

19. The self-defense apparatus of claim 18, wherein the non-metallic material is plastic, wherein the metallic material is steel.

20. The self-defense apparatus of claim 18, wherein the adapter body is non-removably attached to the sleeve portion.

* * * * *